US011744320B2

(12) United States Patent
Hopkins et al.

(10) Patent No.: US 11,744,320 B2
(45) Date of Patent: Sep. 5, 2023

(54) FOOTWEAR ARTICLE CAPABLE OF HANDS-FREE DONNING

(71) Applicant: NIKE, Inc., Beaverton, OR (US)

(72) Inventors: Timothy P. Hopkins, Lake Oswego, OR (US); Austin J. Orand, Portland, OR (US); Wade Flanagan, Portland, OR (US); Aaron B. Weast, Portland, OR (US); Peter P. Williams, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/950,798

(22) Filed: Sep. 22, 2022

(65) Prior Publication Data

US 2023/0016825 A1 Jan. 19, 2023

Related U.S. Application Data

(60) Continuation of application No. 17/750,193, filed on May 20, 2022, which is a division of application No.

(Continued)

(51) Int. Cl.

| | |
|---|---|
| ***A43B 11/00*** | (2006.01) |
| ***A43B 23/02*** | (2006.01) |
| ***A43B 23/08*** | (2006.01) |

(52) U.S. Cl.

CPC ..... *A43B 11/00* (2013.01); *A43B 23/028* (2013.01); *A43B 23/088* (2013.01)

(58) Field of Classification Search

CPC ..... A43B 11/00; A43B 11/02; A43B 23/08; A43B 23/088

(Continued)

(56) References Cited

U.S. PATENT DOCUMENTS

| | | | | |
|---|---|---|---|---|
| 91,547 A | | 6/1869 | Leathe | |
| 112,439 A | * | 3/1871 | Francis | A43B 3/16 36/138 |

(Continued)

FOREIGN PATENT DOCUMENTS

| | | |
|---|---|---|
| CN | 2138904 Y | 7/1993 |
| CN | 2438353 Y | 7/2001 |

(Continued)

OTHER PUBLICATIONS

Anonymous, "Two Piece Snap Rivets", ITW Fastex, Plastic Fasteners Catalog, Retrieved from the Internet: <http://www.itw-fastex.com/catalog/index.php/dw/op/a/6/c/14/p/27?m=no#specs>, Jan. 30, 2008, pp. 1-2.

(Continued)

*Primary Examiner* — Marie D Bays

(74) *Attorney, Agent, or Firm* — SHOOK, HARDY & BACON L.L.P.

(57) ABSTRACT

A footwear article includes a collar slide that is conducive to hands-free donning to secure the wearer's foot during wear. A footwear article capable of hands-free donning comprises a sole including a ground-contacting surface and a foot-facing surface and an upper having a heel region. The footwear article also includes a strobel, the strobel affixed to the foot-facing surface of the sole and a collar elevator comprising a heel structure, the collar elevator connected with the strobel and coupled with the upper in the heel region. The collar elevator includes a collar slide forming a ramp interface during a donning operation.

19 Claims, 29 Drawing Sheets

Related U.S. Application Data

16/725,860, filed on Dec. 23, 2019, now Pat. No. 11,344,077.

(60) Provisional application No. 62/785,948, filed on Dec. 28, 2018.

(58) Field of Classification Search
USPC ..... 36/69, 138
See application file for complete search history.

(56) References Cited

U.S. PATENT DOCUMENTS 219,436 A 9/1879 Beneke
487,860 A * 12/1892 Vail ..... A43B 3/0031 36/1
827,330 A 7/1906 Tillson
863,549 A 8/1907 Metz
882,109 A 3/1908 Harris
905,323 A 12/1908 King et al.
911,025 A 2/1909 Blaisdell
1,028,598 A 6/1912 Papp
1,081,678 A 12/1913 Langerak
1,155,354 A 10/1915 Hallock
1,275,895 A 8/1918 Fox
1,464,342 A 8/1923 Rothacher
1,494,236 A 5/1924 Greathouse
1,686,175 A 10/1928 Read
D98,150 S 1/1936 Drake
2,069,752 A 2/1937 Dorr
2,097,810 A 11/1937 Dawes
2,450,250 A 9/1948 Napton
2,452,502 A 10/1948 Tarbox
2,736,110 A * 2/1956 Hardimon ..... A43B 23/08 36/58.5
2,920,402 A * 1/1960 Minera ..... A43B 3/102 36/58.5
3,146,535 A * 9/1964 Owings ..... A43B 11/00 36/58.6
3,192,651 A 7/1965 Smith
4,489,509 A 12/1984 Libit
4,608,769 A 9/1986 Sturlaugson
4,876,806 A 10/1989 Robinson et al.
4,972,613 A 11/1990 Loveder
5,054,216 A 10/1991 Lin
5,090,140 A 2/1992 Sessa
5,152,082 A * 10/1992 Culpepper ..... A43B 7/20 602/65
5,181,331 A 1/1993 Berger
5,184,410 A 2/1993 Hamilton
5,279,051 A 1/1994 Whatley
5,282,327 A 2/1994 Ogle
5,317,819 A 6/1994 Ellis
5,341,583 A 8/1994 Hallenbeck
5,371,957 A 12/1994 Gaudio
5,406,721 A 4/1995 Marcolin
5,467,537 A 11/1995 Aveni et al.
5,481,814 A 1/1996 Spencer
5,826,353 A 10/1998 Woznicki
5,842,292 A 12/1998 Siesel
5,926,978 A 7/1999 Smith
5,933,986 A 8/1999 Donnadieu
6,000,148 A 12/1999 Cretinon
6,189,239 B1 2/2001 Gasparovic et al.
6,298,582 B1 10/2001 Friton et al.
6,314,662 B1 11/2001 Ellis
6,360,454 B1 3/2002 Dachgruber et al.
6,378,230 B1 4/2002 Rotem et al.
6,497,058 B2 12/2002 Dietrich et al.
6,557,271 B1 5/2003 Weaver
6,684,533 B1 2/2004 Su
6,874,255 B2 4/2005 Bernstein
6,880,272 B2 4/2005 Wells
6,925,732 B1 8/2005 Clarke
6,938,361 B2 9/2005 Su
7,082,702 B2 8/2006 Cretinon
7,103,994 B2 9/2006 Johnson
7,225,563 B2 6/2007 Chen et al.
7,392,603 B1 7/2008 Shepherd et al.
7,439,837 B2 10/2008 Mcdonald
7,685,747 B1 3/2010 Gasparovic et al.
7,793,438 B1 9/2010 Busse et al.
7,823,299 B1 11/2010 Brigham
7,975,403 B2 7/2011 Mosher
3,020,317 A1 9/2011 Sokolowski
D648,512 S 11/2011 Schlageter et al.
8,056,264 B2 11/2011 Sato et al.
8,065,819 B2 11/2011 Kaufman
8,161,669 B2 4/2012 Keating
8,245,421 B2 8/2012 Baudouin et al.
8,769,845 B2 7/2014 Lin
9,192,204 B1 11/2015 Liles et al.
9,820,527 B2 11/2017 Pratt et al.
9,867,426 B2 1/2018 Conant et al.
D840,663 S 2/2019 Flanagan et al.
D854,303 S 7/2019 Flanagan et al.
10,455,898 B1 10/2019 Orand et al.
10,617,174 B1 4/2020 Hopkins et al.
10,638,810 B1 5/2020 Cheney et al.
10,905,192 B1 2/2021 Cheney
11,191,321 B2 12/2021 Kilgore et al.
11,219,274 B2 1/2022 Orand et al.
11,344,077 B2 * 5/2022 Hopkins ..... A43B 23/028
2002/0053147 A1 5/2002 Borsoi et al.
2002/0066213 A1 * 6/2002 Wells ..... A47G 25/82 223/118
2002/0092205 A1 7/2002 Hall et al.
2002/0112376 A1 8/2002 Tomat
2002/0144434 A1 10/2002 Farys et al.
2004/0088890 A1 5/2004 Matis et al.
2004/0111921 A1 6/2004 Lenormand
2004/0244226 A1 12/2004 Farys et al.
2005/0039348 A1 2/2005 Raluy et al.
2005/0081404 A1 * 4/2005 Hurd ..... A43B 11/02 36/89
2005/0198869 A1 9/2005 Bouche et al.
2006/0010718 A1 1/2006 Auger et al.
2006/0032091 A1 2/2006 Kilgore
2007/0074425 A1 4/2007 Leong
2007/0256332 A1 11/2007 Calderone
2008/0083138 A1 4/2008 Lacorazza et al.
2008/0086911 A1 4/2008 Labbe
2008/0120871 A1 5/2008 Sato et al.
2008/0155788 A1 7/2008 Wilcox
2008/0307673 A1 12/2008 Johnson
2009/0100712 A1 4/2009 Baker et al.
2011/0016751 A1 1/2011 Somerville
2011/0078922 A1 4/2011 Cavaliere et al.
2011/0119959 A1 5/2011 Bodner
2011/0146106 A1 * 6/2011 Kaufman ..... A43C 11/00 36/43
2011/0185592 A1 8/2011 Nishiwaki et al.
2011/0308109 A1 12/2011 Sokolowski
2012/0079742 A1 4/2012 Ferreira et al.
2012/0180338 A1 7/2012 Lin
2012/0192453 A1 8/2012 Raysse et al.
2012/0198721 A1 8/2012 Cavaliere
2012/0297643 A1 11/2012 Shaffer et al.
2012/0304491 A1 12/2012 Kimura et al.
2012/0317839 A1 12/2012 Pratt
2013/0185959 A1 7/2013 Coleman
2013/0219747 A1 8/2013 Lederer
2013/0247416 A1 9/2013 Nurse et al.
2014/0130376 A1 * 5/2014 Fahmi ..... D04B 1/123 36/84
2014/0137434 A1 * 5/2014 Craig ..... A43B 23/0215 66/170
2014/0150292 A1 * 6/2014 Podhajny ..... D04B 1/106 36/50.1
2014/0173935 A1 6/2014 Sabbioni
2014/0202044 A1 7/2014 Adami et al.
2014/0305005 A1 10/2014 Yeh
2015/0143720 A1 5/2015 Avar
2015/0237960 A1 8/2015 Mallen et al.

(56) References Cited

U.S. PATENT DOCUMENTS

| | | | | |
|---|---|---|---|---|
| 2015/0305432 | A1 | 10/2015 | Wiens | |
| 2016/0007687 | A1 | 1/2016 | Surace et al. | |
| 2016/0029743 | A1 | 2/2016 | Cavaliere et al. | |
| 2016/0088899 | A1 | 3/2016 | Liles et al. | |
| 2016/0302530 | A1 | 10/2016 | Smith et al. | |
| 2016/0324269 | A1 | 11/2016 | Dombrow et al. | |
| 2016/0332063 | A1 | 11/2016 | Van Horne | |
| 2016/0374427 | A1* | 12/2016 | Zahabian | A43B 3/24 36/102 |
| 2017/0055630 | A1 | 3/2017 | Marshall | |
| 2017/0099908 | A1 | 4/2017 | Lee et al. | |
| 2017/0105485 | A1 | 4/2017 | Schenone et al. | |
| 2017/0231319 | A1 | 8/2017 | Bohnsack et al. | |
| 2017/0303632 | A1* | 10/2017 | Pratt | A43B 11/00 |
| 2017/0360143 | A1 | 12/2017 | Pratt et al. | |
| 2017/0360151 | A1 | 12/2017 | Pratt | |
| 2017/0370027 | A1* | 12/2017 | da Costa Pereira Machado | D02G 3/32 |
| 2018/0098601 | A1 | 4/2018 | Hartenstein et al. | |
| 2018/0110287 | A1 | 4/2018 | Hopkins et al. | |
| 2018/0110292 | A1 | 4/2018 | Beers et al. | |
| 2018/0206588 | A1 | 7/2018 | Pratt et al. | |
| 2018/0213882 | A1 | 8/2018 | Morse | |
| 2018/0279721 | A1 | 10/2018 | Doenges | |
| 2018/0289109 | A1* | 10/2018 | Beers | A43B 11/00 |
| 2018/0338583 | A1 | 11/2018 | Sullivan | |
| 2019/0045884 | A1 | 2/2019 | Uda et al. | |
| 2019/0297999 | A1 | 10/2019 | Nakaya et al. | |
| 2020/0000178 | A1 | 1/2020 | Pratt et al. | |
| 2020/0196703 | A1 | 6/2020 | Hopkins | |
| 2020/0196709 | A1 | 6/2020 | Orand et al. | |
| 2020/0205511 | A1 | 7/2020 | Hopkins et al. | |
| 2020/0205518 | A1 | 7/2020 | Hopkins et al. | |
| 2020/0205520 | A1 | 7/2020 | Kilgore | |
| 2020/0229536 | A1 | 7/2020 | Hopkins et al. | |
| 2020/0253333 | A1 | 8/2020 | Kilgore et al. | |
| 2020/0297076 | A1 | 9/2020 | Kilgore | |
| 2020/0390183 | A1 | 12/2020 | Arnold | |
| 2021/0068494 | A1 | 3/2021 | Zahabian | |
| 2021/0106094 | A1 | 4/2021 | Cheney | |
| 2021/0112914 | A1 | 4/2021 | Cheney | |
| 2021/0112915 | A1 | 4/2021 | Hopkins | |
| 2021/0112916 | A1 | 4/2021 | Schulten | |
| 2021/0204643 | A1 | 7/2021 | Kyle | |
| 2021/0204644 | A1 | 7/2021 | Kyle | |
| 2021/0378356 | A1 | 12/2021 | Cheney et al. | |
| 2022/0000220 | A1 | 1/2022 | Orand et al. | |
| 2022/0273069 | A1 | 9/2022 | Hopkins et al. | |

FOREIGN PATENT DOCUMENTS

| | | | |
|---|---|---|---|
| CN | 1403041 | A | 3/2003 |
| CN | 1832693 | A | 9/2006 |
| CN | 1993064 | A | 7/2007 |
| CN | 101022744 | A | 8/2007 |
| CN | 201005111 | Y | 1/2008 |
| CN | 101480282 | A | 7/2009 |
| CN | 101991227 | A | 3/2011 |
| CN | 101991227 | B | 8/2012 |
| CN | 102762121 | A | 10/2012 |
| CN | 103313622 | A | 9/2013 |
| CN | 104203024 | A | 12/2014 |
| CN | 204317632 | U | 5/2015 |
| CN | 105163616 | A | 12/2015 |
| CN | 105611851 | A | 5/2016 |
| CN | 205568021 | U | 9/2016 |
| CN | 108697196 | A | 10/2018 |
| DE | 3928625 | A1 | 3/1991 |
| DE | 19534249 | A1 | 3/1997 |
| DE | 19611797 | A1 | 10/1997 |
| DE | 29809404 | | 8/1998 |
| DE | 10247163 | A1 | 4/2004 |
| DE | 102004005288 | A1 | 8/2005 |
| EP | 0149362 | A2 | 7/1985 |
| EP | 1059044 | A1 | 12/2000 |
| EP | 2319344 | A1 | 5/2011 |
| EP | 2438826 | A1 | 4/2012 |
| FR | 1083503 | A | 1/1955 |
| FR | 1474203 | A | 3/1967 |
| GB | 503525 | A | 4/1939 |
| GB | 2517148 | A | 2/2015 |
| GB | 2517399 | A | 2/2015 |
| JP | 50-11740 | U | 2/1975 |
| JP | 56-158803 | U | 11/1981 |
| JP | 57-72603 | A | 5/1982 |
| JP | 1-80010 | U | 5/1989 |
| JP | 1-81910 | A | 7/1989 |
| JP | 1-179511 | U | 12/1989 |
| JP | 2000-139502 | A | 5/2000 |
| JP | 2000-184902 | A | 7/2000 |
| JP | 2001-149394 | A | 6/2001 |
| JP | 2005-046520 | A | 2/2005 |
| JP | 2005-532115 | A | 10/2005 |
| JP | 2006-055571 | A | 3/2006 |
| JP | 2012-061046 | A | 3/2012 |
| JP | 2012-110687 | A | 6/2012 |
| KR | 20090130804 | A | 12/2009 |
| NL | 2000762 | C1 | 1/2009 |
| TW | 200743450 | A | 12/2007 |
| WO | 90/00358 | A1 | 1/1990 |
| WO | 2007/080205 | A1 | 7/2007 |
| WO | 2009/154350 | A1 | 12/2009 |
| WO | 2010/059716 | A2 | 5/2010 |
| WO | 2015/183486 | A1 | 12/2015 |
| WO | 2016/002412 | A1 | 1/2016 |
| WO | 2017/090195 | A1 | 6/2017 |

OTHER PUBLICATIONS

Intention to Grant received for European Patent Application No. 19836920.9, dated Oct. 28, 2022, 6 pages.

Partial European Search Report received for European Application No. 22191953.3, dated Sep. 29, 2022, 11 pages.

Extended European Search Report received for European Application No. 22191953.3, dated Jan. 9, 2023, 10 pages.

Final Office Action received for U.S. Appl. No. 17/135,220, dated Jan. 25, 2023, 22 pages.

Notice of Allowance received for U.S. Appl. No. 17/482,809, dated Feb. 1, 2023, 5 pages.

Final Office Action received for U.S. Appl. No. 16/839,744, dated Dec. 9, 2022, 18 pages.

Non-Final Office Action received for U.S. Appl. No. 17/482,809, dated Nov. 22, 2022, 5 pages.

Non-Final Office Action received for U.S. Appl. No. 17/950,781, dated Dec. 14, 2022, 9 Pages.

Non-Final Office Action received for U.S. Appl. No. 17/950,814, dated Dec. 27, 2022, 10 pages.

Office Action received for European Patent Application No. 19842673.6, dated Feb. 7, 2023, 6 pages.

Office Action received for European Patent Application No. 19839789.5, dated Mar. 9, 2023, 5 pages.

Nike Lunarglide 7 Review, Solereview Inc., Available online at <https://www.solereview.com/nike-lunarglide-7-review/> Nov. 8, 2015, 40 pages.

Non- Final Office Action received for U.S. Appl. No. 17/950,814, dated Apr. 6, 2023, 8 pages.

Non- Final Office Action received for U.S. Appl. No. 17/750, 193, dated Apr. 7, 2023, 8 pages.

Notice of Allowance received for U.S. Appl. No. 16/839,744, dated Apr. 5, 2023, 15 pages.

* cited by examiner

FOOTWEAR ARTICLE CAPABLE OF HANDS-FREE DONNING

CROSS REFERENCE TO RELATED APPLICATION

This application, entitled "FOOTWEAR ARTICLE CAPABLE OF HANDS-FREE DONNING" is a continuation of pending U.S. application Ser. No. 17/750,193, entitled "FOOTWEAR ARTICLE WITH COLLAR ELEVATOR", and filed on May 20, 2022, which is a divisional of U.S. application Ser. No. 16/725,860, entitled "FOOTWEAR ARTICLE WITH COLLAR ELEVATOR", and filed Dec. 23, 2019. U.S. application Ser. No. 16/725,860 claims the benefit of U.S. Provisional Application No. 62/785,948, entitled "FOOTWEAR ARTICLE WITH COLLAR ELEVATOR", which was filed Dec. 28, 2018. The aforementioned applications are incorporated herein by reference in their entirety.

TECHNICAL FIELD

This disclosure relates to a footwear article capable of hands-free donning.

BACKGROUND

Some footwear articles include an ankle collar that is manipulated when the footwear article is put on. For example, the ankle collar may be depressed towards the sole as the wearer's foot is slid into the upper. Furthermore, some of these footwear articles include a collar elevator operable to move the ankle collar from the depressed or lowered state to the raised state. An example of one type of collar elevator is described in U.S. Pat. No. 9,820,527, and examples of other collar elevators are described in US Pat. Pub. 2018/0110292 and US Pat. Pub. 2018/0289109.

BRIEF DESCRIPTION OF THE DRAWINGS

Some subject matter described in this disclosure makes reference to drawing figures, which are incorporated herein by reference in their entirety.

DETAILED DESCRIPTION

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present technologies or future technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

The subject matter described in this Specification generally relates to, among other things, a footwear article having a collar elevator capable of hands-free donning.

A collar elevator aids in the donning and/or doffing of a footwear article, as will be described in detail hereinafter. It is contemplated that any combination of the following elements and concepts of this paragraph and the Specification as a whole may be formed from the present disclosure. This Specification and supporting figures detail various configurations for the collar elevator arm(s), such as bifurcated, asymmetrical, biased, and undulating collar elevators. The Specification and supporting figures also details various configurations at a proximal end of an arm forming the collar elevator, such as monolithic, mechanically joined, bonded, variably oriented, slideable joined, and integrated. The Specification and the figures also provide details on various configurations for the base to which the proximal end of the arm forming the collar elevator extends, such as a U-shaped element, a bifurcated plate, integral with the sole, and layered with the sole. Further, the Specification and the figures also provide details on cross-sectional shaping of an arm forming the collar elevator. Additionally, the Specification and the figures also provide details on various footwear upper constructions in combination with the collar elevator, such as a heel loop and a collar stay. These various configurations are introduced here to emphasize that any combination of details are contemplated herein. Specific combinations of collar elevator arms, joints, bases, cross-sections, and/or upper elements will be discussed and depicted for illustration purposes, but any combination, unless explicitly indicated to the contrary, may be formed from the selection of details provided herein.

Figure 1:
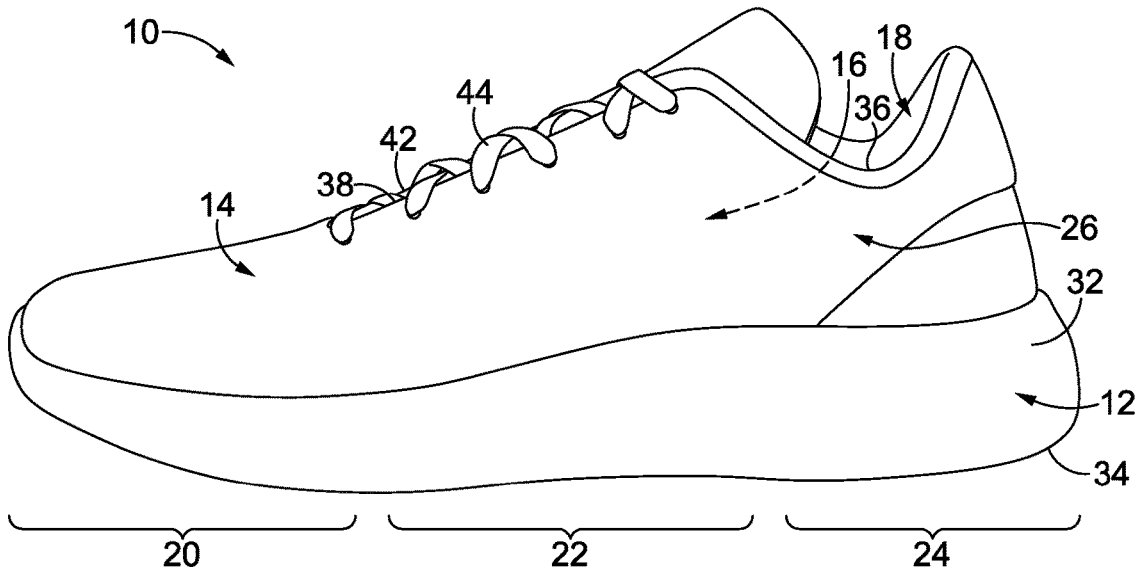
FIG. 1 depicts a side view of a footwear article in accordance with an aspect of this disclosure.
Figure 2:
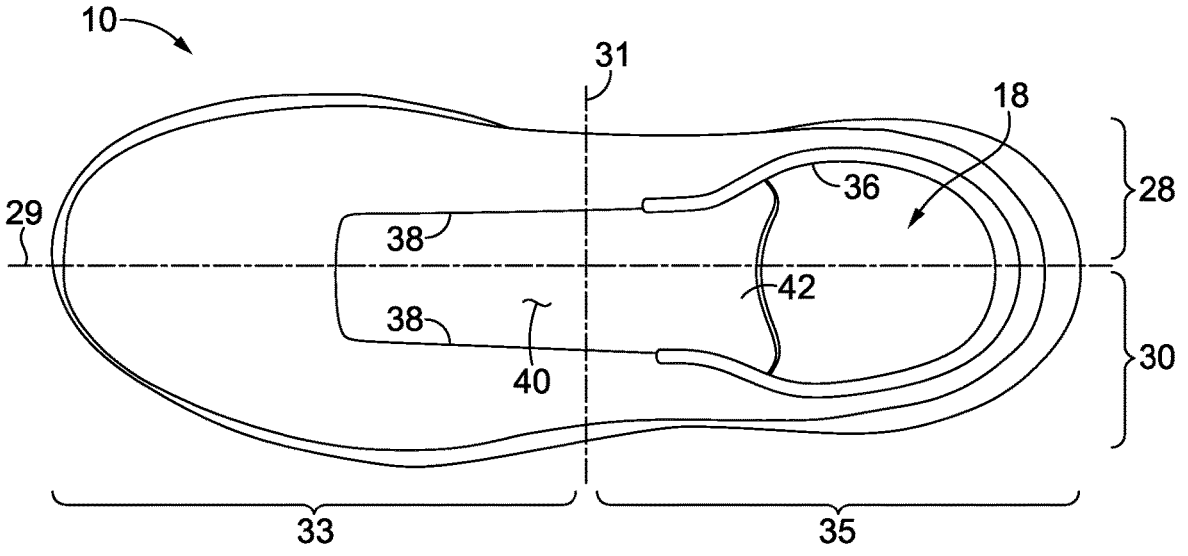
FIG. 2 depicts a top view of the footwear article of FIG. 1 in accordance with an aspect of this disclosure.

In order to aid in the explanation of, and understanding of, aspects of this Specification, reference is now made to FIGS. 1 and 2 to describe elements of a typical footwear article 10, which may include a tongue reinforcer. FIG. 1 depicts a lateral side of the footwear article 10, and FIG. 2 depicts a top of the footwear article. When describing the various figures mentioned in this disclosure, like reference numbers refer to like components throughout the views.

The footwear article 10 includes at least two primary elements including a sole structure 12 and an upper 14. When the footwear article 10 is worn (as intended on a foot), the sole structure 12 is typically positioned near the foot plantar surface (i.e., the bottom of the foot). The sole structure 12 may protect the bottom of the foot, and in addition, may attenuate ground-reaction forces, absorb energy, provide traction, and control foot motion, such as pronation and supination. The upper 14 is coupled to the sole structure 12, and together with the sole structure 12, forms a foot-receiving cavity 16. That is, while the sole structure 12 typically encloses the bottom of the foot, the upper 14 extends over, and at least partially covers, a dorsal portion of the foot (i.e., the top of the foot or the instep) and secures the footwear article 10 to the foot. The upper 14 includes a foot-insertion opening 18, through which a foot is inserted when the footwear article 10 is put on as the foot is arranged into the foot-receiving cavity 16.

As indicated in FIG. 1, the footwear article 10 may include a forefoot region 20, a midfoot region 22, a heel region 24, and an ankle region 26. The forefoot region 20, the midfoot region 22, and the heel region 24 extend through the sole structure 12 and the upper 14. The ankle region 26 is located in a portion of the upper 14. The forefoot region 20 generally includes portions of the article of footwear 10 corresponding with the toes and the joints connecting the metatarsals with the phalanges. The midfoot region 22 generally includes portions of the article of footwear 10 corresponding with the arch area and instep of the foot. The heel region 24 corresponds with rear portions of the foot, including the calcaneus bone. The ankle region 26 corresponds with the ankle. The forefoot region 20, the midfoot region 22, the heel region 24, and the ankle region 26 are not intended to demarcate precise areas of the footwear article 10, and are instead intended to represent general areas of the footwear article 10 to aid in the understanding of various aspects of this Specification. In addition, portions of a footwear article may be described in relative terms using these general zones. For example, a first structure may be described as being more heelward than a second structure, in which case the second structure would be more toeward and closer to the forefoot.

The footwear article 10 also has a medial side 28 (identified in FIG. 2 and obscured from view in FIG. 1) and a lateral side 30 (identified in FIG. 2 and viewable in FIG. 1). The medial side 28 and the lateral side 30 extend through each of the forefoot region 20, the midfoot region 22, the heel region 24, and the ankle region 26, and correspond with opposite sides of the article of footwear 10, each falling on an opposite side of a longitudinal midline reference plane 29 of the article of footwear 10, as is understood by those skilled in the art. For example, the longitudinal midline reference plane 29 may pass through the foremost point of the sole structure and the rearmost point of the sole structure. The medial side 29 is thus considered opposite to the lateral side 30. Typically, the lateral side corresponds with an outside area of the foot (i.e., the surface that faces away from the other foot), and the medial side corresponds with an inside area of the foot (i.e., the surface that faces toward the other foot). In another aspect, the footwear article includes an anterior portion 33 and a posterior portion 35, falling on an opposite side of a latitudinal midline reference plane 31 of the article of footwear 10. The latitudinal midline reference plane 31 extends perpendicular to the longitudinal midline reference plane 29 and to the ground-surface plane and is spaced evenly between the foremost point of the footwear article 10 and the rearmost point of the footwear article 10. In addition, these terms may also be used to describe relative positions of different structures. For example, a first structure that is closer to the inside portion of the footwear article might be described as medial to a second structure, which is closer to the outside area and is more lateral.

In describing a footwear article, the relative terms "inferior" and "superior" may also be used. For example, the superior portion generally corresponds with a top portion that is oriented closer towards a person's head when the person's feet are positioned flat on a horizontal ground surface and the person is standing upright, whereas the inferior portion generally corresponds with a bottom portion oriented farther from a person's head and closer to the ground surface.

The sole structure 12 may be constructed of various materials and may include various elements. For example, the sole structure 12 may include a midsole 32 and an outsole 34. The midsole 32 may be formed from a compressible polymer foam element (e.g., a polyurethane or ethylene vinyl acetate (EVA) foam) that attenuates ground reaction forces (i.e., provides cushioning) when compressed between the foot and the ground during walking, running, or other ambulatory activities. In further aspects, the midsole 32 may incorporate fluid-filled chambers, plates, moderators, or other elements that further attenuate forces, enhance stability, or influence motions of the foot. The midsole 32 may be a single, one-piece midsole, or could be multiple components integrated as a unit. In some aspects, the midsole 32 may be integrated with the outsole 34 as a unisole. The outsole 34 may be one-piece, or may be several outsole components, and may be formed from a wear-resistant rubber material that may be textured to impart traction and/or may include traction elements such as tread or cleats secured to the midsole 32. The outsole 34 may extend either the entire length and width of the sole or only partially across the length and/or width.

The upper 14 may also be constructed of various materials and may include various features. For example, the upper 14 may be constructed of leather, textiles, or other synthetic or natural materials. Further, the upper 14 may be a knit textile, woven, braided, non-woven, laminate, or any combination thereof. The upper 14 may have various material properties related to breathability, stretch, flexibility, wicking, water resistance, and the like.

The upper 14 typically includes a portion that overlaps with, and is connected to, the sole structure 12, and the junction of this connection may be referred to as a biteline. In addition, the upper 14 may include a "strobel," which includes a material panel extending from the upper 14 and across at least a portion of a foot-facing surface of the sole structure 12, and the strobel may be used to hold the upper 14 on a last when the sole structure 12 is attached to the upper 14. Stated differently, the sole structure 12 that is integrated into the footwear article 10 includes a foot-facing surface, and in some instances, the upper 14 may include a panel (referred to as a strobel) that extends inward from near the biteline region and at least partially covers the foot-facing surface. In that instance, the strobel is positioned underneath a foot when the footwear article is worn. The strobel may be covered by an insole or other layer of material.

The upper 14 includes other features. For example, the upper 14 includes an ankle collar 36 that forms a perimeter around at least a portion of the foot-insertion opening 18. In addition, the upper 14 includes a throat 38 that often extends from the ankle collar 36 and forms a perimeter along at least one or more sides of an elongated opening 40. A tongue 42 is located in the elongated opening 40, and a size of the elongated opening 40 can be adjusted using various closure systems. For example, FIG. 1 illustrates laces 44, and other closure systems may include elastic bands, hook-and-loop straps, zippers, buckles, and the like. The position of the tongue 42 and the connections of the closure system can be adjusted to vary a size of the foot-insertion opening and the elongated opening, such as by making the openings larger when the footwear article is being donned or doffed and by making the openings smaller when the footwear article is being secured onto a foot. Additional aspects contemplate the elongated opening 40 (which may also be referred to as a forefoot opening) may be omitted and instead the medial and lateral side of the upper converge and are continuous across an area that traditionally includes the elongated opening 40. Therefore, in some aspects the tongue 42 is integral to the upper, continuous to the upper, contiguous to the upper, and/or the like.

The footwear article 10 might include an athletic-type shoe, such as might be worn when running or walking, and the description of the footwear article 10, including the elements described with respect to FIGS. 1 and 2, might also be applicable to other types of shoes, such as basketball shoes, tennis shoes, American football shoes, soccer shoes, leisure or casual shoes, dress shoes, work shoes, a sandal, a slipper, a boot, hiking shoes, and the like.

Figure 3A:
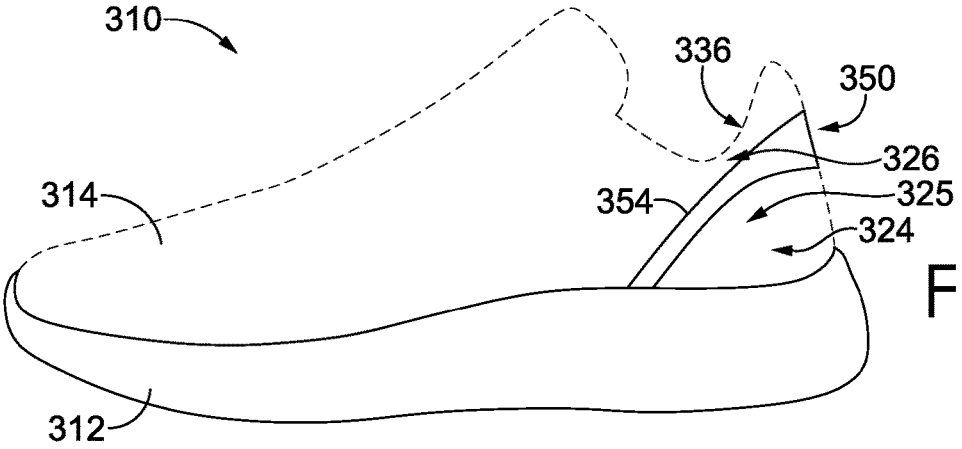
FIGS. 3A-3C depict another footwear article having a collar elevator in accordance with an aspect of this disclosure.
Figure 3B:
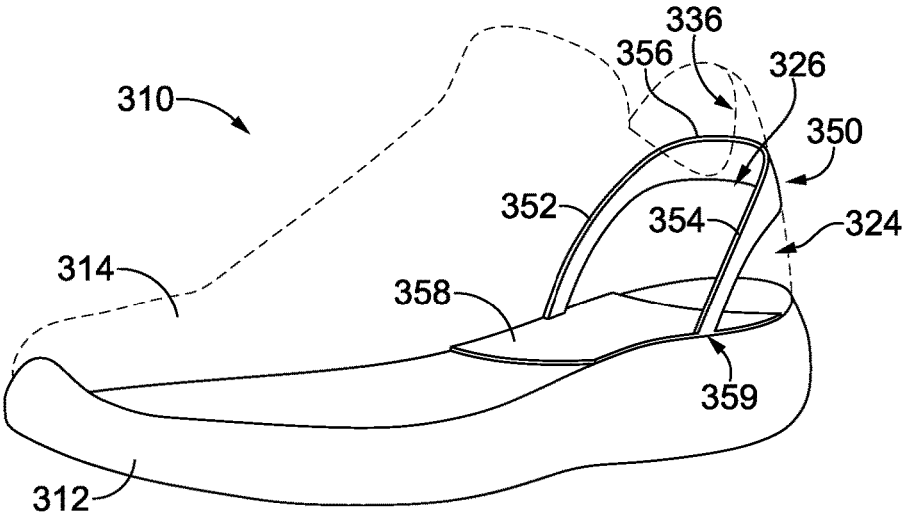
Figure 3C:
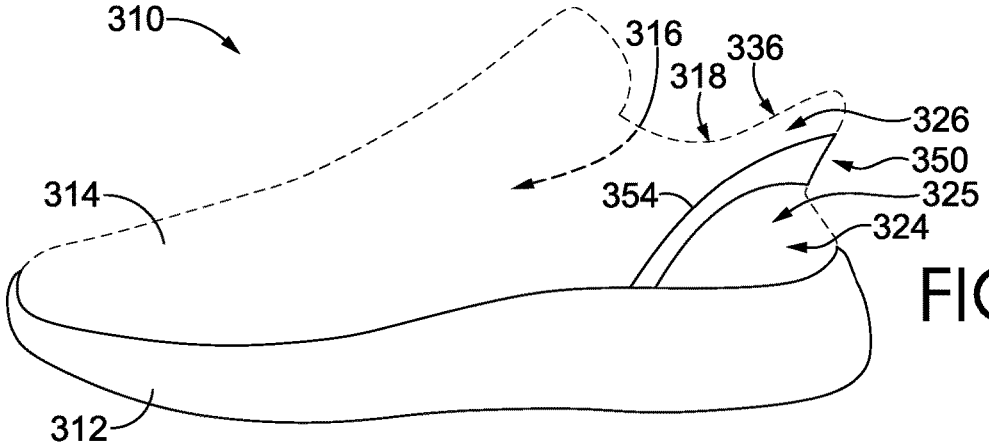

Having described FIGS. 1 and 2, reference is now made to FIGS. 3A-3C and 4A-4C to describe some other aspects of this disclosure. Each of FIGS. 3A, 3B, and 3C depicts a footwear article 310, which includes an upper 314 coupled to a sole 312, and the upper 314 includes an ankle region 326 with an ankle collar 336. The ankle collar 336 is movable between a lowered state (as depicted in FIG. 3C) and a raised state (as depicted in FIGS. 3A and 3B). In the lowered state, the ankle collar 336 is positioned closer to the sole 312, and in the raised state, the ankle collar 336 is positioned farther from the sole 312.

Figure 4A:
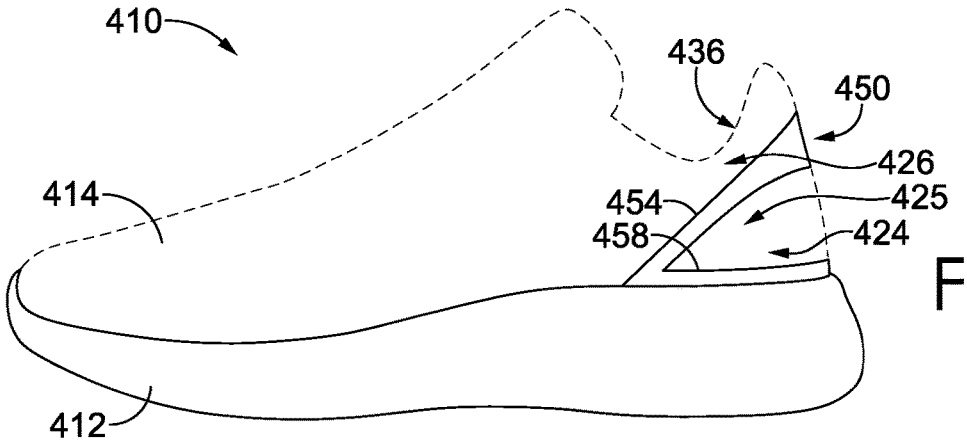
FIGS. 4A-4C depict another footwear article having an alternative collar elevator in accordance with an aspect of this disclosure.
Figure 4B:
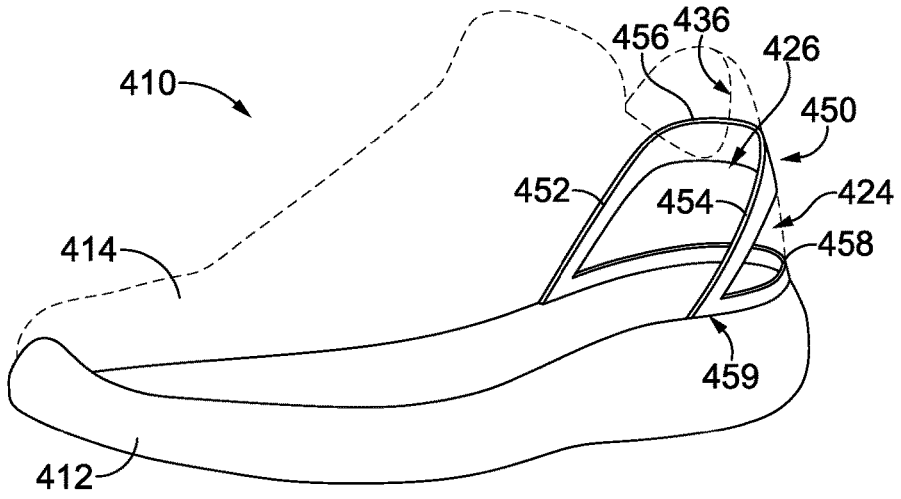
Figure 4C:
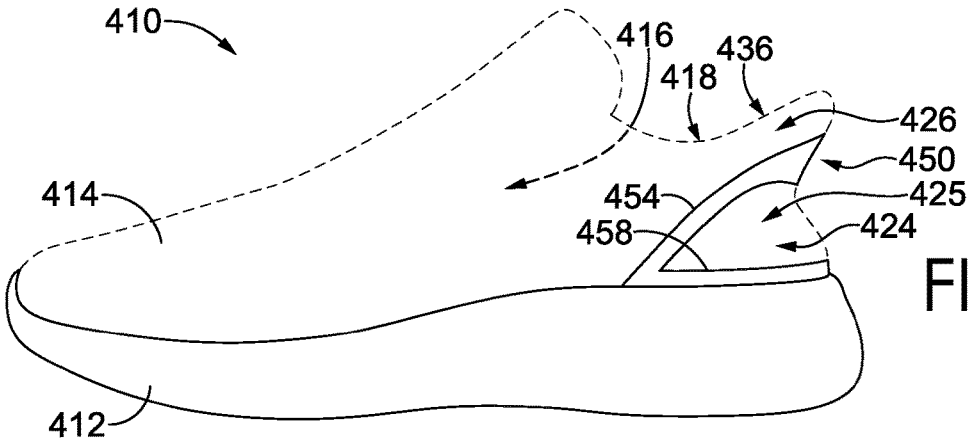

Furthermore, the footwear article 310 includes a collar elevator 350 that is coupled to the upper 314 near the heel region 324 and/or the ankle region 326 and that is operable to move the ankle collar 336 from the lowered state to the raised state. More specifically, the collar elevator 350 includes portions that are positioned in the heel region 324 and that extend up into the ankle region 326. As previously indicated, there are not necessarily precise delineations between the heel region 324 and the ankle region 326; rather, describing the positioning of the collar elevator 350 with respect to these regions is one way to describe that the collar elevator 350 extends from a more inferior part closer to the sole to a more superior part closer to the ankle collar 336. As far as the coupling of the collar elevator 350 to the upper 314 near the heel region 324 and/or near the ankle region 326, this coupling may take various forms. For example, the collar elevator 350 may be coupled to the upper in the heel region 324, in the ankle region 326, to the ankle collar 336, or any and all combinations thereof. The collar elevator 350 is an example of one type of collar elevator operable to move an ankle collar from the lowered state to the raised state, and as will be described in other portions of this disclosure, a collar elevator may include one or more alternative structures than those depicted in FIGS. 3A-3C. For example, FIGS. 4A-4C depict a footwear article 410 with a collar elevator 450 that is operable to move the ankle collar 436 from the lowered state (e.g., FIG. 4C) to the raised state (e.g., FIGS. 4A and 4B) and that has a different structure from the collar elevator 350. Furthermore, FIGS. 5-8 depict examples of bifurcated collar elevators and FIGS. 15-18 depict examples of asymmetrical collar elevators. Additional figures and disclosure in this Specification provide additional alternative collar elevator configurations as will be discussed hereinafter.

For illustrative purposes, the upper 314 and the upper 414 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

A collar elevator (such as the collar elevators 350 and 450) may include various elements. In one aspect, a collar elevator includes a medial lever arm, a lateral lever arm, and (optionally) a center connecting band that couples the medial lever arm to the lateral lever arm and that is located in a heel portion of the ankle collar. For purposes of the present Specification, the terms medial lever arm and lateral lever arm may be substituted with a term first lever arm and a second lever arm when a relative position to the upper is not intended. In a further aspect, each lever arm is affixed to a base, which remains stationary relative to the lever arms as the lever arms deform and/or articulate when the ankle collar is moved to a lowered state. The base may be a portion of the footwear article, such as a portion of the sole or a portion of the upper. In addition, the base may be one or more other anchors affixed directly or indirectly to the sole, the sole itself, or any combination thereof. U.S. Pat. No. 9,820,527 describes one or more collar elevators, some of which may be referred to as a deformable member or as deformable members (with or without a base), and the full disclosure of U.S. Pat. No. 9,820,527 is incorporated herein by reference in its entirety. In accordance with an aspect of this disclosure, at least some of the deformable members described in U.S. Pat. No. 9,820,527 include a medial lever arm, a lateral lever arm, and a center connecting band that couples the medial lever arm to the lateral lever arm. In other examples, US 2018/0110292 and US 2018/0289109 each describes a plurality of other collar elevators, some of which are referred to as a control bar (with or without a base), and the full disclosures of US 2018/0110292 and US 2018/0289109 are incorporated herein by reference in their entirety. In accordance with an aspect of this disclosure, at least some of the control bars described in US 2018/0110292 and US 2018/0289109 include a medial lever arm, a lateral lever arm, and a center connecting band that couples the medial lever arm to the lateral lever arm.

Each of the illustrated collar elevators 350 and 450 depicts examples of medial lever arms 352 and 452, respectively. In addition, each of the illustrated collar elevators 350 and 450 depicts examples of lateral lever arms 354 and 454, respectively, and center connecting bands 356 and 456, respectively. Furthermore, the lever arms 352 and 354 attach to a base 358, and the lever arms 452 and 454 attach to a base 458 having a different structure from the base 358. The base 358 is affixed to or near a foot-facing surface of the sole 312, and the base 358 might be a portion of an outsole, a portion of a midsole, a portion of an insole, a portion of a strobel, a plate or sheet of material layered between any of these sole layers, or any combination thereof. Among other things, the base 358 might include a rigid portion or section to which the lever arms 352 and 354 are anchored. FIGS. 4A-4C depict a different aspect, in which the base 458 might attach to a portion of the upper (e.g., a heel counter), a portion of the midsole sidewall, or any combination thereof, and the base 458 wraps around a backside of the footwear article, as opposed to extending through the footbed in the manner described with respect to the base 358. FIGS. 4A-4C depict similar features of the upper as described in FIGS. 3A-3C, such as ankle collar 436, an ankle region 426, a heel region 424, and a portion 425 of the upper below the center connecting band may include one or more textiles that are more flexible than other portions of the upper.

The medial lever arm, the lateral lever arm, and the center connecting band may be a single continuous body, such that clear demarcation may not exist between the medial lever arm, the lateral lever arm, and the center connecting band (i.e., a monolithic structure). For example, the medial and lateral arms and the center connecting band may be molded, cast, 3D printed, or otherwise formed as a single, integrally formed unit, such as a monolithic structure. In other aspects, the medial lever arm and the lateral lever arm may be discrete, separate, and distinct elongated members, which are connected to the center connecting band, such as by a mechanical or chemical coupling, a friction fit, sheathing, or other coupling.

Having generally described some of the structural elements of a collar elevator, some operational aspects of a collar elevator will now be described. As briefly described above, the collar elevator moves the ankle collar from the lowered state to the raised state. More specifically, at least a portion of the collar elevator is affixed to a portion of the upper. In one aspect, the center connecting band may be affixed near a heel portion of the ankle collar. For example, the center connecting band may be attached to the heel portion of the ankle collar by an adhesive, connection tab, heat stake, stitch, and the like. As such, when the ankle collar is moved to a lowered state closer to the sole, a first lever arm may deform to a more compressed or more loaded position. Stated differently, the collar elevator stores potential energy by elastically deforming from a less compressed configuration (e.g., FIGS. 3A and 4A) to a more compressed configuration (e.g., FIGS. 3C and 4C) when an applied force moves the ankle collar from the raised state to the lowered state. The potential energy returns the collar elevator to the less compressed configuration upon removal of the applied force, and since the collar elevator is affixed to the upper or otherwise physically related to the upper, the ankle collar is also moved from the lowered state to the raised state. While the compression of the collar elevator may be greater when the ankle collar is moved to the lowered state (as compared with the raised state), in the raised state the collar elevator may still store potential energy in an at least partially deformed state (i.e., preloaded compression) so as to be able to hold a rear, heel portion of the ankle collar about the heel of the wearer. For example, if the collar elevator is attached to the upper heel region and/or the upper ankle region, then portions of the upper may hold or retain the collar elevator in the preloaded configuration when the ankle collar is in the raised state. In other aspects, the collar elevator may be unloaded when the ankle collar is in the raised state.

In one aspect, the portion 325 of the upper below the center connecting band may include wall of one or more textiles that are more flexible than other portions of the upper. This more flexible region of the upper may, for example, be at least partially in the heel-counter region. Among other things, this more flexible portion 325 of the upper may collapse more easily when the ankle collar is moved to a lower state and may provide less resistance for the collar elevator (as compared with a less flexible upper in other parts of the footwear article or in a typical footwear article) when the collar elevator is returning to the less compressed state.

In some aspects, the combination of the medial lever arm, the lateral lever arm, and the center connecting band may be referred to as a deformable element. The term "deformable element" refers to a resiliently flexible member that can be bent or compressed but has a bias to move towards a non-bent or uncompressed state. The deformable element may include a single, integrally formed, deformable element, extending continuously from the medial lever arm to the lateral lever arm. In other aspects, the medial lever arm and the lateral lever arm may be two or more separate and distinct deformable elements that connect to the center connecting band, which may also be referred to as a heel piece. As will be depicted herein, the deformable element may be a first lever arm, a second lever arm, an asymmetrical collar elevator, an undulating collar elevator, a C-spring, and/or any other element effective to provide a return force for the upper from a first positional state for donning to a second positional state to secure a wearer's foot.

In some aspects, the deformable element might be directly coupled, mounted, or attached to the base. In other aspects, the base may include one or more anchors that engage and retain the deformable element in place. For example, anchors may be located at a junction (e.g., 359 and 459) between the lever arms and the base. Such anchors might be integrally formed with, coupled to and/or located within or between or outside of portions of the sole (e.g., insole, midsole, outsole). For example, an anchor may be disposed in a block, plate, or wedge layered among, on top, or beneath the sole. In some instances, a portion of the sole (e.g., midsole) might be carved or cut out to attach to or house an anchor. In another aspect, a base extending in the mediolateral orientation (e.g., base 358) includes an anchor-shaped receptacle into which an anchor engages by way of a resistance fit, compression fit, a snap fit, or via an interlocking mechanism/configuration. In other examples, the anchors may be integrally formed with, coupled to, and/or located within, between, or outside of portions of the upper. For example, anchors may be located in the upper, in a heel counter, or any combination thereof. A single anchor may extend a full width of the footwear article, or two anchors may be positioned on opposing sides of the footwear article (e.g., on the medial and lateral sides). The deformable member may attach to the base or to an anchor at an angle. For example, the deformable member might attach at a perpendicular angle to the base and then curve or arc rearward. In another aspect, the deformable member might attach at a forwardly inclining angle (i.e., upwards and forwards) or a rearward reclining angle (i.e., upwards and rearwards) before rearward arcing.

A connection between the deformable member and the base or the anchors may be described in various manners. For example, in one aspect, the deformable element does not pivot (i.e., is non-pivoting) about the base (e.g., about an insole, midsole, or outsole). Described differently, the deformable element may be non-rotatably coupled to the base. In various aspects, engagement between the deformable element and the base (or anchor) is free of play, meaning that there is little or no relative movement between the two components. In yet other aspects, the deformable element may be adjustably oriented with the base (or anchor), as will be depicted in FIGS. 25A-26B and discussed hereinafter. Further yet, the deformable elements may have a slideable engagement with the base (e.g., sole), as will be depicted and discussed in connection with FIGS. 27A-28C A deformable element may include one or more of a tube, a wire, a spring, a shape memory structure or material, and the like. Furthermore, a deformable element can include one or more materials such as carbon steel, stainless steel, titanium, nickel titanium (nitinol) and other metals and alloys (shape-memory or otherwise), polymers (shape-memory or otherwise), composite materials, foam materials, graphite, carbon fiber, fiberglass, thermoplastic polyester elastomers ("TPC-ET"), silicone, thermoplastic polyurethane ("TPU"), and polycarbonate. For example, a deformable element might include titanium or be a titanium wire. Also, one or more deformable elements might be made of a first material, e.g., titanium, and one or more additional deformable elements might be made of a second material, e.g., graphite. Further, various combination of materials may be used in the formation of a deformable element. For example a first material may form a first portion of the deformable element and a second (different) material may form a second portion of the same deformable element.

In some aspects, the deformable element might include a single, unitary piece. For instance, a first end of the deformable element (e.g., an end of the first lever arm) might be embedded in, or attached to, a medial anchor; a second end of the deformable element (e.g., an end of the second lever arm) might be embedded in or attached to a lateral anchor; and a middle portion of the deformable element (e.g., the center connecting band) might extend around the heel portion or ankle portion of the upper, or be embedded within some additional heel-piece structure.

In other aspects, the deformable element might include a plurality of separate and distinct components, such as a bifurcated configuration. For instance, a deformable element might include two separate components, with a first component (e.g., first lever arm) having a first end (i.e., proximal end) embedded in or attached to a medial anchor and a second end (i.e., distal end) embedded in, attached to or otherwise positioned relative to the upper. As such, a second component (e.g., second lever arm) might similarly include a first end embedded in or attached to a lateral anchor and a second end embedded in, attached to, or otherwise positioned relative to the upper. The plurality of separate and distinct components can be formed with one or more of a tape wrap, woven encasing, overmold (e.g., TPU), heat shrink tube, and the like, each of which can provide different stabilities and strengths. For example, a deformable element might include one or more wires encased independently or encased together in a cover, sleeve, overmold, or heat shrink tube. The one or more wires can arch, bend, and sway and then return to an initial/normal state in order to help facilitate the elastic deformation of the deformable element.

In yet other aspects, the deformable element may only be joined, extend from, or otherwise be secured to a base at one location, such as an asymmetrical configuration. In the asymmetrical configuration, the deformable element might include a single component having a first end (i.e., proximal end)) embedded in or attached to a medial anchor, lateral anchor, or midline anchor (e.g., Achilles location of the heel end) and a second end (i.e., distal end) embedded in, attached to, or otherwise positioned relative to the upper. As will be discussed hereinafter in connection with FIGS. 15-18 an asymmetrical deformable member is secured with a base on a first side of the base (e.g., medial side) at a proximal end of the deformable member extends from the proximal end toward a distal end that is not secured with the base. As the deformable member extends around a heel and of the upper to the distal end on an opposite side of the upper (e.g., lateral side of the upper) for the proximal end.

A deformable element might have variable mechanical properties along its length and/or at distinct points along its length. Such variation might be provided by the deformable element (e.g., by a wire or bundle of two or more wires), by a securement surrounding all or a portion of the deformable element(s), a cross sectional shape/size/orientation, or any combination thereof. For example, the deformable element and/or the securement might have a variable cross-section, a variable density, a variable material, and/or the like along its length, as will be depicted in FIGS. 29A-32B, for example. A variable cross-section, in turn, can be provided by variation in thickness or shape, or twisting of the deformable element otherwise having a constant thickness or shape along its length.

As briefly described above, a deformable element may include a cover, sleeve, overmold, or other suitable structure, which might protect other elements (e.g., wire, spring, etc.) of the deformable element and might control, guide, support and/or otherwise affect the flexure or compression of the deformable element. In some aspects, the cover, based on its material of manufacture, shape, geometry, etc., is configured to facilitate mechanical stress distribution by transferring mechanical bending/deforming forces from the deformable element (e.g., from the wire(s) or spring) to the cover to prevent, or at least inhibit, the deformable element from damage or breakage that may otherwise result from the concentrated and repeated mechanical stress experienced by the deformable element. For example, the cover may have dimensions that vary along its length, such as a funnel-like tapering shape, to help distribute stress and contribute to the dynamic flexing of the deformable element. In the event that the deformable element breaks, the cover might still provide at least some degree of bias, thereby still helping to move the ankle collar from the lowered position to the raised position. Further, the cover may provide additional padding and/or support to the deformable element and may prevent, or at least inhibit, a wearer from feeling the deformable element.

As briefly described above, the center connecting band, when included in the collar elevator configuration, may also be referred to as a heel piece. The center connecting band may be integrally formed with the medial and lateral lever arms, as a single, continuous unit. In other aspects, the center connecting band may be a separate piece that extends between, and bridges, the medial and lateral lever arms. Among other things, the center connecting band may provide a coupling to the upper and may provide a frame to the ankle collar, to inhibit the ankle collar from collapsing into the foot-receiving opening when a foot is being inserted. The center connecting band may be omitted altogether in some aspects contemplated herein (e.g., bifurcated collar elevator).

When being put on by a wearer, a footwear article with a collar elevator (e.g., collar elevators 350 and 450) might be slipped on by the wearer without the wearer using his or her hands to manipulate the footwear article. For example, the wearer's toes may be inserted through the foot-insertion openings 318 or 418, while the arch or heel of his or her foot is used to press downward on the ankle collars 336 or 436 towards the soles 312 or 412. This adjustment of the ankle collar 336 or 436 into the lowered state closer to the sole may increase a size of the foot-insertion opening 318 or 418. Once the wearer's foot has been slid into the foot-receiving cavity 316 or 416, the collar elevator 350 or 450 moves the ankle collar from the lowered state (i.e., FIGS. 3C and 4C) to the raised state (i.e., FIGS. 3A and 4A) to help secure the footwear article to the wearer's foot.

Among other things, the collar elevators 350 and 450 may reduce potential structural breakdown of the upper heel region and upper ankle region over time, which could result from repeated hands-free donning, by providing a frame operational to return to, or bias in, the raised state. Furthermore, the collar elevators 350 and 450 may allow the user to more easily don (i.e., put on) his or her shoes without the use of hands and/or without having to bend down to tie the laces, without having to use a shoe horn, or without using other such adjustment features, elements, or mechanisms for fit. Moreover, the footwear articles 310 and 410 may more easily receive, or more easily direct a wearer's foot into, or otherwise accommodate, a wearer's foot with respect to, the foot-receiving opening. This potentially easier donning may result from, among other things, the collar elevators 350 and 450 helping to provide a larger foot-insertion opening without allowing a topline of the ankle collar to fold inward towards the foot-receiving cavity.

Operation of the footwear articles 310 and 410 may be described in various manners. For example, the ankle collars 336 and 436 may be elastic or may include a goring element that permits expansion of the foot-insertion openings 318 and 418, such as when the ankle collar is moved to a lowered state. In the lowered state, the foot-insertion openings 318 and 418 may be expanded by at least about 5%, or at least about 10%, or at least about 15%. This measured expansion may be detected in various manners. For example, a first circumference of the foot-insertion opening may be measured when the ankle collar is in a first state, and a second circumference may be measured when the ankle collar is in a second state, which is closer to the sole (relative to the first state). The distance of the ankle collar from the sole in the first and second states may be measured in a vertical plane (i.e., perpendicular relative to the horizontal reference plane, including a flat ground surface on which the ground-contacting surface sits in an at-rest position), and the distance may be measured from a rearmost point of the ankle collar topline edge to a topline edge of the sole (e.g., where the sole connects to the upper at the biteline). As such, the distance in the first state will be longer than the distance in the second state, and in one aspect, the second distance is equal to or shorter than 75% of the first distance. Continuing with the above example, in the second state having the distance equal to or shorter than 75% of the distance in the first state, the circumference may be expanded by at least about 5%, or at least about 10%, or at least about 15%. In a further example, a circumference of the foot-insertion openings 318 and 418 may be expandable by at least about 1.0 inch (about 2.54 centimeters), when the ankle collar is in the second state having the distance equal to or shorter than 75% of the distance in the first state. An amount of the expansion of the foot-insertion opening 318 and 418 may vary with the shoe style and size. In other aspects, a height of the ankle collars 336 and 436 above the soles 312 and 412 in the lowered state is about 50% lower than the height in the raised state, however, as with other parameters, this may vary depending on the shoe style and size.

As described in other portions of this disclosure, the collar elevators 350 and 450 provide a return force when moving the ankle collars 336 and 436 from the lowered state to the raised state. In some aspects, the return force is between about 1 pound-force and about 15 pound-force, and this may be measured at various positions of the ankle collar. For example, as explained above, the ankle collar may include a first state having a first distance from the sole and a second state having a second distance from the sole, which is shorter than the distance in the first state. In one aspect, the collar elevators 350 and 450 provide the return force between about 1 pound-force and about 15 pound-force in the second state having the distance equal to or shorter than about 85% of the distance in the first state. In a further aspect, the collar elevators 350 and 450 provide the return force between about 1 pound-force and about 15 pound-force in the second state having the distance equal to or shorter than about 75% of the distance in the first state. Further still, the collar elevators 350 and 450 might provide the return force between about 1 pound-force and about 15 pound-force in the second state having the distance equal to or shorter than about 50% of the distance in the first state. The return force may be strong enough such that the rear of the ankle collar rebounds back up from the second state and snugly fits around the wearer's heel. For example, the ankle collars 336 and 436 may be elevated from the lowered state to the raised state in less than about 1 second, when the distance between the ankle collar and the sole in the lowered state is shorter than 85%, or shorter than 75%, or shorter than 50% of the distance in the raised state. In other aspects, ankle collars 336 and 436 may be elevated from the lowered state to the raised state in less than about 0.5 seconds, when the distance between the ankle collar and the sole in the lowered state is shorter than 85%, or shorter than 75%, or shorter than 50% of the distance in the raised state. And in further aspects, the ankle collars 336 and 436 may be elevated from the lowered state to the raised state in less than about 0.2 seconds, when the distance between the ankle collar and the sole in the lowered state is shorter than 85%, or shorter than 75%, or shorter than 50% of the distance in the raised state. This rebound time is measured absent any counteracting external forces, such as friction that might be imparted by the wearer's heel.

The collar elevator examples of FIGS. 3A-4C are generally referred to as a continuous collar elevator. As provided in connections with FIGS. 3A-4C it is contemplated that a continuous collar elevator may be formed from discrete portions joined as a common element. For example a discrete medial lever arm and a discrete lateral lever arm are described as being joined by a connecting band. In this example even though three discrete elements provided, they are joined or otherwise physically combined as a common element to represent a continuous collar elevator. This is in contrast to a bifurcated collar elevator or an asymmetrical collar elevator as will be provided hereinafter. The bifurcated collar elevator has a first lever arm and a second lever arm where the first lever arm and the second lever arm are discontiguous from each other. Stated differently, the connecting band of FIGS. 3A-4C is omitted such that a distal end of the first lever arm and a distal end of the second lever arm are independently moveable from one another, as will be discussed in greater detail hereinafter. Furthermore, the asymmetrical collar elevator lack symmetry between a first side (e.g., medial side) of the footwear article and a second side (e.g., lateral side) of the footwear article. For example, an asymmetrical collar elevator may extend from a base on a first side of the footwear article toward a distal end that free from the base and on the second side of the footwear article, as will be discussed in greater detail hereinafter. The function, response, construction, assembly, and configuration for each of a continuous collar elevator, a bifurcated collar elevator, and an asymmetrical collar elevator varies and provides alternative advantages.

Figure 5:
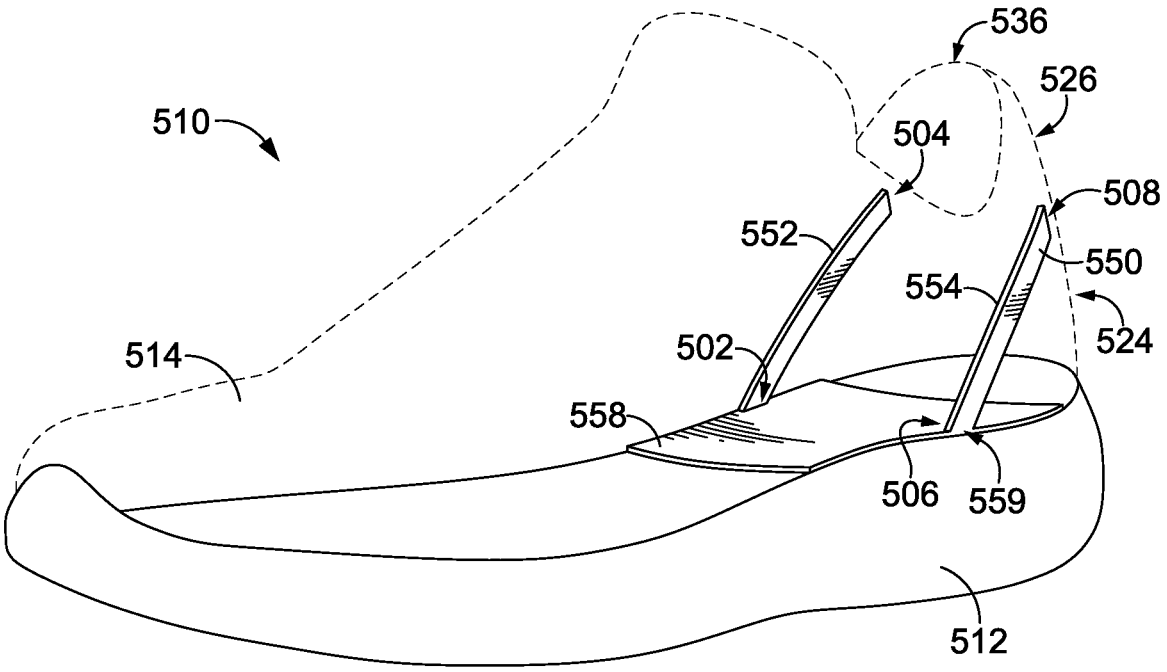
FIG. 5 depicts another footwear article having a bifurcated collar elevator monolithic with a base in accordance with an aspect of this disclosure.

Turning to FIG. 5, which depicts a footwear article 510 having a collar elevator 550, in accordance with aspects herein. Specifically, the collar elevator is an example of a bifurcated collar elevator comprised of a first lever arm 552 having a proximal end 502 and a distal end 504 and a second lever arm 554 having a proximal end 506 and a distal end 508. A bifurcated collar elevator is distinguished from the collar elevator 350 of FIG. 3A as the first lever arm distal end 504 and the second lever arm distal end 508 are discontiguous. Discontiguous lever arms are lever arms having a gap, interval, disconnect, interruption, not contiguous in space, not touching or adjacent, disconnected, separate or other avoidance of a continuous physical connection there between. For example, the center connecting band 356 of FIG. 3A provides a bridge between a first lever arm and a second lever arm. Omission of the center connecting band 356 of FIG. 3A is an example of a bifurcated collar elevator.

A bifurcated collar elevator provides advantages to footwear assembly in some examples. Instead of either forming a footwear upper around a continuous collar elevator or threading a continuous collar elevator from a first side to a second side of the footwear through a channel of a footwear upper during assembly, a bifurcated collar elevator can more easily be incorporated because of the discontiguous nature around the curve of a heel end, in an example. Additional advantages of a bifurcated collar elevator may include a reduction in material and associated mass of a discontiguous portion, in example where the bifurcation includes an elimination of collar elevator material. Yet other potential advantages of a bifurcated collar elevator relative to a continuous collar elevator include variable response such that the first lever arm is able to respond independently of the second lever arm in some examples. As such, a bifurcated collar elevator provides a variety of advantageous from a continuous collar elevator, such as those described in FIG. 3A, in some examples.

The lever arms of a bifurcated collar elevator may extend around a heel end of the footwear article in an example. The lever arms of a bifurcated collar elevator may terminate (e.g., the distal ends) prior to wrapping around a portion of the heel end in another example. Further yet, it is contemplated that a first lever arm may have a different length than a second lever arm resulting in an asymmetrical configuration where there are at least one connection to a base by each of the lever arms. It is further contemplated that a first lever arm may extend from a first location of a base at a first location along a longitudinal length of the footwear article and the second lever arm extends from the base at a second location along a longitudinal length of the footwear article that is different from the first location.

The footwear article 510 includes an upper 514 coupled to a sole 512, and the upper 514 includes an ankle region 526 with an ankle collar 536. The ankle collar 536 is movable between a lowered state and a raised state. In the lowered state, the ankle collar 536 is positioned closer to the sole 512, and in the raised state, the ankle collar 536 is positioned farther from the sole 512.

Furthermore, the footwear article 510 includes the collar elevator 550 that is coupled to the upper 514 near the heel region 524 and/or the ankle region 526 and that is operable to move the ankle collar 536 from the lowered state to the raised state. As far as the coupling of the collar elevator 550 to the upper 514 near the heel region 524 and/or near the ankle region 526, this coupling may take various forms. For example, the collar elevator 550 may be coupled to the upper 514 in general, the heel region 524, the ankle region 526, to the ankle collar 336, or any and all combinations thereof.

For illustrative purposes, the upper 514 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The first lever arm 552 and the second lever arm 554 are monolithic to a base 558. A monolithic configuration is one that is formed or composed of material without joints or seams. Therefore at a junction 559 between the second lever arm 554 and the base 558, the junction 559 or other junctions between the collar lift and the base is absent a joint, seam, or other connection. Instead, the material forming the base 558 continuously extends to the second lever arm 554. For example, the lever arms and the base may be formed, such as through a molding operation as a common part at a common operation, in an example.

The base 558 is affixed to or near a foot-facing surface of the sole 512, and the base 558 might be a portion of an outsole, a portion of a midsole, a portion of an insole, a portion of a strobel, a plate or sheet of material layered between any of these sole layers, or any combination thereof. Among other things, the base 558 might include a rigid portion or section to which the lever arms 552 and 554 are anchored.

Figure 6:
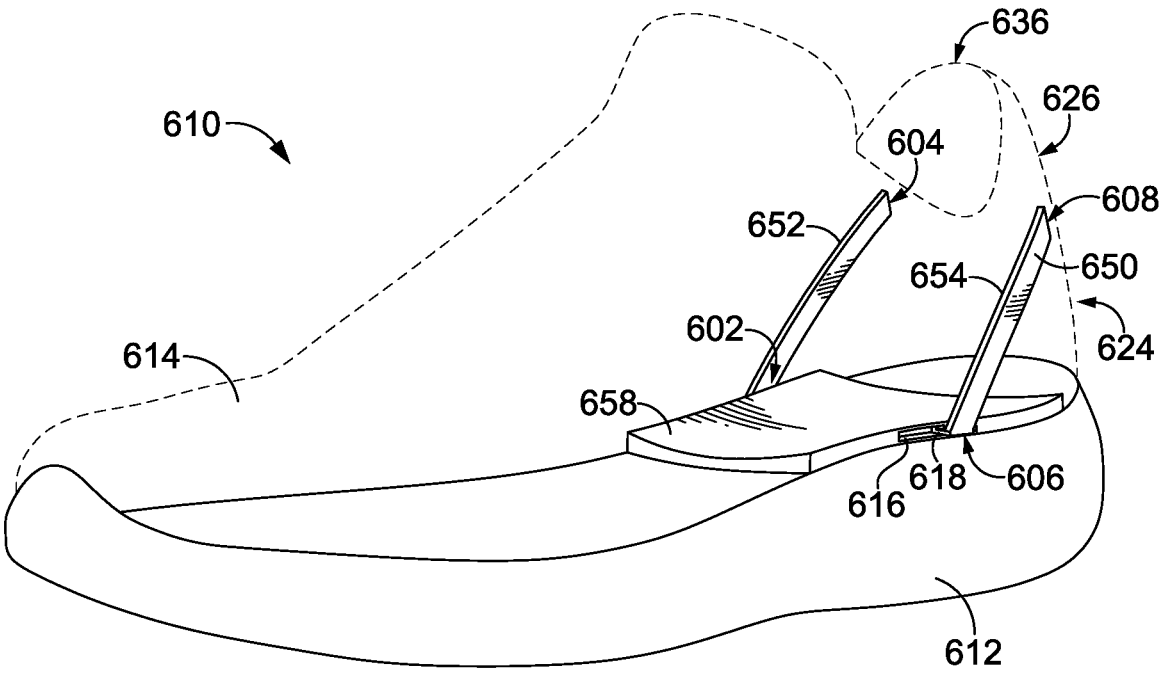
FIG. 6 depicts another footwear article having a bifurcated collar elevator joined with a base in accordance with an aspect of this disclosure.

FIG. 6 depicts an alternative footwear article 610 having a collar elevator 650, in accordance with aspects herein. Specifically, the collar elevator is an example of a bifurcated collar elevator comprised of a first lever arm 652 having a proximal end 602 and a distal end 604 and a second lever arm 654 having a proximal end 606 and a distal end 608.

The lever arms of a bifurcated collar elevator may extend around a heel end of the footwear article in an example. The lever arms of a bifurcated collar elevator may terminate (e.g., the distal ends) prior to wrapping around a portion of the heel end in another example. Further yet, it is contemplated that a first lever arm may have a different length than a second lever arm resulting in an asymmetrical configuration where there is at least one connection to a base by each of the lever arms. It is further contemplated that a first lever arm may extend from a first location of a base at a first location along a longitudinal length of the footwear article and the second lever arm extends from the base at a second location along a longitudinal length of the footwear article that is different from the first location.

The footwear article 610 includes an upper 614 coupled to a sole 612, and the upper 614 includes an ankle region 626 with an ankle collar 636. The ankle collar 636 is movable between a lowered state and a raised state. In the lowered state, the ankle collar 636 is positioned closer to the sole 612, and in the raised state, the ankle collar 636 is positioned farther from the sole 612.

Furthermore, the footwear article 610 includes the collar elevator 650 that is coupled to the upper 614 near the heel region 624 and/or the ankle region 626 and that is operable to move the ankle collar 636 from the lowered state to the raised state. As far as the coupling of the collar elevator 650 to the upper 614 near the heel region 624 and/or near the ankle region 626, this coupling may take various forms. For example, the collar elevator 650 may be coupled to the upper 614 in general, the heel region 624, the ankle region 626, to the ankle collar 336, or any and all combinations thereof.

For illustrative purposes, the upper 614 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The first lever arm 652 and the second lever arm 654 are distinct from and joined to a base 658. A joined configuration may either be reversibly joined or permanently joined. A permanent joint may occur through an adhesive bond, welding, or other methods of causing an irreversible chemical or physical connection between the elements. A reversible joining between the components may be accomplished through a mechanical connection that generates a joint. For example, FIG. 6 depicts the base 658 having a slot 616 into which a latch 618 from the proximal end 606 extends. The latch 618 when inserted into the slot 616 mechanically joins the base 658 and the second lever arm 654. The mechanical joining may be through an interference of materials forming the latch and the slot, through friction, snaps, ratchet, compression, and other techniques. By having a joint between the base 658 and the lever arms, assembly of the footwear article may be simplified as the lever arms may be incorporated into the upper prior to the lever arms being joined with the base. As such, the base 658, which may be the sole 612 or integrated with the sole 612 may be assembled in a traditional manner for footwear articles and the upper 614 may be assembled in a more traditional manner while incorporating the lever arms and then the sole 612 and the upper 614 having the lever arms. For example, as the sole 612 is joined with the upper 614, the lever arms may be joined with the base concurrently.

The base 658 is affixed to or near a foot-facing surface of the sole 612, and the base 658 might be a portion of an outsole, a portion of a midsole, a portion of an insole, a portion of a strobel, a plate or sheet of material layered between any of these sole layers, or any combination thereof. Among other things, the base 658 might include a rigid portion or section to which the lever arms 652 and 654 are anchored.

Figure 7:
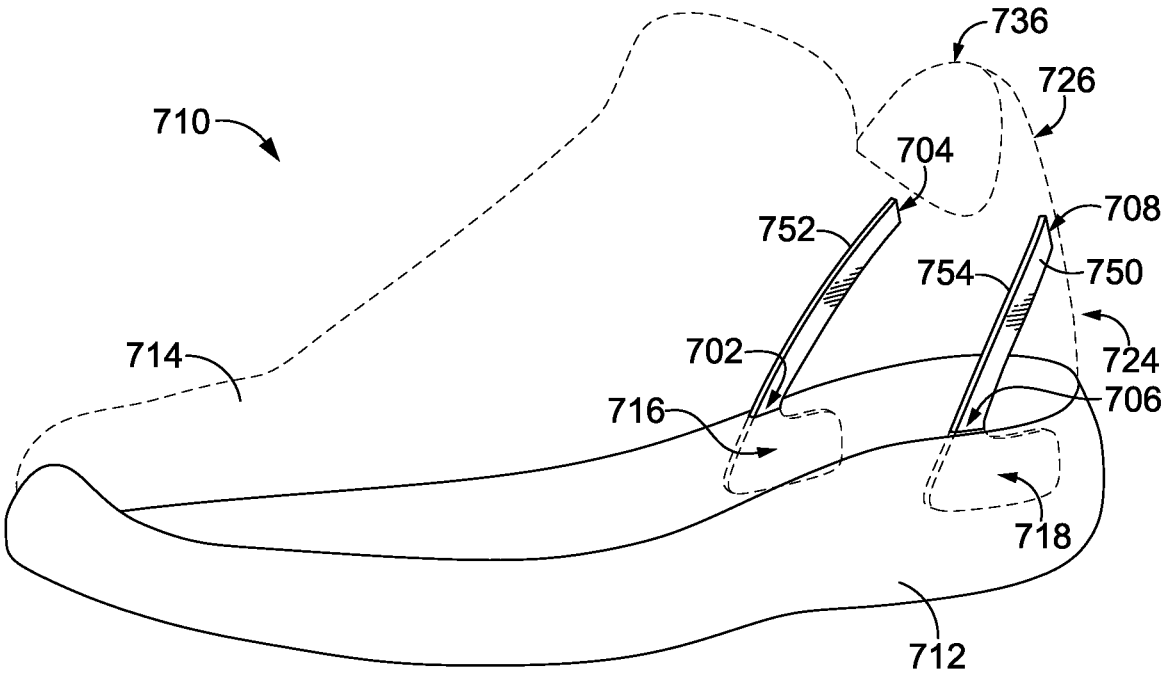
FIG. 7 depicts another footwear article having a bifurcated collar elevator integrated with a base in accordance with an aspect of this disclosure.

FIG. 7 depicts an alternative footwear article 710 having a collar elevator 750, in accordance with aspects herein. Specifically, the collar elevator is an example of a bifurcated collar elevator comprised of a first lever arm 752 having a proximal end 702 and a distal end 704 and a second lever arm 754 having a proximal end 707 and a distal end 708.

The lever arms of a bifurcated collar elevator may extend around a heel end of the footwear article in an example. The lever arms of a bifurcated collar elevator may terminate (e.g., the distal ends) prior to wrapping around a portion of the heel end in another example. Further yet, it is contemplated that a first lever arm may have a different length than a second lever arm resulting in an asymmetrical configuration where there are at least one connection to a base by each of the lever arms. It is further contemplated that a first lever arm may extend from a first location of a base at a first location along a longitudinal length of the footwear article and the second lever arm extends from the base at a second location along a longitudinal length of the footwear article that is different from the first location.

The footwear article 710 includes an upper 714 coupled to a sole 712, and the upper 714 includes an ankle region 726 with an ankle collar 736. The ankle collar 736 is movable between a lowered state and a raised state. In the lowered state, the ankle collar 736 is positioned closer to the sole 712, and in the raised state, the ankle collar 736 is positioned farther from the sole 712. As provided herein, a sole may be an outsole, a midsole, and insole, or any combination thereof.

Furthermore, the footwear article 710 includes the collar elevator 750 that is coupled to the upper 714 near the heel region 724 and/or the ankle region 726 and that is operable to move the ankle collar 736 from the lowered state to the raised state. As far as the coupling of the collar elevator 750 to the upper 714 near the heel region 724 and/or near the ankle region 726, this coupling may take various forms. For example, the collar elevator 750 may be coupled to the upper 714 in general, the heel region 724, the ankle region 726, to the ankle collar 337, or any and all combinations thereof.

For illustrative purposes, the upper 714 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The first lever arm 752 and the second lever arm 754 are distinct from and incorporated into a base, such as the sole 712. An incorporation of components includes the formation of one component after the formation of another component. For example, the first lever arm 752 and the second lever arm 754 may be positioned in a tooling that will be used to mold the sole 712 (or a portion of the sole, such as an outsole, midsole, insole, or location of the sole) prior to or as the sole is being formed. For example, each of the lever arms may be positioned in a mold into which a polymeric composition will be introduced (e.g., injected or poured). As the polymeric composition is introduced, the polymeric composition surrounds an anchor portion 716, 718 that becomes embedded within the sole 712 leaving exposed the portion of the lever arms extending from the proximal end to the distal end. In an additional example, a cavity, opening, or other volume may be maintained during an initial forming of the sole 712 or as a result of a post-forming operation such that the anchors 716, 718 may be inserted into those spaces and the embedded therein by a secondary process, such as filling the volume holding the anchors with a material. In this example, the lever arms may be introduced with the sole after an initial forming of both, but a secondary process incorporates the lever arms with the sole, such as through a curing of a complementary polymeric material to that which formed the sole.

The anchors 716, 718 may be of any size or shape. In the depicted aspect, the anchors 716, 718 extend in a heelward direction and have a cross sectional shape that resists dislodgement through an opening created at the sole 712 at each of the proximal ends of the lever arms. In alternative aspects, it is contemplated that the anchor may extend in a toeward direction from a point of incorporation on the sole foot-facing surface. In yet other examples it is contemplated that the anchor may extend in an opposite direction (e.g., heelward and toeward) from a point of incorporation on the sole foot-facing surface. Additional any combination of size, orientation, and shape is contemplated for the anchor.

Figure 8:
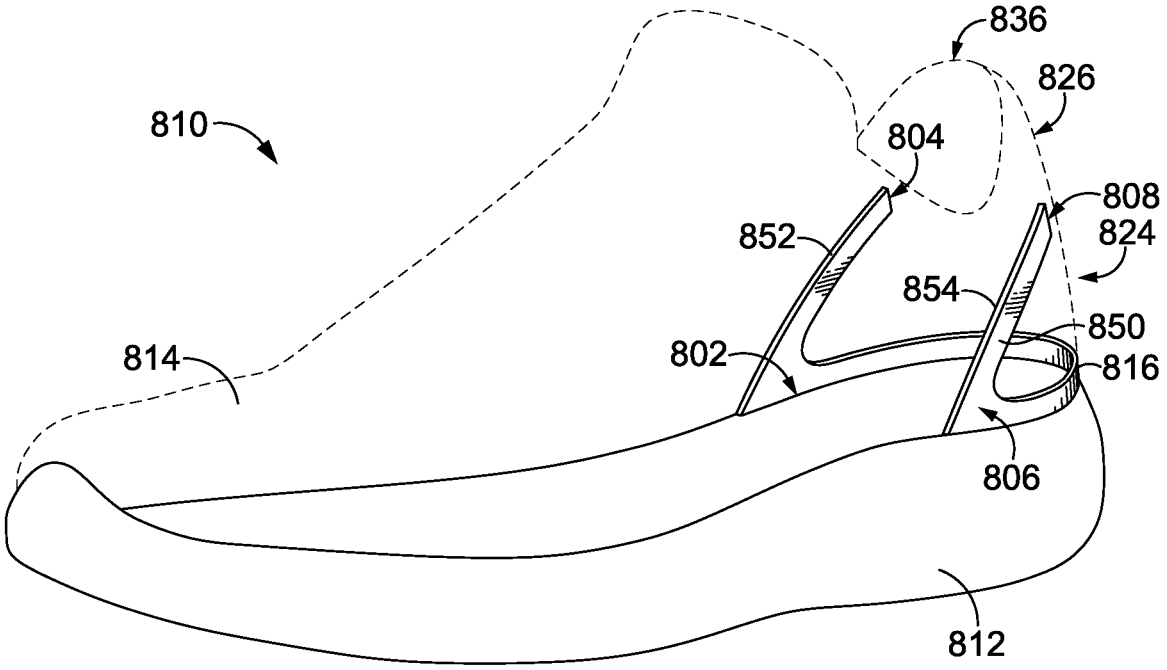
FIG. 8 depicts another footwear article having a bifurcated collar elevator in accordance with an aspect of this disclosure.

FIG. 8 depicts an alternative footwear article 810 having a collar elevator 850, in accordance with aspects herein. Specifically, the collar elevator 850 is an example of a bifurcated collar elevator comprised of a first lever arm 852 having a proximal end 802 and a distal end 804 and a second lever arm 854 having a proximal end 806 and a distal end 808.

The lever arms of a bifurcated collar elevator may extend around a heel end of the footwear article in an example. The lever arms of a bifurcated collar elevator may terminate (e.g., the distal ends) prior to wrapping around a portion of the heel end in another example. Further yet, it is contemplated that a first lever arm may have a different length than a second lever arm resulting in an asymmetrical configuration where there are at least one connection to a base by each of the lever arms. It is further contemplated that a first lever arm may extend from a first location of a base at a first location along a longitudinal length of the footwear article and the second lever arm extends from the base at a second location along a longitudinal length of the footwear article that is different from the first location.

The footwear article 810 includes an upper 814 coupled to a sole 812, and the upper 814 includes an ankle region 826 with an ankle collar 836. The ankle collar 836 is movable between a lowered state and a raised state. In the lowered state, the ankle collar 836 is positioned closer to the sole 812, and in the raised state, the ankle collar 836 is positioned farther from the sole 812.

Furthermore, the footwear article 810 includes the collar elevator 850 that is coupled to the upper 814 near the heel region 824 and/or the ankle region 826 and that is operable to move the ankle collar 836 from the lowered state to the raised state. As far as the coupling of the collar elevator 850 to the upper 814 near the heel region 824 and/or near the ankle region 826, this coupling may take various forms. For example, the collar elevator 850 may be coupled to the upper 814 in general, the heel region 824, the ankle region 826, to the ankle collar 338, or any and all combinations thereof.

For illustrative purposes, the upper 814 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

FIG. 8 depicts a different aspect of a base, in which a base 816 might attach to a portion of the upper (e.g., a heel counter), a portion of the midsole sidewall, or any combination thereof, and the base 816 wraps around a backside of the footwear article, as opposed to extending through the footbed in the manner described with respect to the base 558 of FIG. 5. This is a similar configuration to FIGS. 4A-4C provided before, but with a bifurcated collar elevator. The base 816, like the other bases discussed herein, may be monolithic, joined, or otherwise formed with one or more of the lever arms. Further, while depicted as having a superior edge that is above a foot-facing surface of the sole 812, it is contemplated that the base 816 may be recessed or incorporated into the sole 812 in alternative aspects.

A depicted in FIGS. 5-8, it is contemplated that a collar elevator may be bifurcated such that distal ends of the first lever arm and the second lever arm are independent from one another and without a center connecting band. Some aspects contemplated each of the bifurcated lever arms being secured with a material forming at least a portion of the upper; however, even this common material indirectly joining the bifurcated lever arms they are still considered to be independent from one another and therefore bifurcated. Further, it is contemplated that any gap (as will be depicted in FIGS. 9B and 9C hereinafter) may be formed between distal ends of bifurcated lever arms. For example, the gap may be less than 1 mm or it may be greater than 100 cm in other examples. The game may be measured along a surface of the upper from between the distal ends in the raised position.

As will be appreciated throughout and as indicated previously, it is contemplated that any combination of base, joint/coupling/extension between the base and the lever arm, lever arm size, lever arm shape, lever arm cross section, angle between the base and lever arm, position of the base and/or lever arm, and orientation of the lever arm is contemplated in connection with a bifurcated collar elevator. Further, any material provided herein in connection with a collar elevator and base is contemplated as being applicable to a bifurcated collar elevator configuration.

Figure 9A:
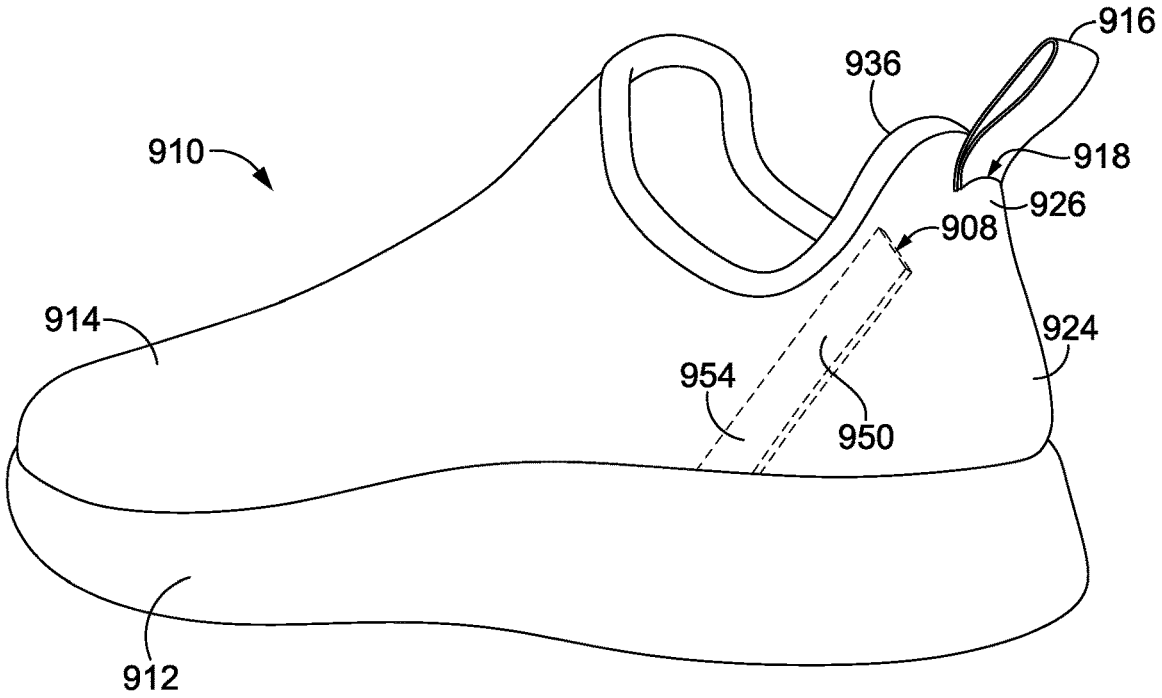
FIGS. 9A-9B depict another footwear article having a bifurcated collar elevator and a heel pull in accordance with an aspect of this disclosure.
Figure 9B:
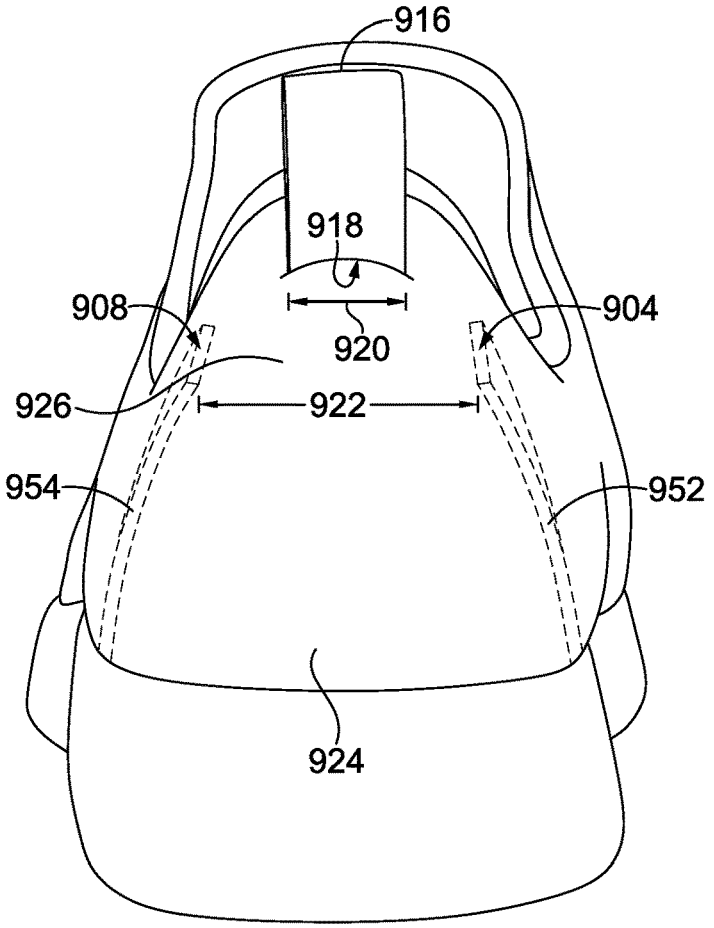

FIGS. 9A and 9B depict another footwear article 910 having a bifurcated collar elevator 950 and a heel pull 916, in accordance with an aspect of this disclosure. Of initial note for FIGS. 9A and 9B is a lack of overlap between distal ends 904, 908 of the bifurcated collar elevator 950 and the heel pull 916. As will be discussed in greater detail below, the heel pull 916 is effective in connection with the bifurcated collar elevator 950 to raise the ankle collar 936 to the raised state. Additionally, the heel pull 916 is effective to return the upper 914 in an ankle region 926 to a heelward location from a toe ward location between the bifurcated collar elevator 950 lever arms that may occur during a donning process, as will described below.

The footwear article 910 includes an upper 914 coupled to a sole 912, and the upper 914 includes an ankle region 926 with an ankle collar 936. The ankle collar 936 is movable between a lowered state and a raised state. In the lowered state, the ankle collar 936 is positioned closer to the sole 912, and in the raised state, the ankle collar 936 is positioned farther from the sole 912.

Furthermore, the footwear article 910 includes the collar elevator 950 that is coupled to the upper 914 near the heel region 924 and/or the ankle region 926 and that is operable to move the ankle collar 936 from the lowered state to the raised state. As far as the coupling of the collar elevator 950 to the upper 914 near the heel region 924 and/or near the ankle region 926, this coupling may take various forms. For example, the collar elevator 950 may be coupled to the upper 914 in general, the heel region 924, the ankle region 926, to the ankle collar 339, or any and all combinations thereof.

The disclosure of FIGS. 5-8 are applicable to the heel pull configurations of FIGS. 9A-9B and therefore incorporated. For example, any base structure may be implemented (e.g., monolithic, joint, incorporated, and/or U-shaped. The bifurcated collar elevator 950 includes a first lever arm 952 and a second lever arm 954. The first lever arm 952 has the distal end 904 and the second lever arm 954 has the distal end 908. A distance 922 extends between the distal ends 904 and 908. The distance 922 is measure as a direct line between the most distal points of each distal end. The direct line measurement does not account for a curvature of the upper 914 around a heel end, in this example. Alternative examples contemplate the distance may be measured along the upper between the distal ends (e.g., along a curvature of the heel).

The heel pull 916 is depicted as a loop; however, it is contemplated that the heel pull 916 may instead by a tab, or other material having any thickness or number of layers. The heel pull may be integrally formed with the upper 914 or it is may be joined with the upper 914. The heel pull 916 extends from the upper 914 in the ankle region 926 at a joining location 918. The joining location 918 may be a mechanical fastening location (e.g., stitches, rivet, snaps) or a bonding location (e.g., welded, adhered), in an example. The joining location 918 may also be an aperture in an outer layer of the upper 914 through which the heel pull 916 extends exterior from a more interior location, in another example. The joining location may be an inferior-most location (e.g., closest to the sole 912) of the heel pull 916 on the upper 914. The heel pull 916 has a width 920 at the joining location 918. The width 920 is a direct line measurement in an example. In an alternative example the width 920 is measured across the surface of the upper 914 when in an intended configuration.

FIGS. 9A and 9B depict the width 920 as being less than the distance 922. In this example, the heel pull 916 therefore does not overlap the distal end 904 nor the distal end 908. As such, in this example, the heel pull 916 is useable for retrieving the ankle region 926 from between the first lever arm 952 and the second lever arm 954 when the ankle region 926 is indented (e.g., concave at the heel end as opposed to an intended shape of convex at the heel end). As the distance 922 expands based on elevator collar configuration changes, the potential for a concave formation during the donning of the footwear article increase, in an example. As such, the heel pull works in concert with the collar elevator 950 to resist and return the ankle region 926 to an intended convex configuration (from an exterior perspective).

Figure 10A:
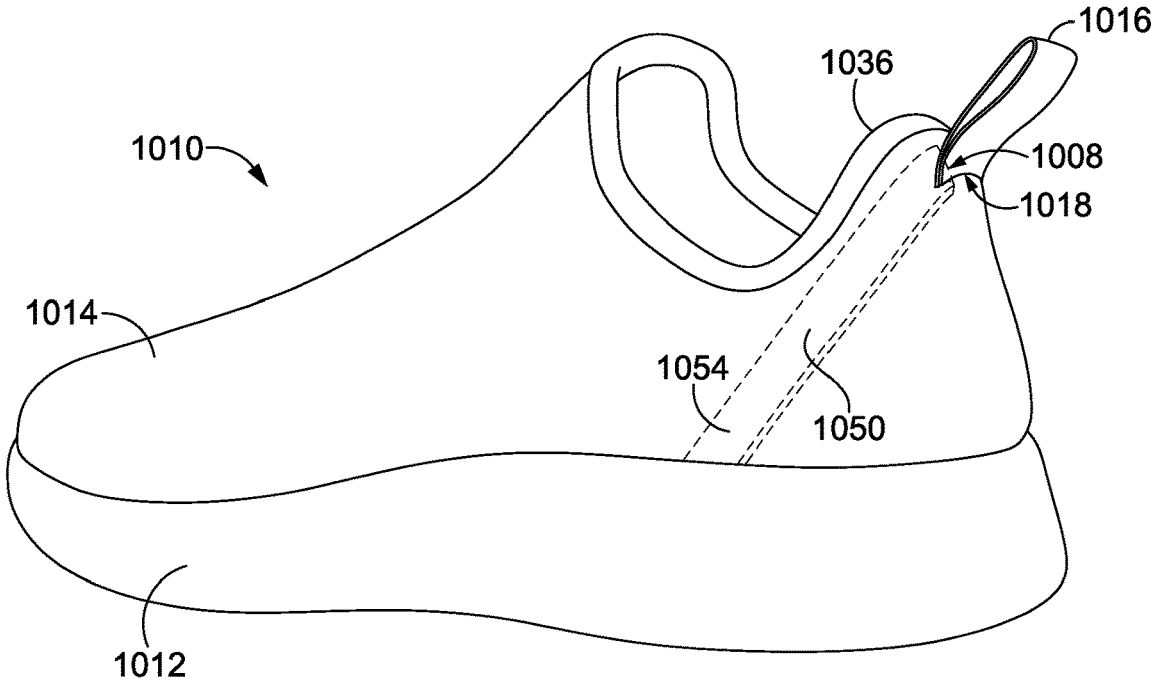
FIGS. 10A-10B depict another footwear article having a bifurcated collar elevator overlapping a heel pull in accordance with an aspect of this disclosure.
Figure 10B:
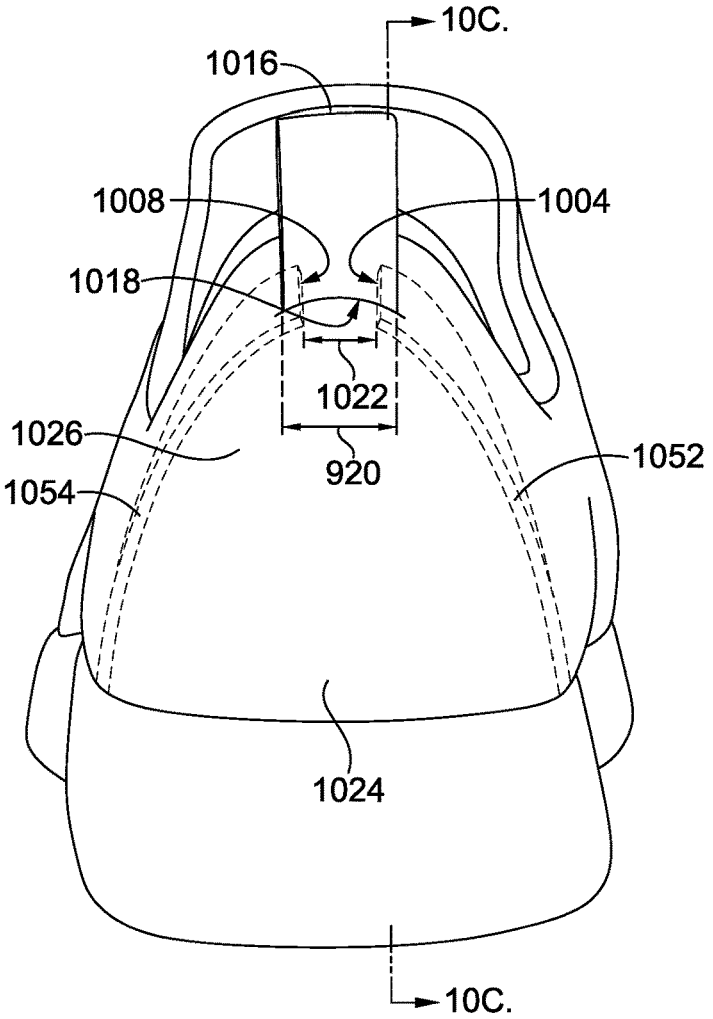

FIGS. 10A and 10B depict another footwear article 1010 having a bifurcated collar elevator 1050 and a heel pull 1016, in accordance with an aspect of this disclosure. Of initial note for FIGS. 10A and 10B is an overlap between distal ends 1004, 1008 of the bifurcated collar elevator 1050 and the heel pull 1016. As will be discussed in greater detail below, the heel pull 1016 is effective in connection with the bifurcated collar elevator 1050 to raise the ankle collar 1036 to the raised state. Additionally, the heel pull 1016 is effective to return the upper 1014 in an ankle region 1026 to a heelward location from a toe ward location between the bifurcated collar elevator 1050 lever arms that may occur during a donning process, as will described below.

The footwear article 1010 includes an upper 1014 coupled to a sole 1012, and the upper 1014 includes an ankle region 1026 with an ankle collar 1036. The ankle collar 1036 is movable between a lowered state and a raised state. In the lowered state, the ankle collar 1036 is positioned closer to the sole 1012, and in the raised state, the ankle collar 1036 is positioned farther from the sole 1012.

Furthermore, the footwear article 1010 includes the collar elevator 1050 that is coupled to the upper 1014 near the heel region 1024 and/or the ankle region 1026 and that is operable to move the ankle collar 1036 from the lowered state to the raised state. As far as the coupling of the collar elevator 1050 to the upper 1014 near the heel region 1024 and/or near the ankle region 1026, this coupling may take various forms. For example, the collar elevator 1050 may be coupled to the upper 1014 in general, the heel region 1024, the ankle region 1026, to the ankle collar 3310, or any and all combinations thereof.

The disclosure of FIGS. 5-8 are applicable to the heel pull configurations of FIGS. 10A-10B and are therefore incorporated. For example, any base structure may be implemented (e.g., monolithic, joint, incorporated, and/or U-shaped). The bifurcated collar elevator 1050 includes a first lever arm 1052 and a second lever arm 1054. The first lever arm 1052 has the distal end 1004 and the second lever arm 1054 has the distal end 1008. A distance 1022 extends between the distal ends 1004 and 1008. The distance 1022 is measure as a direct line between the most distal points of each distal end. The direct line measurement does not account for a curvature of the upper 1014 around a heel end, in this example. Alternative examples contemplate the distance may be measured along the upper between the distal ends (e.g., along a curvature of the heel).

The heel pull 1016 is depicted as a loop; however, it is contemplated that the heel pull 1016 may instead by a tab, or other material having any thickness or number of layers. The heel pull may be integrally formed it is may be joined with the upper 1014. The heel pull 1016 extends from the upper 1014 in the ankle region 1026 at a joining location 1018. The joining location 1018 may be a mechanical fastening location (e.g., stitches, rivet, snaps) or a bonding location (e.g., welded, adhered), in an example. The joining location 1018 may also be an aperture in an outer layer of the upper 1014 through which the heel pull 1016 extends exterior from a more interior location, in another example. The joining location may be an inferior-most location (e.g., closest to the sole 1012) of the heel pull 1016 on the upper 1014. The heel pull 1016 has a width 920 at the joining location 1018. The width 920 is a direct line measurement in an example. In an alternative example the width 920 is measured across the surface of the upper 1014 when in an intended configuration.

FIGS. 10A and 10B depict the width 920 as being greater than the distance 1022.

In this example, the heel pull 1016 therefore overlaps both the distal end 1004 and the distal end 1008. As such, in this example, the heel pull 1016 aids in adding a indirectly joined bridge between the distal ends to resist a concave deformation of the ankle region 926 during a donning process. For example, the heel pull 1016 in addition to aiding the collar elevator 1050 in the return of the ankle collar 1036 to the raise position, the heel pull 1016 also aids the upper 1014 in resisting a concave deformation between the distal ends 1004 and 1008 by increasing a material thickness in the gap formed there between.

Figure 10C:
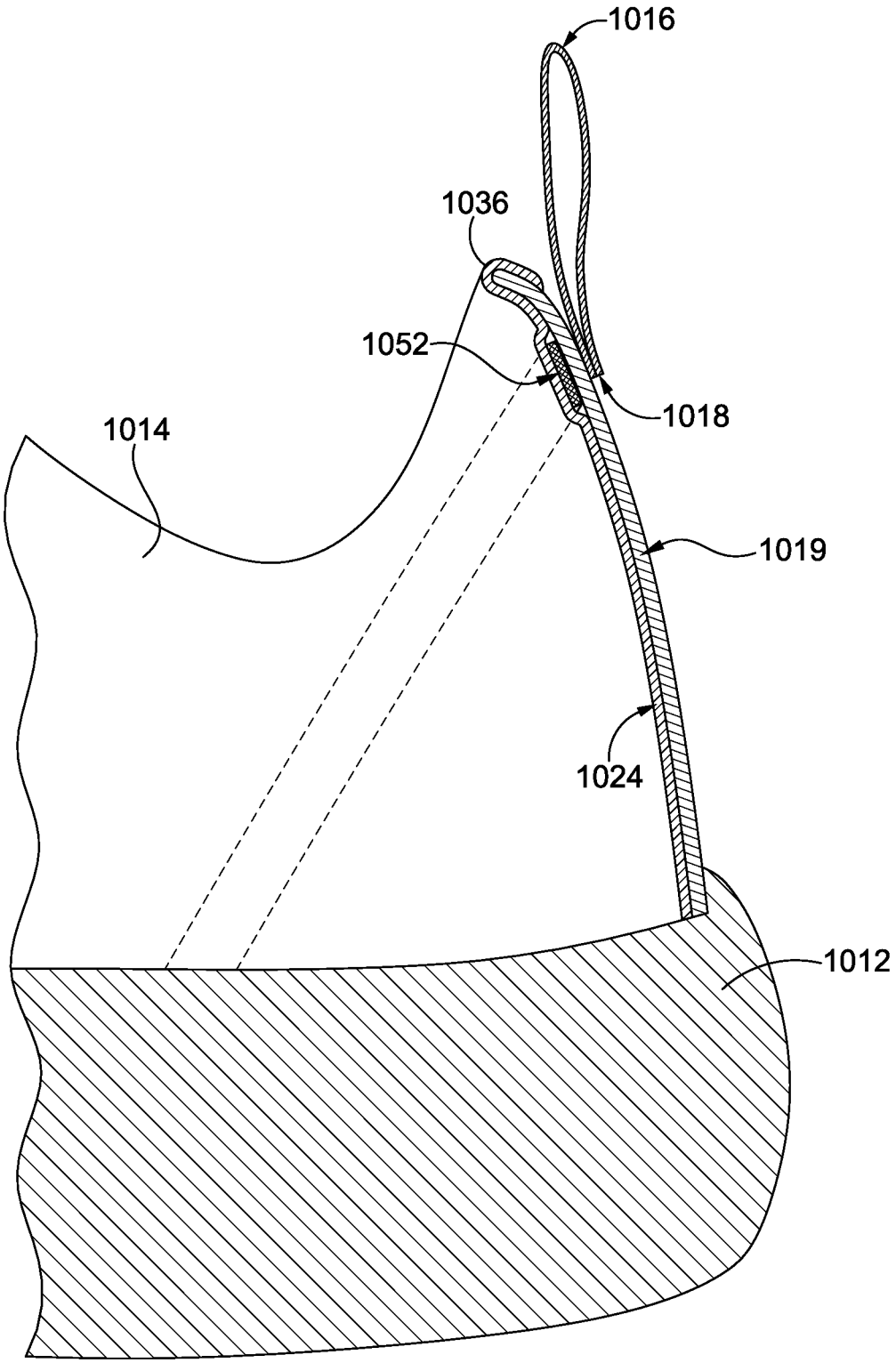
FIG. 10C depicts a cross section along cutline 10C-10C of FIG. 10B in accordance with an aspect of this disclosure.

FIG. 10C provides a cross section view of the footwear article along cutline 10C-10C of FIG. 10B, in accordance with aspects hereof. As depicted in this example configuration, an inner material 1021 (e.g., a liner) is on an interior side of the first lever arm 1052 and an exterior material 1019 is on an exterior surface of the first lever arm 1052. The heel pull is depicted overlapping a portion of the first lever arm 1052. Further, the exterior material 1019 is positioned between the first lever arm 1052 and the heel pull 1016 so that the heel pull is indirectly joined with the bifurcated collar elevator. The heel pull 1016 is therefore a portion of the upper 1014 in this example and the collar elevator remains bifurcated (e.g., non-continuous). Having the intervention of the exterior material (or any material) between the heel pull 1016 and the first lever arm 1052 allows the first lever arm and the second lever arm to independently move.

While a bifurcated collar elevator is depicted in FIGS. 9A-10C, it is contemplated that a heel pull may be used in connection with alternative collar elevators. For example, a continuous collar elevator, an asymmetrical collar elevator, or an undulating collar elevator may all be used in connection with a heel pull provided herein.

Figure 11:
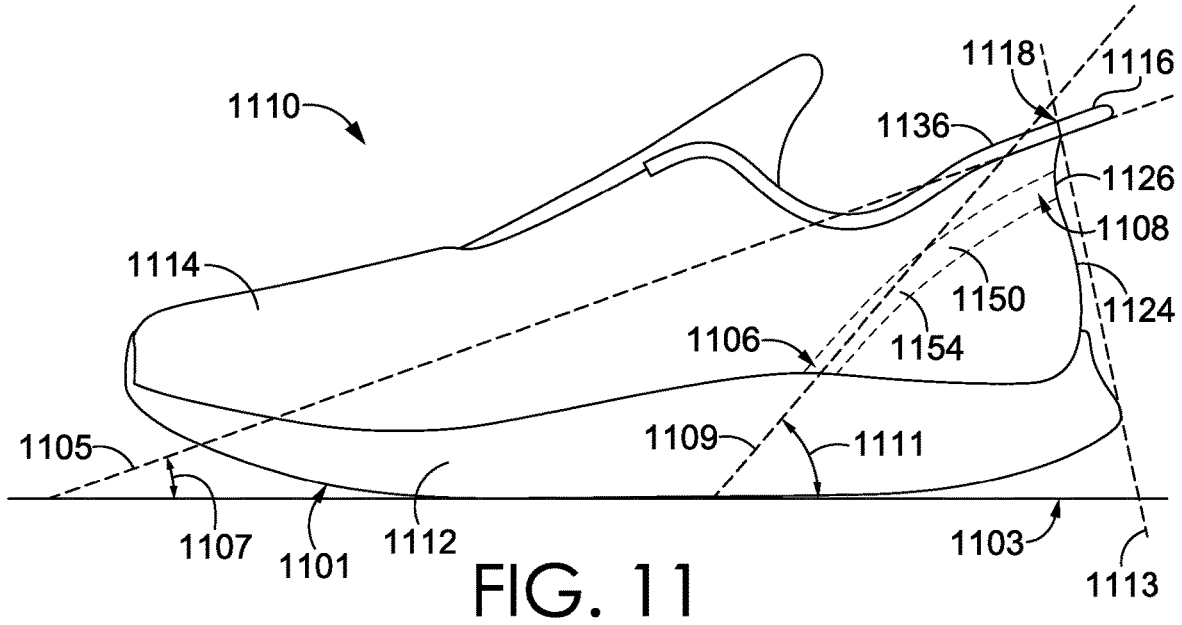
FIG. 11 depicts another footwear article having a collar elevator and a collar slide in accordance with an aspect of this disclosure.

FIG. 11 depicts another footwear article 1110 having a collar elevator 1150 and a collar slide 1116 in accordance with an aspect of this disclosure. The collar slide 1116 provides an enhanced entry for a wearer's foot during a donning operation. For example, the collar slide extends heelward from a heel end location 1118 of the upper 1114 at an angle assisting in the donning operation.

The footwear article 1110 includes an upper 1114 coupled to a sole 1112, and the upper 1114 includes an ankle region 1126 with an ankle collar 1136. The ankle collar 1136 is movable between a lowered state and a raised state. In the lowered state, the ankle collar 1136 is positioned closer to the sole 1112, and in the raised state, the ankle collar 1136 is positioned farther from the sole 1112.

Furthermore, the footwear article 1110 includes the collar elevator 1150 that is coupled to the upper 1114 near the heel region 1124 and/or the ankle region 1126 and that is operable to move the ankle collar 1136 from the lowered state to the raised state. As far as the coupling of the collar elevator 1150 to the upper 1114 near the heel region 1124 and/or near the ankle region 1126, this coupling may take various forms. For example, the collar elevator 1150 may be coupled to the upper 1114 in general, the heel region 1124, the ankle region 1126, to the ankle collar 3311, or any and all combinations thereof.

Figure 12:
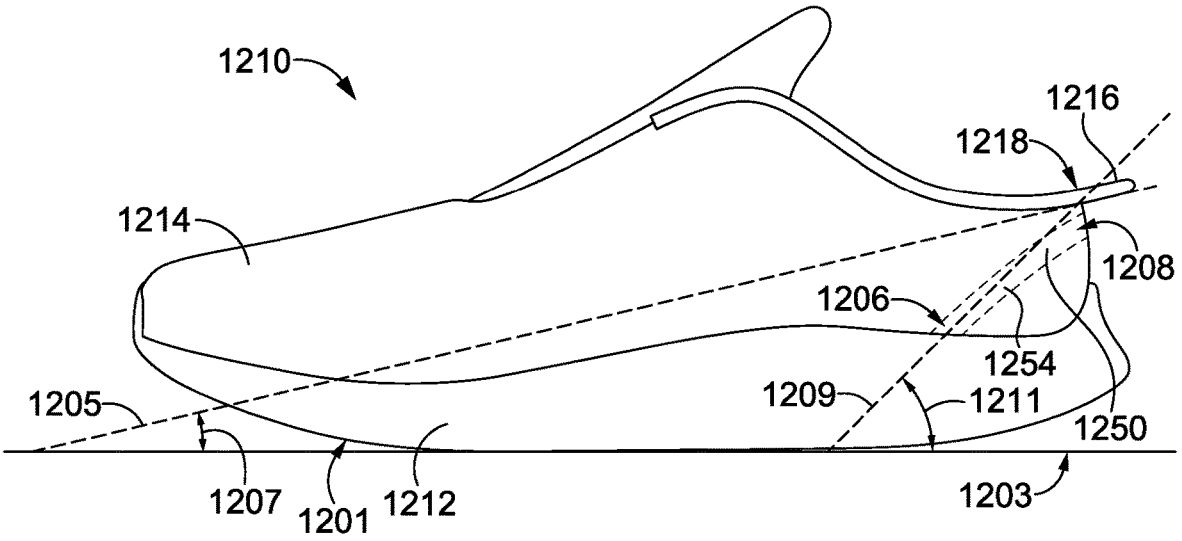
FIG. 12 depicts another footwear article having a collar elevator and a low-profile ankle collar in accordance with an aspect of this disclosure.

The disclosure of FIGS. 5-8 are applicable to the collar slide configurations of FIGS. 11 and 12 and therefore incorporated. For example, any base structure may be implemented (e.g., monolithic, joint, incorporated, and/or U-shaped. The bifurcated collar elevator 1150 includes a first lever arm and a second lever arm 1154. The first lever arm has a distal end and the second lever arm 1154 has a distal end 1108.

A horizontal line 1103 is depicted to represent a ground plane of the footwear article 1110 in a traditional orientation and location. The line 1103 is tangential to a ground-contacting surface 1101 of the sole 1112. Multiple reference lines are depicted extending from the line 1103. The first is a line 1105. The line 1105 represents a tangential line extending from the collar slide 1116 proximate the heel end 1118. The heel end 1118, as described previously, is an anterior location (e.g., heelward) of the upper 1114 prior to transitioning to the collar slide 1116. A reference line 1113 extends from between a heelward location on the sole 1112 and a heelward-most location on the upper 1114 to aid in determining the heel end 1118 at the transition to the collar slide 1116. The line 1105 forms an angle 1107 with the line 1103.

A second line 1109 is a reference line that extends tangential to the proximal end 1106 of the second lever arm 1154. The second line 1109 forms an angle 1111 with the line 1103. In an example, for the collar slide to be effective in aiding in the donning of the footwear article 1110, it is contemplated that the angle 1107 is less than the angle 1111. In some examples the angle 1111 is 60 degrees or less. In other aspects the angle 1111 is 45 degrees or less. In some examples the angle 1107 is 45 degrees or less. In additional examples the angle 1107 is 35 degrees or less. The provided angles, in some aspects, provide for an effective collar slide 1116.

The collar slide has a proximal end at 1118, an upper-most heel end of the ankle collar 1136. The collar slide may be monolithic with the upper 1114 at the ankle collar 1136. In other aspects the ankle collar 1136 may be a distinct component that is joined with the upper 1114 at the ankle collar 1136. In some aspects, the collar slide 1116 is at least partially resistant to deformation such that the collar slide 1115 maintains a ramp interface to the ankle collar 1136 even in the event a force is applied to the collar slide 1115 during a donning operation. As also depicted, it is contemplated that the distal end of the lever arm 1154 is inferior (e.g., below) the collar slide 1116. This relative positioning allows for a downward force to be applied by a wearer's foot during a donning operation to begin moving the ankle collar 1136 to a lowered state in resistance to the collar elevator 1150.

FIG. 12 depicts another footwear article 1210 having a collar elevator 1250 and a collar slide 1216 in accordance with an aspect of this disclosure. The collar slide 1216 provides an enhanced entry for a wearer's foot during a donning operation. For example, the collar slide extends heelward from a heel end location 1218 of the upper 1214 at an angle assisting in the donning operation. FIG. 12 provides an alternative ankle collar configuration having a lower profile heel end than the footwear article 1110 of FIG. 11.

The footwear article 1210 includes an upper 1214 coupled to a sole 1212, and the upper 1214 includes an ankle region 1226 with an ankle collar. The ankle collar is movable between a lowered state and a raised state. In the lowered state, the ankle collar is positioned closer to the sole 1212, and in the raised state, the ankle collar is positioned farther from the sole 1212.

Furthermore, the footwear article 1210 includes the collar elevator 1250 that is coupled to the upper 1214 near the heel region 1224 and/or the ankle region 1226 and that is operable to move the ankle collar from the lowered state to the raised state. As far as the coupling of the collar elevator 1250 to the upper 1214 near the heel region 1224 and/or near the ankle region 1226, this coupling may take various forms. For example, the collar elevator 1250 may be coupled to the upper 1214 in general, the heel region 1224, the ankle region 1226, to the ankle collar 3312, or any and all combinations thereof. The bifurcated collar elevator 1250 includes a first lever arm and a second lever arm 1254. The first lever arm has a distal end and the second lever arm 1254 has a distal end 1208.

A horizontal line 1203 is depicted to represent a ground plane of the footwear article 1210 in a traditional orientation and location. The line 1203 is tangential to a ground-contacting surface 1201 of the sole 1212. Multiple reference lines are depicted extending from the line 1203. The first is a line 1205. The line 1205 represents a tangential line extending from the collar slide 1216 proximate the heel end 1218. The heel end 1218, as described previously is an anterior location (e.g., heelward) of the upper 1214 prior to transitioning to the collar slide 1216. A reference line 1213 extends from between a heelward location on the sole 1212 and a heelward-most location on the upper 1214 to aid in determining the heel end 1218 at the transition to the collar slide 1216. The line 1205 forms an angle 1207 with the line 1203.

A second line 1209 is a reference line that extends tangential to the proximal end 1206 of the second lever arm 1254. The second line 1209 forms an angle 1211 with the line 1203. In an example, for the collar slide to be effective in aiding in the donning of the footwear article 1210, it is contemplated that the angle 1207 is less than the angle 1211. In some examples the angle 1211 is 60 degrees or less. In other aspects the angle 1211 is 45 degrees or less. In some examples the angle 1207 is 45 degrees or less. In additional examples the angle 1207 is 35 degrees or less. The provided angles, in some aspects, provide for an effective collar slide 1216.

The collar slide has a proximal end at 1218, an upper-most heel end of the ankle collar. The collar slide may be monolithic with the upper 1214 at the ankle collar. In other aspects the ankle collar may be a distinct component that is joined with the upper 1214 at the ankle collar. In some aspects, the collar slide 1216 is at least partially resistant to deformation such that the collar slide 1215 maintains a ramp interface to the ankle collar even in the event a force is applied to the collar slide 1215 during a donning operation. As also depicted, it is contemplated that the distal end of the lever arm 1254 is inferior (e.g., below) the collar slide 1216. This relative positioning allows for a downward force to be applied by a wearer's foot during a donning operation to begin moving the ankle collar to a lowered state in resistance to the collar elevator 1250.

While a bifurcated collar elevator is depicted in FIGS. 9A-10C, it is contemplated that a heel pull may be used in connection with alternative collar elevators. For example, a continuous collar elevator, an asymmetrical collar elevator, or an undulating collar elevator may all be used in connection with a heel pull provided herein.

Figure 13A:
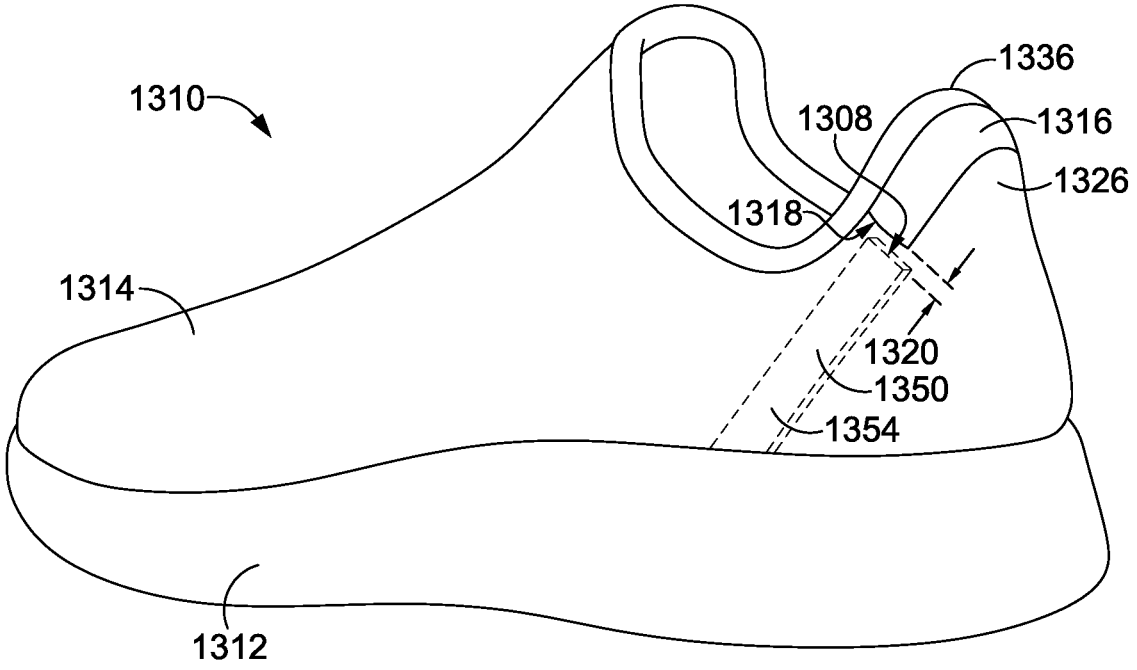
FIGS. 13A-13B depict another footwear article having a bifurcated collar elevator and a collar stay in accordance with an aspect of this disclosure.
Figure 13B:
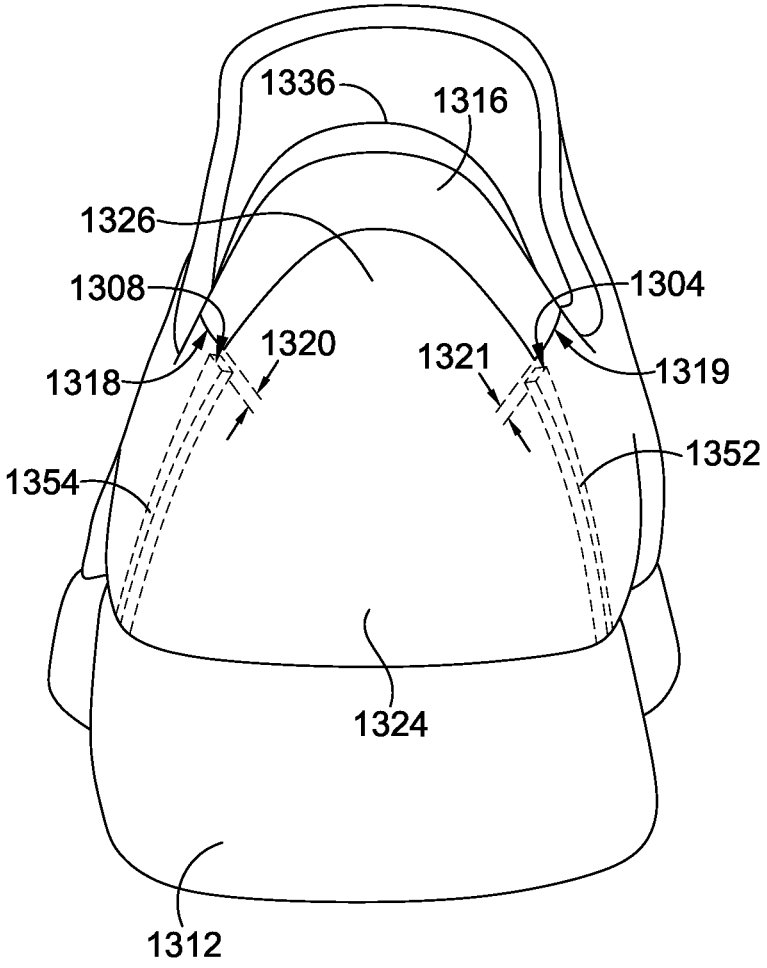

FIGS. 13A-13B depicts another footwear article 1310 having a bifurcated collar elevator 1350 and a collar stay 1316 in accordance with an aspect of this disclosure. FIG. 13A provide a side perspective view of the footwear article 1310 while FIG. 13B provide a heel end view of the footwear article 1310.

Of initial note for FIGS. 13A and 13B is a lack of overlap between distal ends 1304, 1308 of the bifurcated collar elevator 1350 and the collar stay 1316. As will be discussed in greater detail below, the collar stay 1316 is effective to return the upper 1314 in an ankle region 1326 to resist a concave formation of the ankle collar 1336 during a donning operation.

The footwear article 1310 includes an upper 1314 coupled to a sole 1312, and the upper 1314 includes an ankle region 1326 with an ankle collar 1336. The ankle collar 1336 is movable between a lowered state and a raised state. In the lowered state, the ankle collar 1336 is positioned closer to the sole 1312, and in the raised state, the ankle collar 1336 is positioned farther from the sole 1312.

Furthermore, the footwear article 1310 includes the collar elevator 1350 that is coupled to the upper 1314 near the heel region 1324 and/or the ankle region 1326 and that is operable to move the ankle collar 1336 from the lowered state to the raised state. As far as the coupling of the collar elevator 1350 to the upper 1314 near the heel region 1324 and/or near the ankle region 1326, this coupling may take various forms. For example, the collar elevator 1350 may be coupled to the upper 1314 in general, the heel region 1324, the ankle region 1326, to the ankle collar 3313, or any and all combinations thereof.

The disclosure of FIGS. 5-8 are applicable to the collar stay configurations of FIGS. 13A-13B and therefore incorporated. For example, any base structure may be implemented (e.g., monolithic, joint, incorporated, and/or U-shaped. The bifurcated collar elevator 1350 includes a first lever arm 1352 and a second lever arm 1354. The first lever arm 1352 has the distal end 1304 and the second lever arm 1354 has the distal end 1308. A distance 1320 extends between the distal end 1308 and a second end 1318 of the collar stay 1316. A distance 1321 extends between the distal end 1304 and a first end 1319 of the collar stay 1316. As such, there is no overlap between the collar stay 1316 and the lever arms of the bifurcated collar elevator 1350, in this example.

The collar stay 1316 is a polymeric composition having a stiffness (i.e., stiffness is the extent to which an object resists deformation in response to an applied force) that is greater than the upper 1314 in the ankle region 1326. The supplemental stiffness provided by the collar stay 1316 resists a deformation into a concave shape during a donning operation. Additionally, by preventing an overlap between the collar stay 1316 and the distal ends of the collar elevator 1350, the collar elevator 1350 has greater independent movement between the first lever arm 1352 and the second lever arm 1354, which may aid in operation of the collar elevator 1350 in some examples.

Figure 14A:
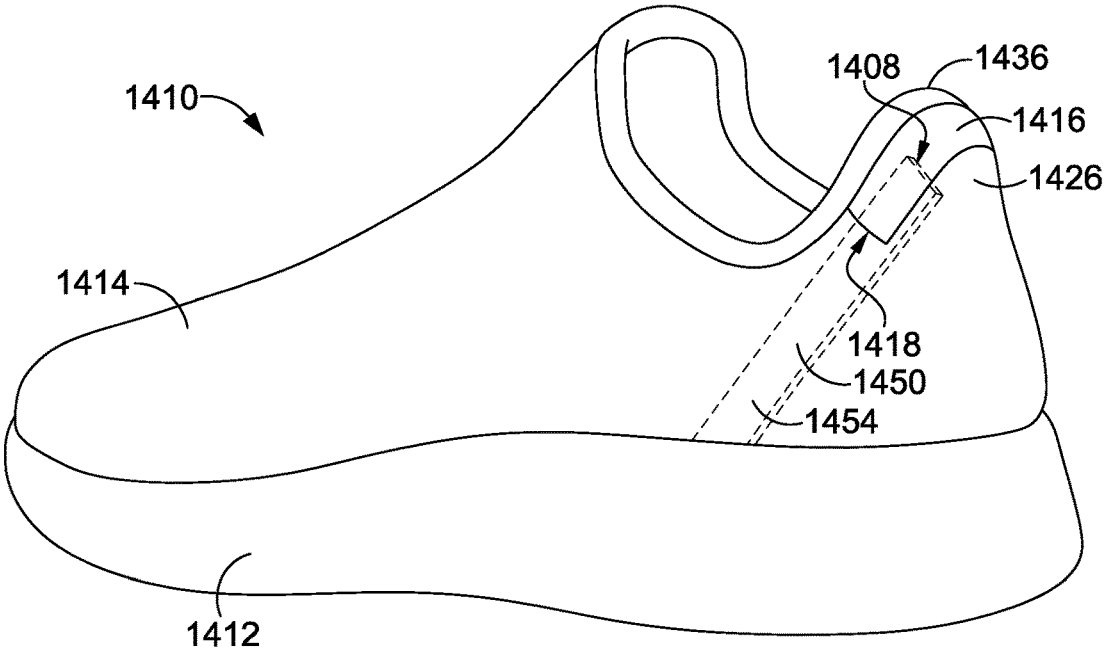
FIGS. 14A-14B depict another footwear article having a bifurcated collar elevator overlapping a collar stay in accordance with an aspect of this disclosure.
Figure 14B:
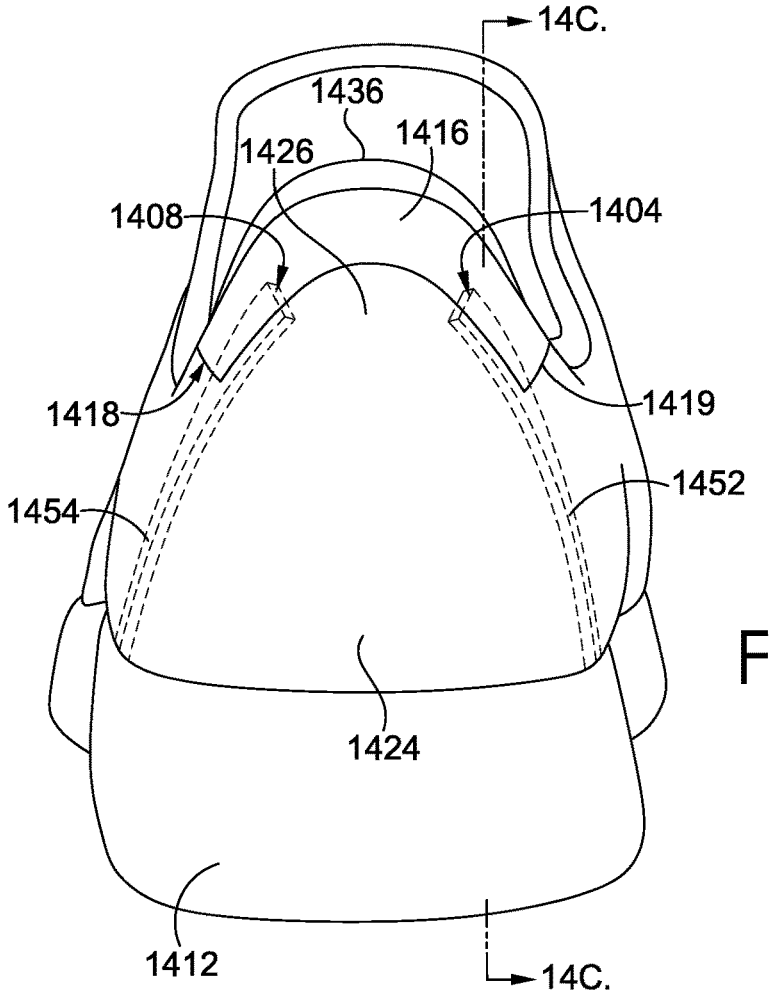

FIGS. 14A and 14B depict another footwear article 1410 having a bifurcated collar elevator 1450 and a collar stay 1416, in accordance with an aspect of this disclosure. Of initial note for FIGS. 14A and 14B is an overlap between distal ends 1404, 1408 of the bifurcated collar elevator 1450 and the collar stay 1416. As will be discussed in greater detail below, the collar stay 1416 is effective in connection with the bifurcated collar elevator 1450 to prevent the upper 1414 in an ankle region 1426 deforming into a concave structure between the bifurcated collar elevator 1450 lever arms during a donning process, as will described below.

The footwear article 1410 includes an upper 1414 coupled to a sole 1412, and the upper 1414 includes an ankle region 1426 with an ankle collar 1436. The ankle collar 1436 is movable between a lowered state and a raised state. In the lowered state, the ankle collar 1436 is positioned closer to the sole 1412, and in the raised state, the ankle collar 1436 is positioned farther from the sole 1412.

Furthermore, the footwear article 1410 includes the collar elevator 1450 that is coupled to the upper 1414 near the heel region 1424 and/or the ankle region 1426 and that is operable to move the ankle collar 1436 from the lowered state to the raised state. As far as the coupling of the collar elevator 1450 to the upper 1414 near the heel region 1424 and/or near the ankle region 1426, this coupling may take various forms. For example, the collar elevator 1450 may be coupled to the upper 1414 in general, the heel region 1424, the ankle region 1426, to the ankle collar 3314, or any and all combinations thereof.

Figure 14C:
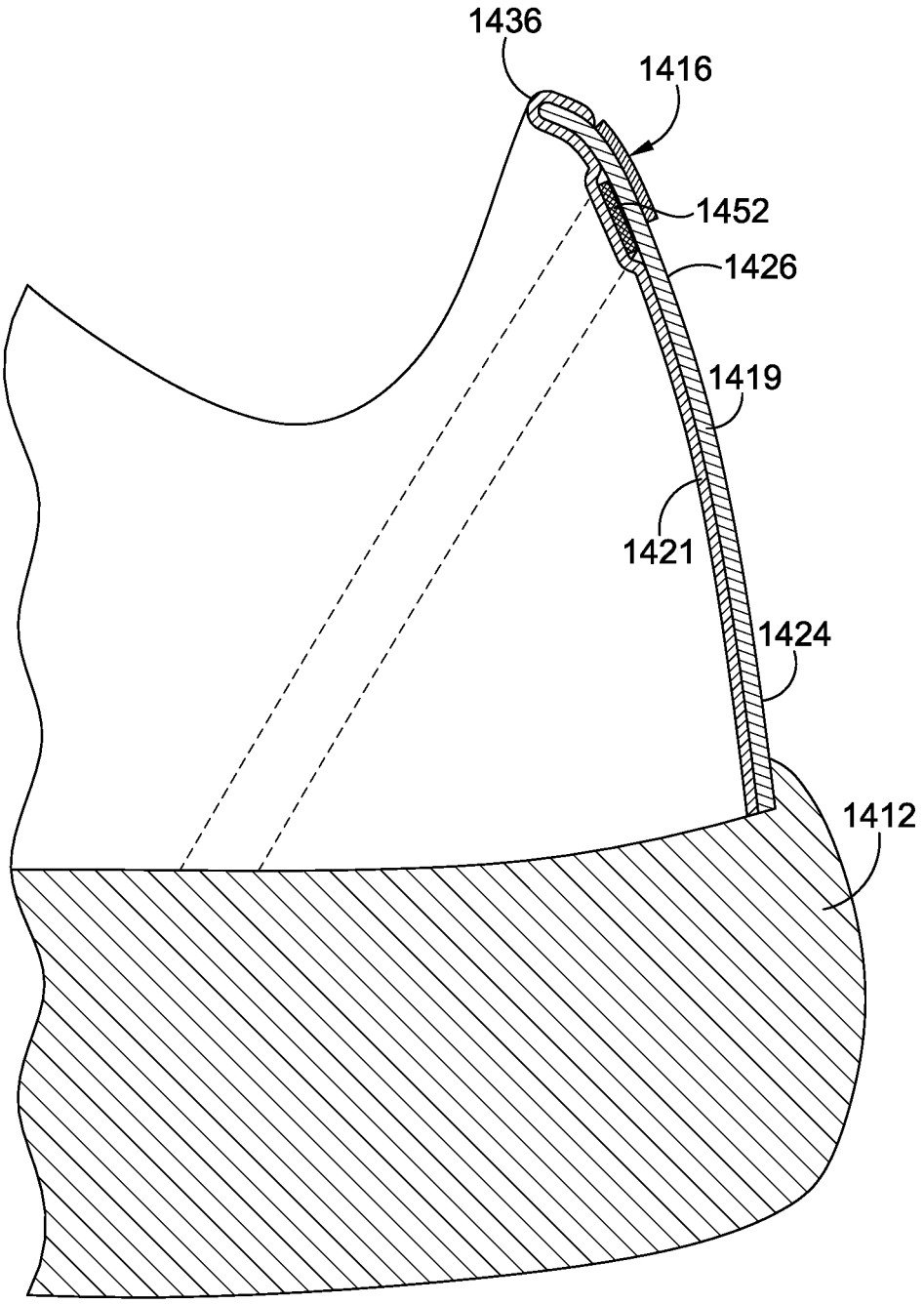
FIG. 14C depicts a cross section along cutline 14C-14C of FIG. 14B in accordance with an aspect of this disclosure.

The disclosure of FIGS. 5-8 are applicable to the collar stay configurations of FIGS. 14A-14C and therefore incorporated. For example, any base structure may be implemented (e.g., monolithic, joint, incorporated, and/or U-shaped. The bifurcated collar elevator 1450 includes a first lever arm 1452 and a second lever arm 1454. The first lever arm 1452 has the distal end 1404 and the second lever arm 1454 has the distal end 1408. The collar stay 1416 overlaps both of the distal ends 1404 and 1408.

The overlap of the collar stay 1416 and the bifurcated collar elevator 1350 allows for a transfer of force in the toward direction caused by a wearer's foot inserting into the footwear article 1410 during a donning operation. The increased stiffness of the collar stay 1416 relative to the upper 1414 in the ankle region 1426 is effective to transfer a toe ward force to the collar elevator 1350. This transfer of force allows the ankle collar 1436 to resist deformation into a concave shape. Stated differently, the collar stay 1416 is effective to convert a toe ward force into a transverse force as a bridge to then be transferred through the first lever arm 1452 and the second lever arm 1454 to oppose a deformation of the ankle collar inwardly toward the toe end.

FIG. 14C provides a cross section view of the footwear article along cutline 14C-14C of FIG. 14B, in accordance with aspects hereof. As depicted in this example configuration, an inner material 1421 (e.g., a liner) is on an interior side of the first lever arm 1452 and an exterior material 1419 is on an exterior surface of the first lever arm 1452. The collar stay 1416 is depicted overlapping a portion of the first lever arm 1452. Further, the exterior material 1419 is positioned between the first lever arm 1452 and the collar stay 1416 so that the collar stay 1416 is indirectly joined with the bifurcated collar elevator. The collar stay 1416 is therefore a portion of the upper 1414 in this example and the collar elevator remains bifurcated (e.g., non-continuous). Having the intervention of the exterior material 1419 (or any material) between the collar stay 1416 and the first lever arm 1452 allows the first lever arm and the second lever arm to independently move.

While a bifurcated collar elevator is depicted in FIGS. 14A-14C, it is contemplated that a collar stay may be used in connection with alternative collar elevators. For example, a continuous collar elevator, an asymmetrical collar elevator, or an undulating collar elevator may all be used in connection with a collar stay provided herein.

Figure 15:
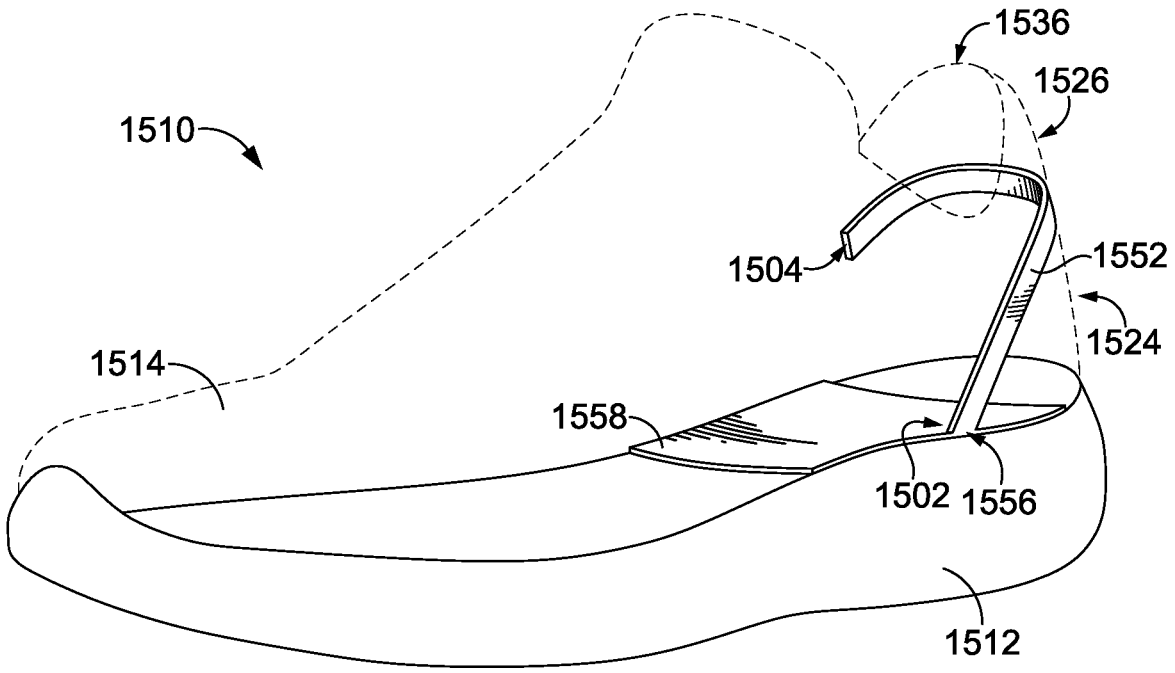
FIG. 15 depicts another footwear article having an asymmetrical collar elevator monolithic with a base in accordance with an aspect of this disclosure.

Turning to FIG. 15, which depicts a footwear article 1510 having a collar elevator 1550, in accordance with aspects herein. Specifically, the collar elevator is an example of an asymmetrical collar elevator comprised of a first lever arm 1552 having a proximal end 1502 and a distal end 1504. An asymmetrical collar elevator is distinguished from the collar elevator 350 of FIG. 3A as the first lever arm distal end 1504 is discontinuous with a base, such as the sole while the proximal end 1502 is continuous, joined, incorporated, or otherwise connected with a base.

An asymmetrical collar elevator provides advantages to footwear assembly in some examples. Instead of either forming a footwear upper around a continuous collar elevator or threading a continuous collar elevator from a first side to a second side of the footwear through a channel of a footwear upper during assembly, an asymmetrical collar elevator can more easily be incorporated because of the discontinuous nature of the lever arm relative to a base on both ends of the lever arm, in an example. Additional advantages of an asymmetrical collar elevator may include a reduction in material and associated mass at the distal end 1504. Yet other potential advantages of an asymmetrical collar elevator relative to a continuous collar elevator include variable response such that the first lever arm has a different response on a first side of the footwear article than the other side of the footwear article, in an example. As such, an asymmetrical collar elevator provides a variety of advantageous from a continuous collar elevator, such as those described in FIG. 3A, in some examples.

The lever arm of an asymmetrical collar elevator may extend around a heel end of the footwear article in an example. The lever arm of an asymmetrical collar elevator may terminate (e.g., the distal ends) prior to wrapping around a portion of the heel end in another example.

The footwear article 1510 includes an upper 1514 coupled to a sole 1512, and the upper 1514 includes an ankle region 1526 with an ankle collar 1536. The ankle collar 1536 is movable between a lowered state and a raised state. In the lowered state, the ankle collar 1536 is positioned closer to the sole 1512, and in the raised state, the ankle collar 1536 is positioned farther from the sole 1512.

Furthermore, the footwear article 1510 includes the collar elevator 1550 that is coupled to the upper 1514 near the heel region 1524 and/or the ankle region 1526 and that is operable to move the ankle collar 1536 from the lowered state to the raised state. As far as the coupling of the collar elevator 1550 to the upper 1514 near the heel region 1524 and/or near the ankle region 1526, this coupling may take various forms. For example, the collar elevator 1550 may be coupled to the upper 1514 in general, the heel region 1524, the ankle region 1526, to the ankle collar 3316, or any and all combinations thereof.

For illustrative purposes, the upper 1514 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The first lever arm 1552 is monolithic to a base 1558. A monolithic configuration is one that is formed or composed of material without joints or seams. Therefore at a junction between the first lever arm 1552 and the base 1558, the junction is absent a joint, seam, or other connection. Instead, the material forming the base 1558 continuously extends to the second lever arm 1554. For example, the lever arm and the base may be formed, such as through a molding operation, as a common part at a common operation, in an example.

The base 1558 is affixed to or near a foot-facing surface of the sole 1512, and the base 1558 might be a portion of an outsole, a portion of a midsole, a portion of an insole, a portion of a strobel, a plate or sheet of material layered between any of these sole layers, or any combination thereof. Among other things, the base 1558 might include a rigid portion or section to which the lever arms 1552 and 1554 are anchored.

Figure 16:
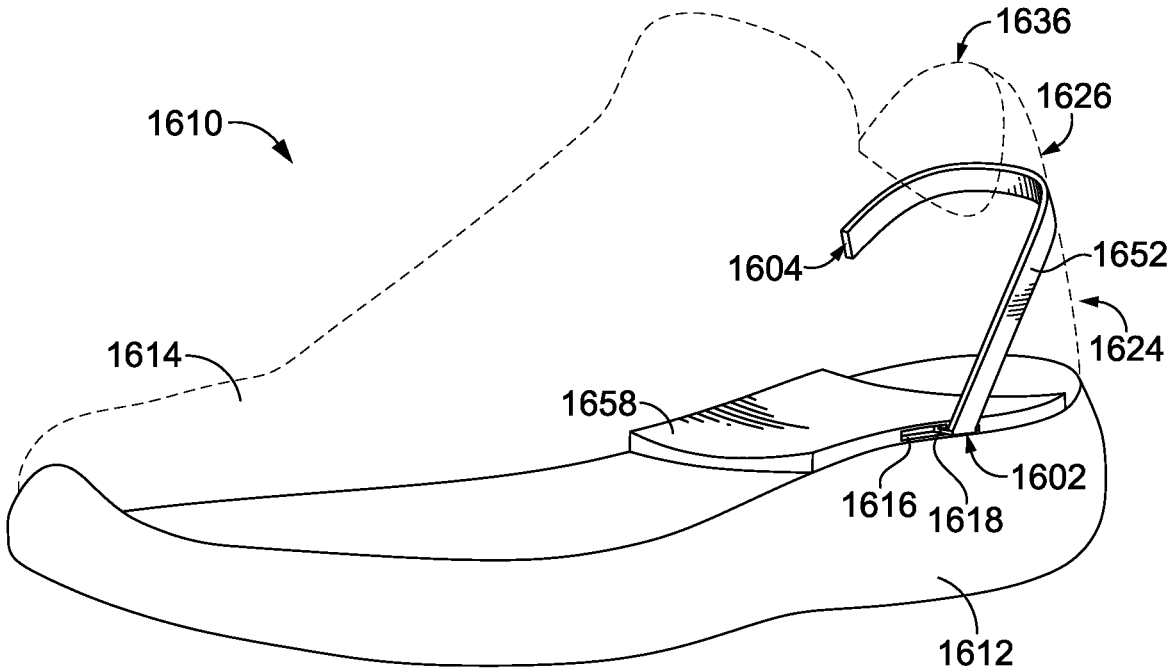
FIG. 16 depicts another footwear article having an asymmetrical collar elevator joined with a base in accordance with an aspect of this disclosure.

FIG. 16 depicts an alternative footwear article 1610 having a collar elevator 1650, in accordance with aspects herein. Specifically, the collar elevator is an example of an asymmetrical collar elevator comprised of a first lever arm 1652 having a proximal end 1602 and a distal end 1604.

The lever arm of an asymmetrical collar elevator may extend around a heel end of the footwear article in an example. The lever arms of an asymmetrical collar elevator may terminate (e.g., the distal ends) prior to wrapping around a portion of the heel end in another example.

The footwear article 1610 includes an upper 1614 coupled to a sole 1612, and the upper 1614 includes an ankle region 1626 with an ankle collar 1636. The ankle collar 1636 is movable between a lowered state and a raised state. In the lowered state, the ankle collar 1636 is positioned closer to the sole 1612, and in the raised state, the ankle collar 1636 is positioned farther from the sole 1612.

Furthermore, the footwear article 1610 includes the collar elevator 1650 that is coupled to the upper 1614 near the heel region 1624 and/or the ankle region 1626 and that is operable to move the ankle collar 1636 from the lowered state to the raised state. As far as the coupling of the collar elevator 1650 to the upper 1614 near the heel region 1624 and/or near the ankle region 1626, this coupling may take various forms. For example, the collar elevator 1650 may be coupled to the upper 1614 in general, the heel region 1624, the ankle region 1626, to the ankle collar 3316, or any and all combinations thereof.

For illustrative purposes, the upper 1614 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The first lever arm 1652 is distinct from and joined to a base 1658. A joined configuration may either be reversibly joined or permanently joined. A permanent joint may occur through an adhesive bond, welding, or other methods of causing an irreversible chemical or physical connection between the elements. A reversible joining between the components may be accomplished through a mechanical connection that generates a joint. For example, FIG. 16 depicts the base 1658 having a slot 1616 into which a latch 1618 from the distal end 1606 extends. The latch 1618 when inserted into the slot 1616 mechanically joins the base 1658 and the first lever arm 1652. The mechanical joining may be through an interference of materials forming the latch and the slot, through friction, snaps, ratchet, compression, and other techniques. By having a joint between the base 1658 and the lever arm, assembly of the footwear article may be simplified as the lever arm may be incorporated into the upper prior to the lever arm being joined with the base. As such, the base 1658, which may be the sole 1612 or integrated with the sole 1612 may be assembled in a traditional manner for footwear articles and the upper 1614 may be assembled in a more traditional manner while incorporating the lever arm and then the sole 1612 and the upper 1614 having the lever arms. For example, as the sole 1612 is joined with the upper 1614, the lever arm may be joined with the base concurrently.

The base 1658 is affixed to or near a foot-facing surface of the sole 1612, and the base 1658 might be a portion of an outsole, a portion of a midsole, a portion of an insole, a portion of a strobel, a plate or sheet of material layered between any of these sole layers, or any combination thereof. Among other things, the base 1658 might include a rigid portion or section to which the lever arm 1652 is anchored.

Figure 17:
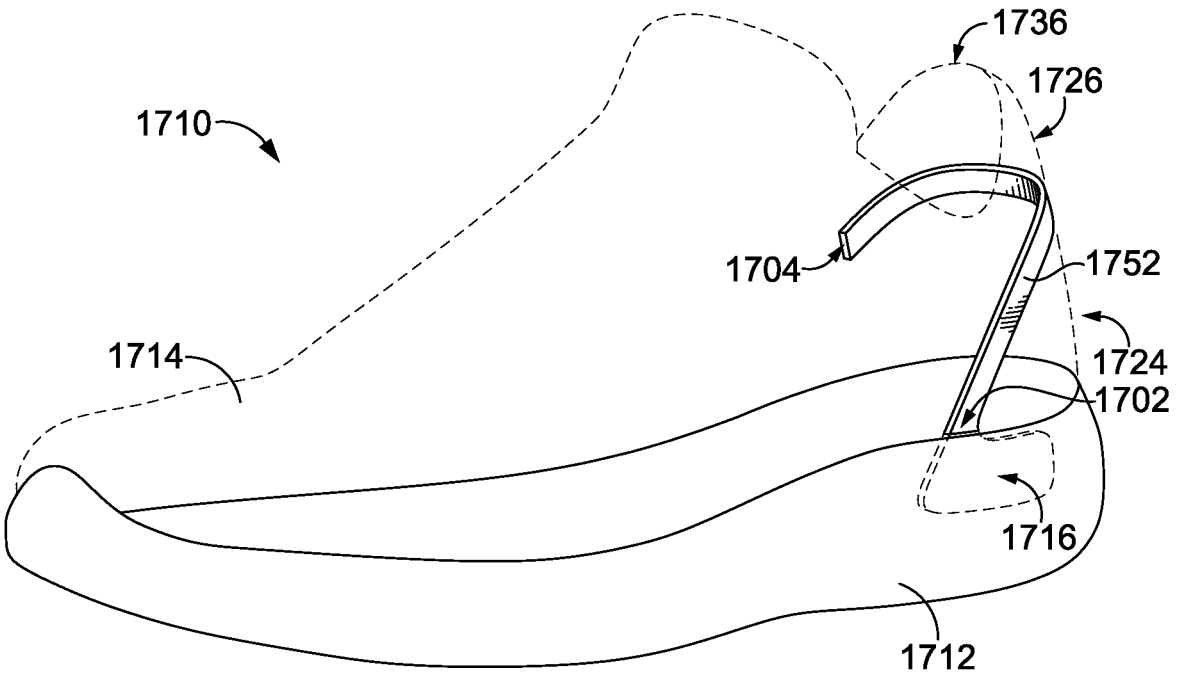
FIG. 17 depicts another footwear article having an asymmetrical collar elevator integrated with a base in accordance with an aspect of this disclosure.

FIG. 17 depicts an alternative footwear article 1710 having a collar elevator 1750, in accordance with aspects herein. Specifically, the collar elevator is an example of an asymmetrical collar elevator comprised of a first lever arm 1752 having a proximal end 1702 and a distal end 1704.

The lever arm of an asymmetrical collar elevator may extend around a heel end of the footwear article in an example. The lever arm of an asymmetrical collar elevator may terminate (e.g., the distal ends) prior to wrapping around a portion of the heel end in another example.

The footwear article 1710 includes an upper 1714 coupled to a sole 1712, and the upper 1714 includes an ankle region 17216 with an ankle collar 17316. The ankle collar 1736 is movable between a lowered state and a raised state. In the lowered state, the ankle collar 1736 is positioned closer to the sole 1712, and in the raised state, the ankle collar 1736 is positioned farther from the sole 1712.

Furthermore, the footwear article 1710 includes the collar elevator 1750 that is coupled to the upper 1714 near the heel region 1724 and/or the ankle region 1726 and that is operable to move the ankle collar 1736 from the lowered state to the raised state. As far as the coupling of the collar elevator 1750 to the upper 1714 near the heel region 1724 and/or near the ankle region 1726, this coupling may take various forms. For example, the collar elevator 1750 may be coupled to the upper 1714 in general, the heel region 1724, the ankle region 1726, to the ankle collar 1736, or any and all combinations thereof.

For illustrative purposes, the upper 1714 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The first lever arm 1752 is distinct from and incorporated into a base, such as the sole 1712. An incorporation of components includes the formation of one component after the formation of another component. For example, the first lever arm 1752 may be positioned in a tooling that will be used to mold the sole 1712 (or a portion of the sole) prior to or as the sole is being formed. For example, the lever arm may be positioned in a mold into which a polymeric composition will be introduced (e.g., injected or poured). As the polymeric composition is introduced, the polymeric composition surrounds an anchor portion 1716 that becomes embedded within the sole 1712 leaving exposed the portion of the lever arm extending from the proximal end to the distal end. In an additional example, a cavity, opening, or other volume may be maintained during an initial forming of the sole 1712 such that the anchor 1716 may be inserted into those spaces and the embedded therein by a secondary process, such as filling the volume holding the anchor with a material. In this example, the lever arm may be introduced with the sole after an initial forming of both, but a secondary process incorporates the lever arm with the sole, such as through a curing of a complementary polymeric material to that which formed the sole.

The anchor 1716 may be of any size or shape. In the depicted aspect, the anchor 1716 extends in a heelward direction and have a cross sectional shape that resists dislodgement through an opening created at the sole 1712 at the proximal ends of the lever arm. In alternative aspects, it is contemplated that the anchor may extend in a toe ward direction from a point of incorporation on the sole foot-facing surface. In yet other examples it is contemplated that the anchor may in extend in opposite direction (e.g., heelward and toe ward) from a point of incorporation on the sole foot-facing surface. Additional any combination of size, orientation, and shape is contemplated for the anchor.

Figure 18:
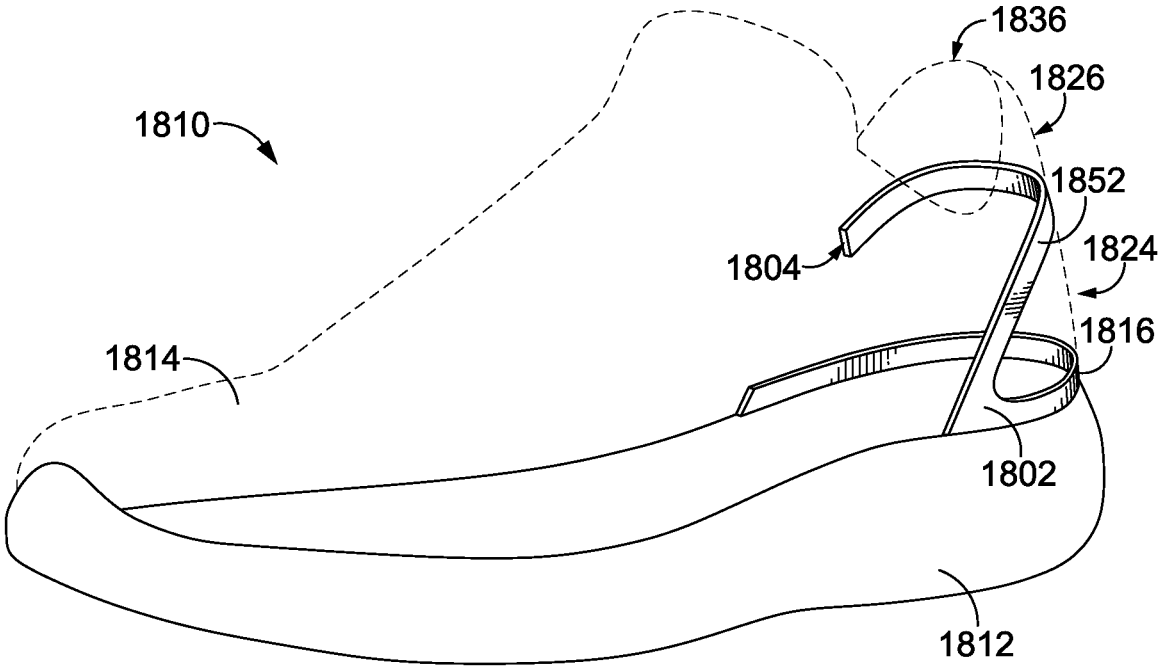
FIG. 18 depicts another footwear article having an asymmetrical collar elevator in accordance with an aspect of this disclosure.

FIG. 18 depicts an alternative footwear article 1810 having a collar elevator 1850, in accordance with aspects herein. Specifically, the collar elevator 1850 is an example of an asymmetrical collar elevator comprised of a first lever arm 1852 having a proximal end 1802 and a distal end 1804.

The lever arm of an asymmetrical collar elevator may extend around a heel end of the footwear article in an example. The lever arm of an asymmetrical collar elevator may terminate (e.g., the distal ends) prior to wrapping around a portion of the heel end in another example.

The footwear article 1810 includes an upper 1814 coupled to a sole 1812, and the upper 1814 includes an ankle region 1826 with an ankle collar 1836. The ankle collar 1836 is movable between a lowered state and a raised state. In the lowered state, the ankle collar 1836 is positioned closer to the sole 1812, and in the raised state, the ankle collar 1836 is positioned farther from the sole 1812.

Furthermore, the footwear article 1810 includes the collar elevator 1850 that is coupled to the upper 1814 near the heel region 1824 and/or the ankle region 1826 and that is operable to move the ankle collar 1836 from the lowered state to the raised state. As far as the coupling of the collar elevator 1850 to the upper 1814 near the heel region 1824 and/or near the ankle region 1826, this coupling may take various forms. For example, the collar elevator 1850 may be coupled to the upper 1814 in general, the heel region 1824, the ankle region 1826, to the ankle collar 1836, or any and all combinations thereof.

For illustrative purposes, the upper 1814 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

FIG. 18 depicts a different aspect of a base, in which a base 1816 might attach to a portion of the upper (e.g., a heel counter), a portion of the midsole sidewall, or any combination thereof, and the base 1816 wraps around a backside of the footwear article, as opposed to extending through the footbed in the manner described with respect to the base 1558 of FIG. 15. This is a similar configuration to FIGS. 4A-4C provided before, but with an asymmetrical collar elevator. The base 1816, like the other bases discussed herein may be monolithic, joined, or otherwise formed with the lever arm. Further, while depicted as having a superior edge that is above a foot-facing surface of the sole 1812, it is contemplated that the base 1816 may be recessed or incorporated into the sole 1812 in alternative aspects.

As will be appreciated throughout and as indicated previously, it is contemplated that any combination of base, joint/coupling/extension between the base and the lever arm, lever arm size, lever arm shape, lever arm cross section, angle between the base and lever arm, position of the base and/or lever arm, and orientation of the lever arm is contemplated in connection with an asymmetrical collar elevator. Further, any material provided herein in connection with a collar elevator and base is contemplated as being applicable to an asymmetrical collar elevator configuration.

Figure 19A:
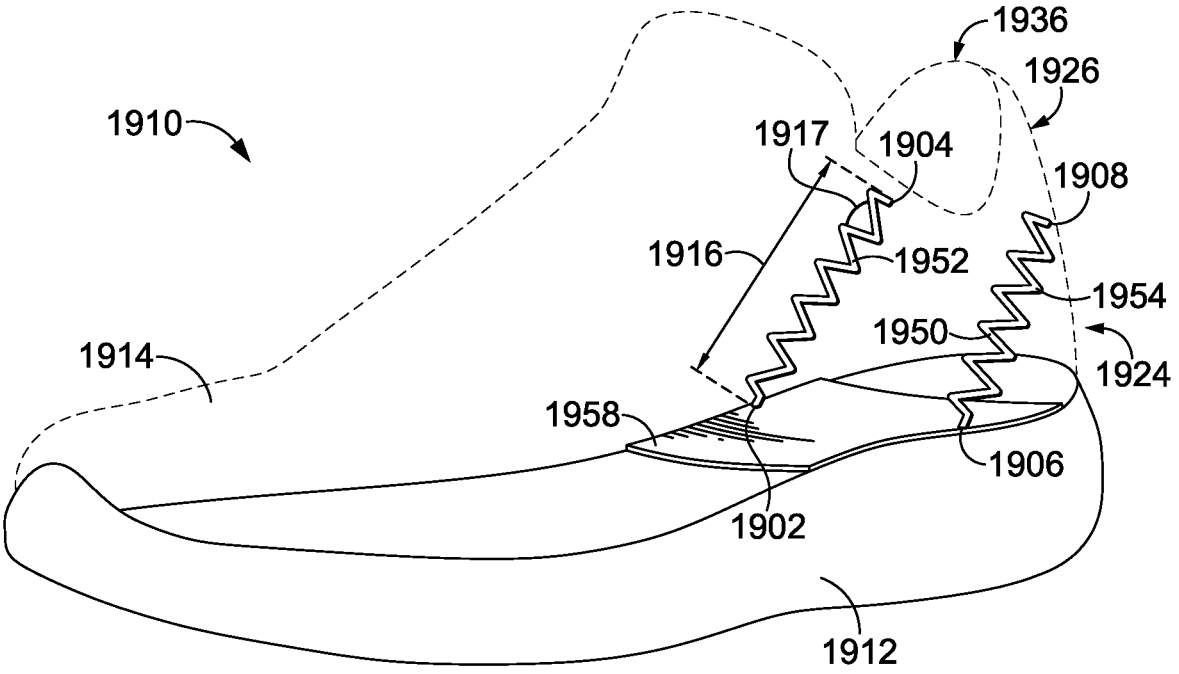
FIGS. 19A-19B depict another footwear article having an undulating collar elevator in accordance with an aspect of this disclosure.
Figure 19B:
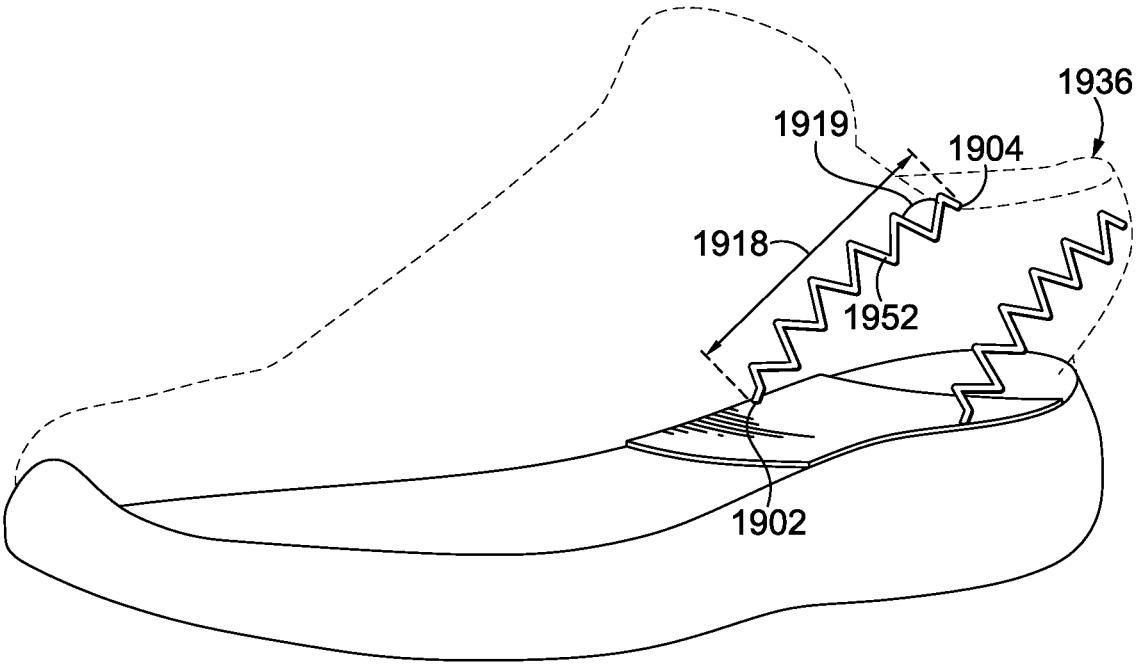

FIGS. 19A-19B depicts another footwear article 1910 having an undulating collar elevator 1950 in accordance with an aspect of this disclosure. FIG. 19A depicts the footwear article 1910 in the raised state and FIG. 19B depicts the footwear article 1910 in a lowered state.

The footwear article 1910 includes an upper 1914 coupled to a sole 1912, and the upper 1914 includes an ankle region 1926 with an ankle collar 1936. The ankle collar 1936 is movable between a lowered state (FIG. 19B) and a raised state (FIG. 19A). In the lowered state, the ankle collar 1936 is positioned closer to the sole 1912, and in the raised state, the ankle collar 1936 is positioned farther from the sole 1912.

Furthermore, the footwear article 1910 includes the collar elevator 1950 that is coupled to the upper 1914 near the heel region 1924 and/or the ankle region 1926 and that is operable to move the ankle collar 1936 from the lowered state to the raised state. As far as the coupling of the collar elevator 1950 to the upper 1914 near the heel region 1924 and/or near the ankle region 1926, this coupling may take various forms. For example, the collar elevator 1950 may be coupled to the upper 1914 in general, the heel region 1924, the ankle region 1926, to the ankle collar 1936, or any and all combinations thereof.

For illustrative purposes, the upper 1914 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The undulating collar elevator 1950 is comprised of a first lever arm 1952 having a proximal end 1902 and a distal end 1904 and a second lever arm 1954 having a proximal end 1906 and a distal end 1908. The lever arms in this example are undulating in nature. An undulating lever arm is a level arm having successive curves, which may be waves, curves, or sharp angles, in alternate directions for at least a portion of a length between a proximal and distal end of the lever arm. An undulating structure is effective to dynamically change in at least two manners. A first manner of change or movement is an elongation along a longitudinal length, much like a spring under tension (e.g., FIGS. 19A and 19B) or compression (e.g., FIGS. 20A and 20B). A second manner of change or movement is in a plane defined by the undulation structure (e.g., a plane in which the successive direction changes occur) as the structure curves or bends to change the shape or form of one or more undulating portions of the structure. Therefore, an exemplary undulating structure is effective to resiliently conform to elongation and bend in the case of FIGS. 19A and 19B to generate a wider opening for donning and then return to a native position for securement of the footwear article about a wearer's foot.

In FIG. 19A in the raised state, the first lever arm 1952 is depicted having a length 1916 between the proximal end 1902 and the distal end 1904. Additionally, an exemplary angle 1917 is depicted between an undulation on the superior side of the first lever arm 1952. In the lowered state of FIG. 19B, the length of the first lever arm 1952 is depicted as a length 1918 and an angle 1919 is depicted between an undulation on the superior side of the first lever arm 1952. As previously discussed, the undulating structure is effective to resiliently elongate and bend to aid in donning. As such, the length 1918 is greater than the length 1916 to represent that elongation in the lowered state. Similarly, the angle 1919 is greater than the angle 1917 to represent the bending or articulation that occurs to achieve a lowered state. As the undulating lever arms are contemplated to be formed for a resilient material as provided herein, the undulating structure is effective to bias against the elongation and bending to return to a raised state.

The first lever arm 1952 and the second lever arm 1954 may be monolithic, discrete, joined, incorporated, or otherwise connected to a base 1958. The base 1958 is affixed to or near a foot-facing surface of the sole 1912, and the base 1958 might be a portion of an outsole, a portion of a midsole, a portion of an insole, a portion of a strobel, a plate or sheet of material layered between any of these sole layers, or any combination thereof. Among other things, the base 1958 might include a rigid portion or section to which the lever arms 1952 and 1954 are anchored. Any base configuration is contemplated in connection with one or more undulating lever arms.

Figure 20A:
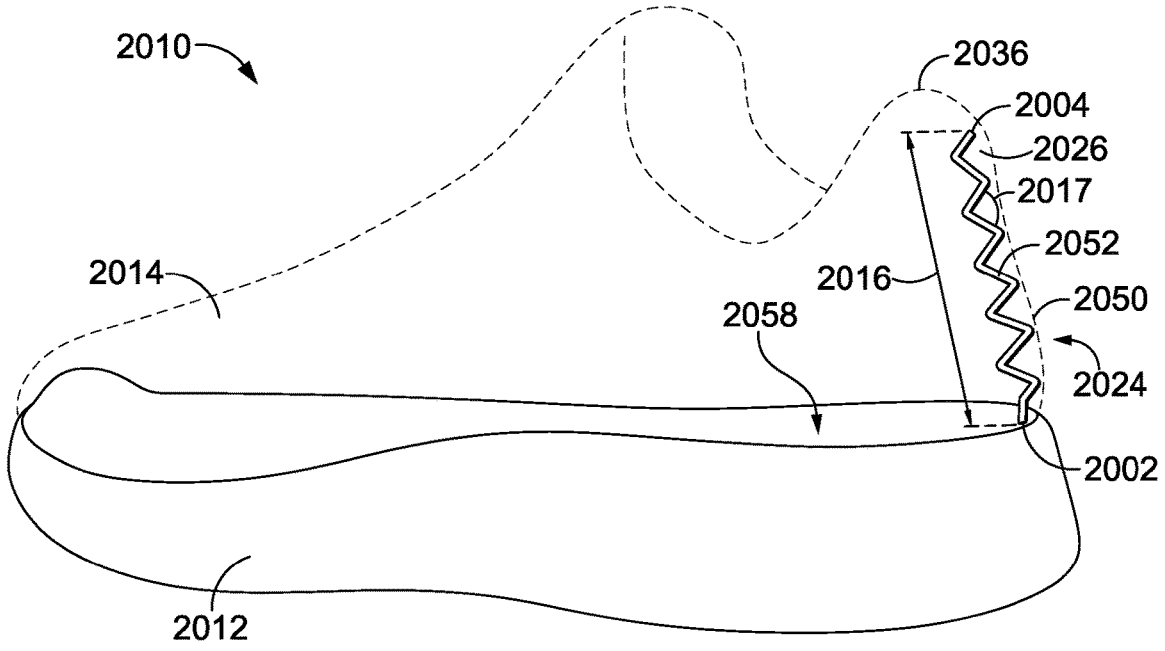
FIGS. 20A-20B depict another footwear article having an undulating collar elevator in accordance with an aspect of this disclosure.
Figure 20B:
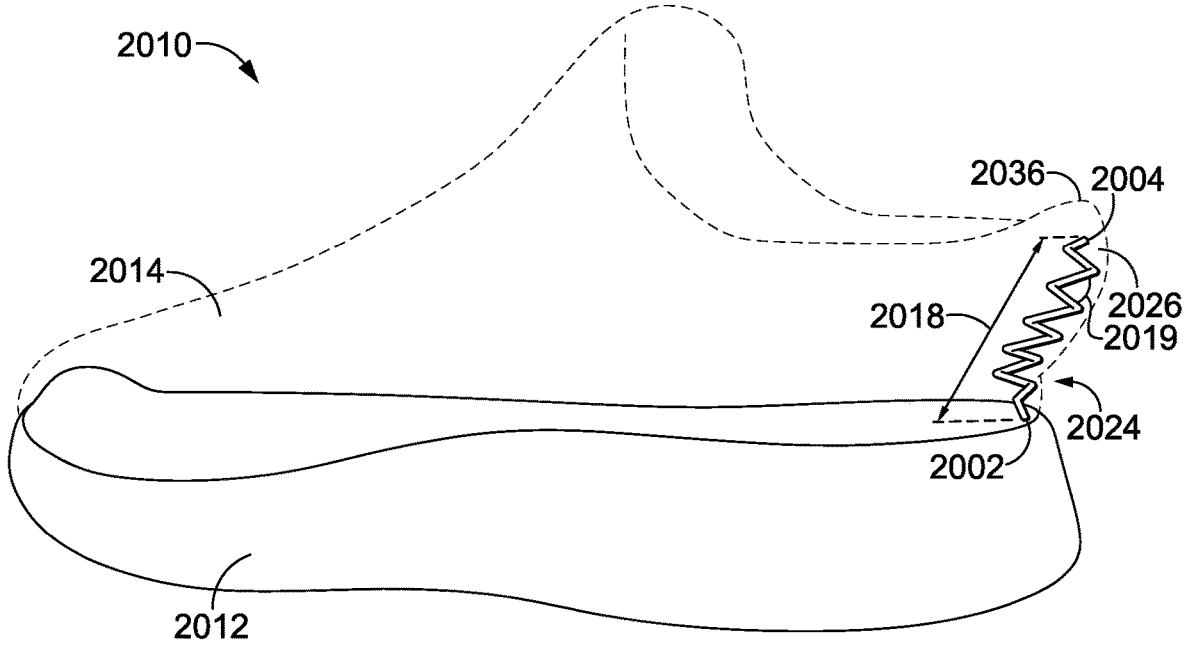

FIGS. 20A and 20B depict another footwear article 2010 having an undulating collar elevator 2050 in accordance with an aspect of this disclosure. FIG. 20A depicts the footwear article 2010 in the raised state while FIG. 20B depicts the footwear article 2010 in the lowered state.

The footwear article 2010 includes an upper 2014 coupled to a sole 2012, and the upper 2014 includes an ankle region 2026 with an ankle collar 2036. The ankle collar 2036 is movable between a lowered state (FIG. 20B) and a raised state (FIG. 20A). In the lowered state, the ankle collar 2036 is positioned closer to the sole 2012, and in the raised state, the ankle collar 2036 is positioned farther from the sole 2012.

Furthermore, the footwear article 2010 includes the collar elevator 2050 that is coupled to the upper 2014 near the heel region 2024 and/or the ankle region 2026 and that is operable to move the ankle collar 2036 from the lowered state to the raised state. As far as the coupling of the collar elevator 2050 to the upper 2014 near the heel region 2024 and/or near the ankle region 2026, this coupling may take various forms. For example, the collar elevator 2050 may be coupled to the upper 2014 in general, the heel region 2024, the ankle region 2026, to the ankle collar 2036, or any and all combinations thereof.

For illustrative purposes, the upper 2014 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The undulating collar elevator 2050 is comprised of a first lever arm 2052 having a proximal end 2002 and a distal end 2004. The first lever arm 2052 is positioned, in this example, in the heel end, which may also be referred to as an Achilles region of the article. This configuration may sometime also be referred to as a spinal or shoehorn structure because of the more vertical orientation and central location between the medial and lateral sides. The first lever arm 1952 is resilient in nature and having a native preference for a raised state of FIG. 20A. However, during a donning of the footwear article 2010, the collar elevator 2050 is compressible and able to bend in a longitudinal direction of the footwear article (heelward in the example of FIG. 20B). This compressibility is demonstrated through the difference in a length 2016 of FIG. 20A extending between the proximal end 2002 and the distal end 2004 and a length 2018 of FIG. 20B. The length 2018 is less than the length 2016. The compressibility may also be demonstrated by a change in angle of the undulations of the first lever arm 2052. An angle 2017 of an undulation in the raised state of FIG. 20A is greater than an angle 2019 of the undulation in the lowered state of FIG. 20B.

The first lever arm 2052 may be monolithic, discrete, joined, incorporated, or otherwise connected to a base 2058. The base 2058 is affixed to or near a foot-facing surface of the sole 2012, and the base 2058 might be a portion of an outsole, a portion of a midsole, a portion of an insole, a portion of a strobel, a plate or sheet of material layered between any of these sole layers, or any combination thereof. Among other things, the base 2058 might include a rigid portion or section to which the lever arm 2052 is anchored. Any base configuration is contemplated in connection with the undulating lever arm.

Figure 21:
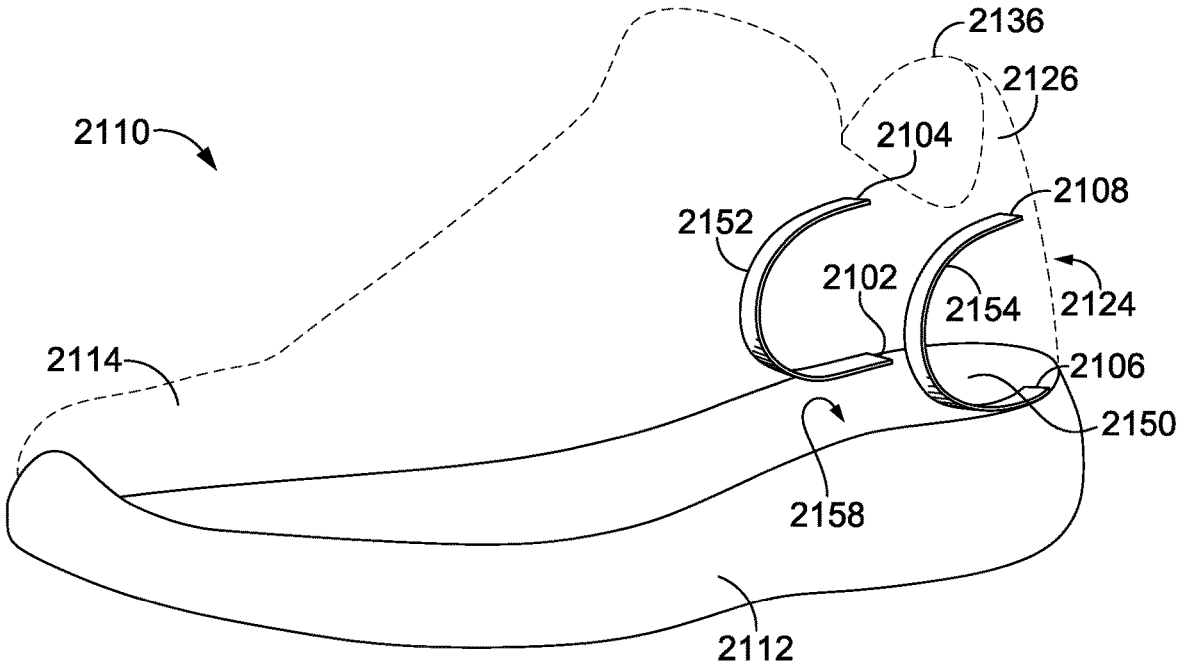
FIG. 21 depicts another footwear article having a C-shaped bifurcated collar elevator in accordance with an aspect of this disclosure.

FIG. 21 depicts another footwear article 2110 having a C-shaped bifurcated collar elevator 2150, in accordance with an aspect of this disclosure.

The footwear article 2110 includes an upper 2114 coupled to a sole 2112, and the upper 2114 includes an ankle region 2126 with an ankle collar 2136. The ankle collar 2136 is movable between a lowered state and a raised state. In the lowered state, the ankle collar 2136 is positioned closer to the sole 2112, and in the raised state, the ankle collar 2136 is positioned farther from the sole 2112.

Furthermore, the footwear article 2110 includes the collar elevator 2150 that is coupled to the upper 2114 near the heel region 2124 and/or the ankle region 2126 and that is operable to move the ankle collar 2136 from the lowered state to the raised state. As far as the coupling of the collar elevator 2150 to the upper 2114 near the heel region 2124 and/or near the ankle region 2126, this coupling may take various forms. For example, the collar elevator 2150 may be coupled to the upper 2114 in general, the heel region 2124, the ankle region 2126, to the ankle collar 2136, or any and all combinations thereof.

For illustrative purposes, the upper 2114 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The C-shaped collar elevator 2150 is comprised of a first lever arm 2152 having a proximal end 2102 and a distal end 2104 and a second lever arm 2154 having a proximal end 2106 and a distal end 2108. The lever arms in this example have a "C" profile with the proximal and distal ends heelward of the curved central portion. It is contemplate that the "C" profile may instead be positioned in an opposite orientation with the proximal and distal ends toeward for some aspects hereof. The C-shaped structure is effective to resiliently compress in a vertical direction. Additionally, it is contemplated that the C-shape may roll or otherwise move in a heelward direction during a donning operation to further open access for a foot entry into the footwear article.

The first lever arm 2152 and the second lever arm 2154 may be monolithic, discrete, joined, incorporated, or otherwise connected to a base 2158. The base 2158 is affixed to or near a foot-facing surface of the sole 2112, and the base 2158 might be a portion of an outsole, a portion of a midsole, a portion of an insole, a portion of a strobel, a plate or sheet of material layered between any of these sole layers, or any combination thereof. Among other things, the base 2158 might include a rigid portion or section to which the lever arms 2152 and 2154 are anchored. Any base configuration is contemplated in connection with one or more C-shaped lever arms.

Figure 22:
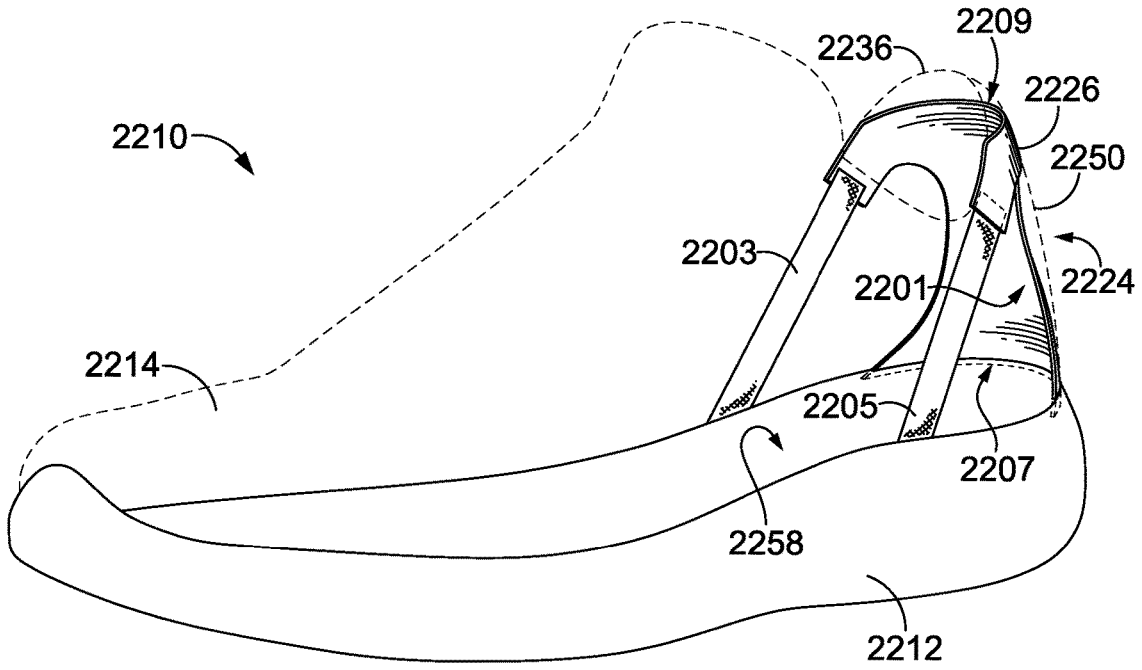
FIG. 22 depicts another footwear article having a biased collar elevator in accordance with an aspect of this disclosure.

FIG. 22 depicts another footwear article 2210 having a biased collar elevator 2250, in accordance with an aspect of this disclosure.

The footwear article 2210 includes an upper 2214 coupled to a sole 2212, and the upper 2214 includes an ankle region 2226 with an ankle collar 2236. The ankle collar 2236 is movable between a lowered state and a raised state. In the lowered state, the ankle collar 2236 is positioned closer to the sole 2212, and in the raised state, the ankle collar 2236 is positioned farther from the sole 2212.

Furthermore, the footwear article 2210 includes the collar elevator 2250 that is coupled to the upper 2214 near the heel region 2224 and/or the ankle region 2226 and that is operable to move the ankle collar 2236 from the lowered state to the raised state. As far as the coupling of the collar elevator 2250 to the upper 2214 near the heel region 2224 and/or near the ankle region 2226, this coupling may take various forms. For example, the collar elevator 2250 may be coupled to the upper 2214 in general, the heel region 2224, the ankle region 2226, to the ankle collar 2236, or any and all combinations thereof.

For illustrative purposes, the upper 2214 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

The collar elevator 2250 is formed from a heel structure 2201 that is flexibly joined with a base 2258 at a location 2207. The heel structure extends in a superior direction to a top edge 2209 that is near the ankle collar 2236. The heel structure 2201 may be any material, but in aspects the heel structure 2201 is formed from a material having a greater stiffness than the upper 2214 in the heel region 2224. The heel structure 2201 may also be referred to as a lever arm or a first lever arm herein. The heel structure 2201 is depicted as having a curve extending in the medial to lateral direction. It is this curve, in an example that enhances a resistance to a bending (e.g., going from the depicted raised state to a lowered state) of the heel structure 2201. For example, during a donning operation, the top edge 2209 may move in a heelward direction and towards the sole 2212 to provide greater access into the footwear article. This directional movement of the heel region 2224 is biased in several manners.

The first bias manner is the curvature previously discussed in the medial to lateral direction by the heel region 2224. The curvature provides a natural resistance to the bending as a deformation of the curve occurs in order for the heel structure 2201 to bend to the lowered state. A second bias manner is a resilient nature of the material forming the heel structure 2201. Having a resilient material as provided herein form at least a portion of the heel structure 2201 that is to be deformed to achieve the lowered state provides a return force to the raised state. A third bias manner is provided by a first resilient member 2203 and a second resilient member 2205. The resilient members may be elastic in nature such that they have a Young's modulus that is lower than the heel structure 2201, for example. Each of the resilient members extend between the sole 2212 (e.g., the base 2258) and the heel structure 2201 in an orientation effective to resist the transition from the raised state to the lowered state. The resilient members may be formed from an elastomeric composition, such as an elastane or other elastic material in an exemplary aspect. Each of the resilient members may be incorporated with, bonded with, mechanically attached with or otherwise connected to the sole 2212, base 2258, and/or the heel structure 2201.

The heel structure 2201 may be monolithic, discrete, joined, incorporated, or otherwise connected to the base 2258. The base 2258 is affixed to or near a foot-facing surface of the sole 2212, and the base 2258 might be a portion of an outsole, a portion of a midsole, a portion of an insole, a portion of a strobel, a plate or sheet of material layered between any of these sole layers, or any combination thereof. Among other things, the base 2258 might include a rigid portion or section to which the heel structure 2201 is anchored. Any base configuration is contemplated in connection with the heel structure 2201.

Figure 23:
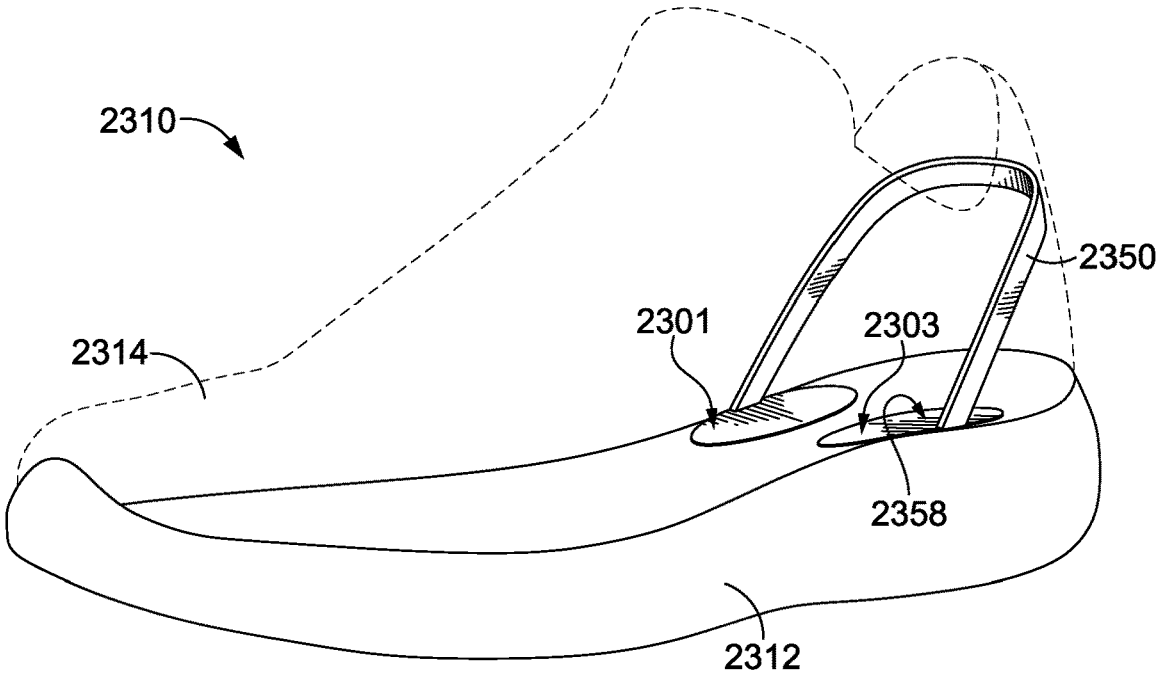
FIG. 23 depicts another footwear article having a continuous collar elevator and a multi-portion base in accordance with an aspect of this disclosure.

FIG. 23 depicts another footwear article 2310 having a continuous collar elevator 2350 and a multi-portion base 2358, in accordance with an aspect of this disclosure. A multi-portion base 2358 is another example of a base structure that may provide a number of advantages in some examples. In a first example, having a multi-portion base 2358 comprised of a first anchor 2301 and a second anchor 2303 from which collar elevator components extend provides increased flexibility to the footwear article 2310. For example, if the anchors are formed from a material that is more rigid than a sole 2312 to which they are joined, the anchors may limit some of the functionality of the sole 2312. For example, the flexibility and ability to conform as a foot-supporting surface may be hampered with a continuous base structure underfoot, but having a multi-portion base allows for independent movement of the base elements to compensate to changes in forces. This ability to better compensate to changes in forces may translate to the response characteristics of the sole 2312 as well because of the coupling between the sole 2312 and the anchors, in an example.

Another example of an advantage of a multi-portion base 2358 is from an assembly perspective. Having a multi-portion base allows for alternative assembly of the footwear article as position smaller portions may provide additional assembly flexibility over positioning and securing a single base unit of similar size or dimensions to the plurality of portions forming a base. Additionally, it is contemplated that a material cost savings and mass reduction may be achieved with a multi-portion base as compared to a monolithic base, in some examples.

The continuous collar elevator 2350 may be monolithic, discrete, joined, incorporated, or otherwise connected to the base 2358. The base 2358 is affixed to or near a foot-facing surface of the sole 2312, and the base 2358 might be a portion of an outsole, a portion of a midsole, a portion of an insole, a portion of a strobel, a plate or sheet of material layered between any of these sole layers, incorporated/embedded in as sole as provided above, or any combination thereof. Among other things, the base 2358 might include a rigid portion or section to which the collar elevator 2350 is anchored.

Figure 24:
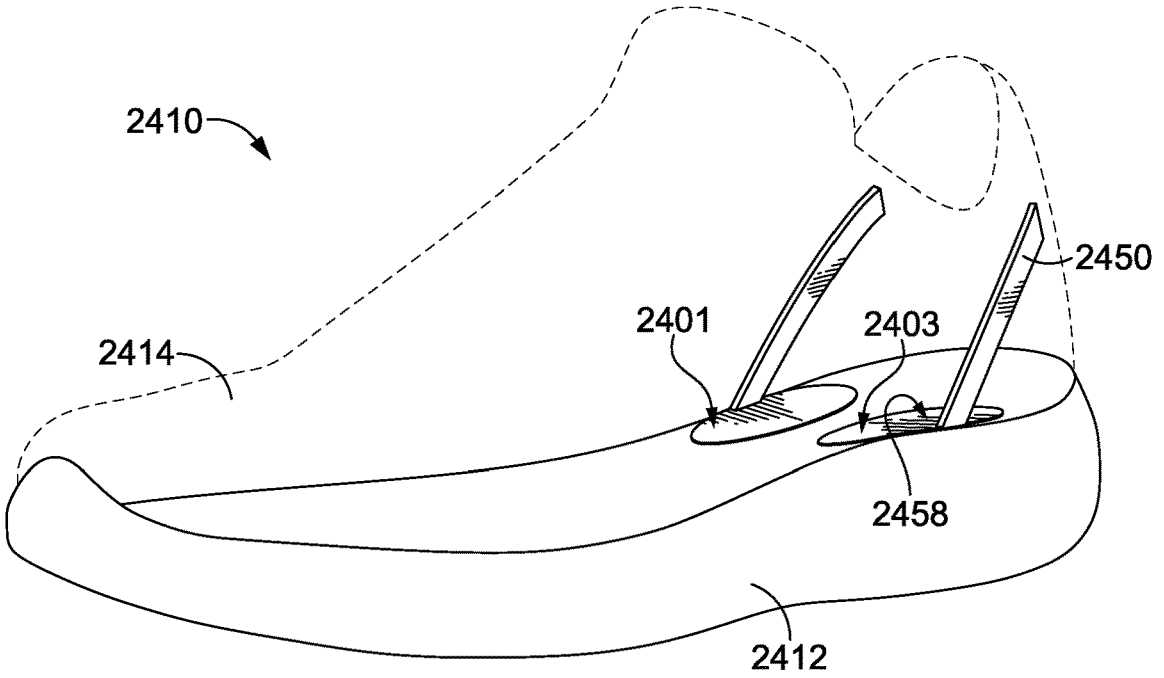
FIG. 24 depicts another footwear article having a bifurcated collar elevator and a multi-portion base in accordance with an aspect of this disclosure.

FIG. 24 depicts another footwear article 2410 having an upper 2414, a bifurcated collar elevator 2450, and a multi-portion base 2458, in accordance with an aspect of this disclosure. The multi-portion base 2458 is comprised of a first anchor 2401 and a second anchor 2403.

The bifurcated collar elevator 2450 may be monolithic, discrete, joined, incorporated, or otherwise connected to the base 2458. The base 2458 is affixed to or near a foot-facing surface of the sole 2412, and the base 2458 might be a portion of an outsole, a portion of a midsole, a portion of an insole, a portion of a strobel, a plate or sheet of material layered between any of these sole layers, incorporated/embedded in the sole, or any combination thereof. Among other things, the base 2458 might include a rigid portion or section to which the collar elevator 2450 is anchored.

FIG. 25A-26C depict various examples of an adjustable orientation connection between a base and a collar elevator, in accordance with aspects hereof. An adjustable orientation allows a common base, such as a sole and/or a common collar elevator to be used in connection with various styles of footwear, various sizes of footwear, and various biasing characteristics between the raised state and the lowered state for the footwear. Additionally, it is contemplated that a common base may accommodate different collar elevators with an adjustable orientation connection. Similarly, it is contemplated that a common collar elevator may be joined with different bases with an adjustable orientation connection.

Figure 25B:
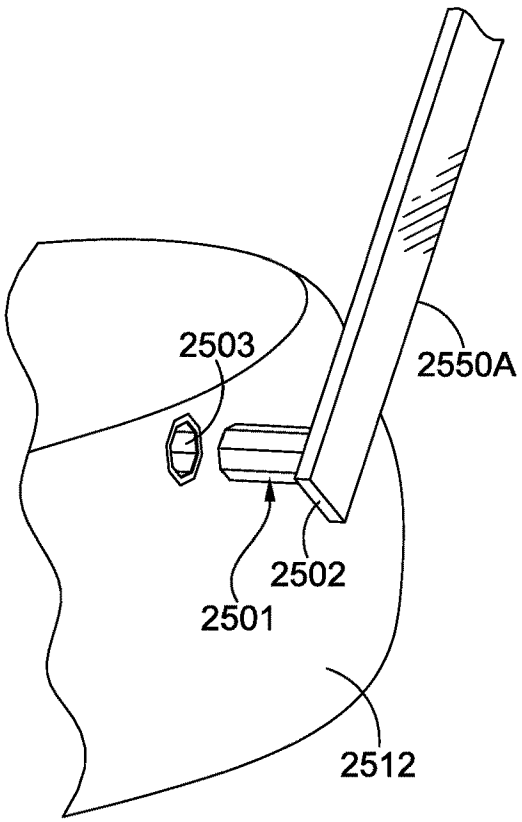
FIG. 25B depicts a perspective view of the footwear article having an adjustable orientation collar elevator at a base of FIG. 25B in accordance with an aspect of this disclosure.
Figure 25A:
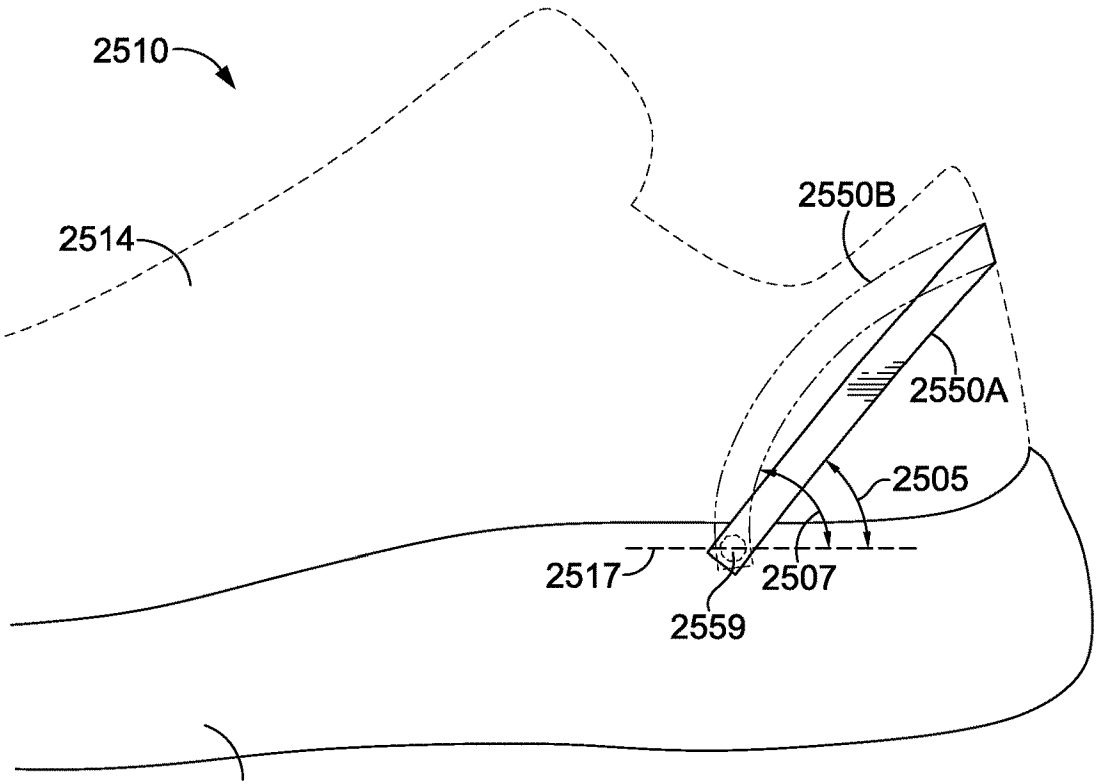
FIG. 25A depicts another footwear article having an adjustable orientation collar elevator at a base in accordance with an aspect of this disclosure.

FIG. 25A depicts a footwear article 2510 having an upper 2514, a sole 2512, and a variable connection 2559. The sole 2512 is serving as a base in this example. Two different collar elevator configurations are depicted. A first collar elevator 2550A is depicted as extending from a multi-faceted aperture 2503 as best seen in the exploded view of FIG. 25B. Staying with FIG. 25B, the multi-faceted aperture 2503 includes a number of discrete facets that are effective to engage with a corresponding faceted structure 2501 at a proximal end 2502 of the collar elevator 2550A. In this example, there is a related structure (e.g., inverse structure shape) to both the multi-faceted aperture 2503 and the faceted structure 2501, which allows for a variable orientation engagement between the two elements. For example, returning to FIG. 25A, the first collar elevator 2550A may be oriented at an angle 2505 relative to a horizontal reference 2517 and an alternative collar elevator 2550B may be oriented at an angle 2507 relative to the horizontal reference 2517. As both of the collar elevators 2550A and 2550B have different lengths but are depicted in connection with a common sole 2512 and a common upper 2514, they are oriented in the multi-faceted aperture at different angle to provide an appropriate fit with the upper 2514. The selection of one collar elevator over the other may be accomplished to achieve a desired biasing force, angle, style, and the like.

While FIG. 25B depicts a male and female configuration with the male portion extending from the collar elevator, it is contemplated that the male and female configuration may be reversed such that a male element extends from a base and the collar elevator provides a female connection point, in an example. Further, it is contemplated that the connection between the faceted structure 2501 and the faceted aperture 2503 may be permanently joined (e.g., adhesive, chemical boding) or removably joined (e.g., compression fit). In an example, the orientation between the faceted structure 2501 and the faceted aperture 2503 may be adjusted by a wearer to achieve a variable fit and collar elevator function.

Figure 25C:
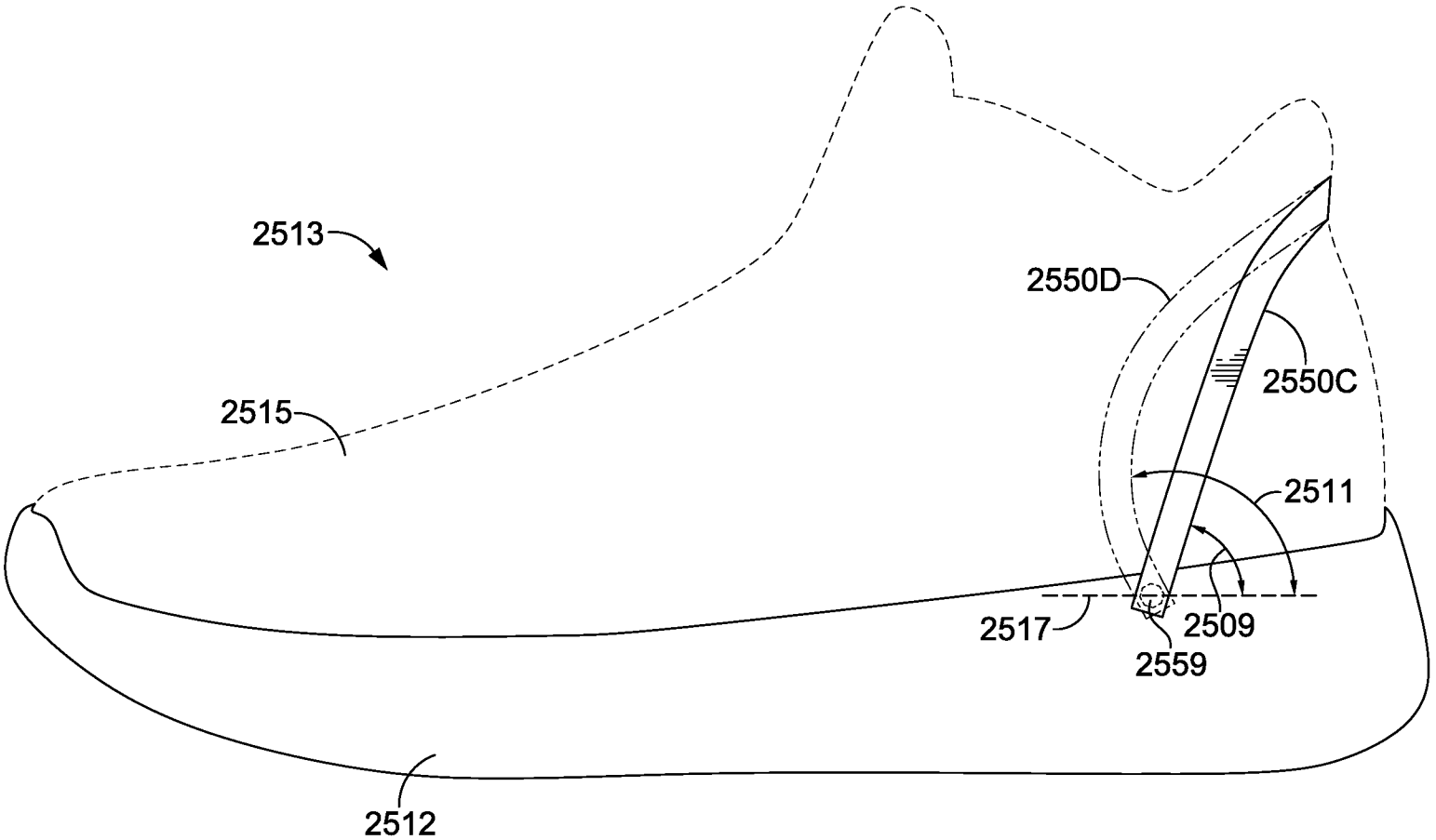
FIG. 25C depicts another footwear article having a larger adjustable orientation collar elevator at a base relative to FIG. 25A in accordance with an aspect of this disclosure.

FIG. 25C depicts another footwear article 2513 having a different style upper 2515 than the upper 2514 of FIG. 25A, while maintaining a common sole 2512, in accordance with aspects hereof. FIG. 25C is effective to demonstrate how a common base (e.g., sole 2512) can be paired with a different upper and the variable orientation connection between the collar elevator and the base provides assembly freedom. Stated differently, a common base may be used for different upper configuration by leveraging a variable orientation connection between the common base and the collar elevator (s). This can reduce inventor and tooling needs for the footwear manufacturer while allowing the footwear to have a collar elevator.

FIG. 25C is also effective to demonstrate the flexibility of different collar elevator configurations for a common base. A first collar elevator 2550C forms an angle 2509 from the horizontal reference 2517. A second collar elevator 2550D forms a second angle 2511 from the horizontal reference 2517. As such, variable configuration may be achieved with a variable orientation connection.

Figure 26B:
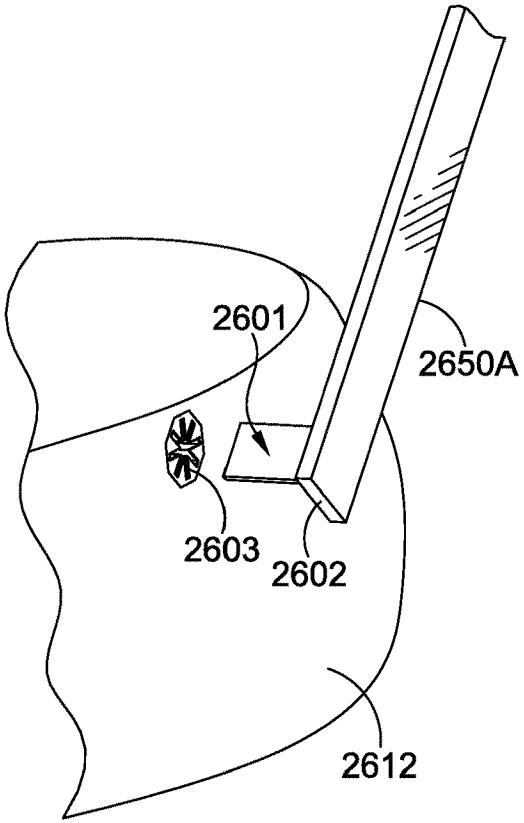
FIG. 26B depicts a perspective view of the footwear article having an adjustable orientation collar elevator at a base of FIG. 26B in accordance with an aspect of this disclosure.
Figure 26A:
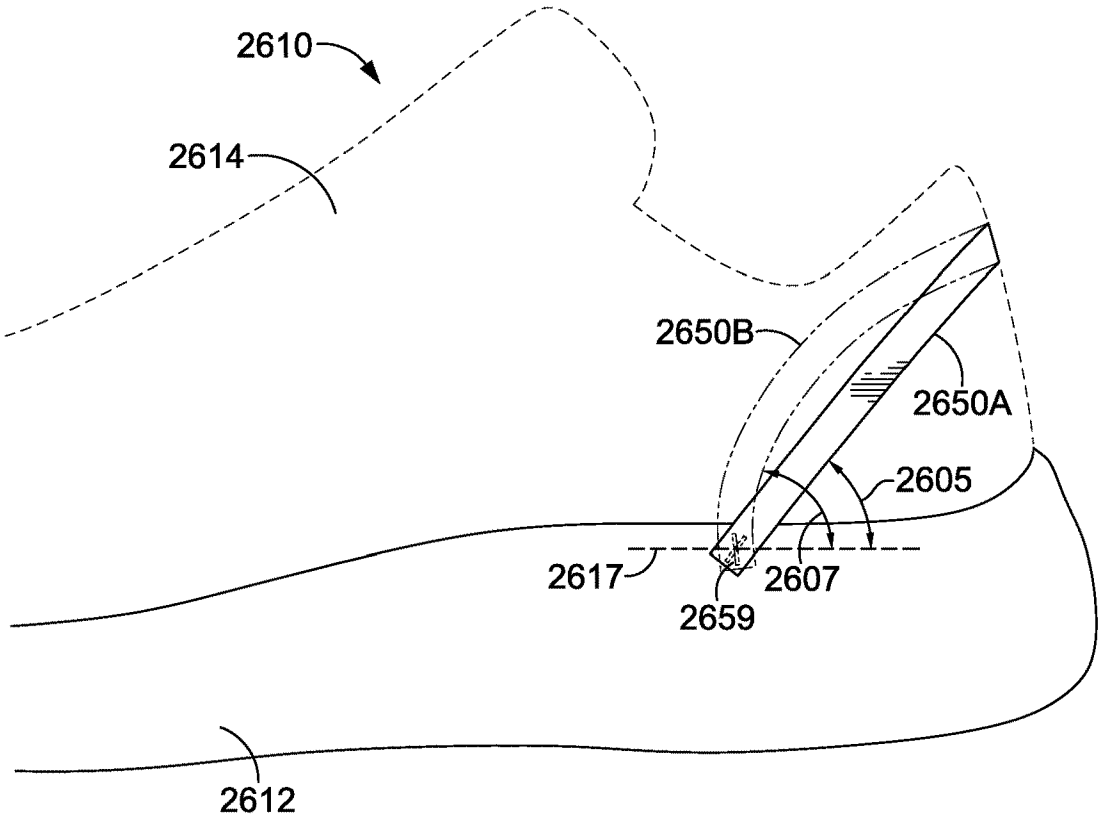
FIG. 26A depicts another footwear article having another adjustable orientation collar elevator at a base in accordance with an aspect of this disclosure.
Figure 26C:
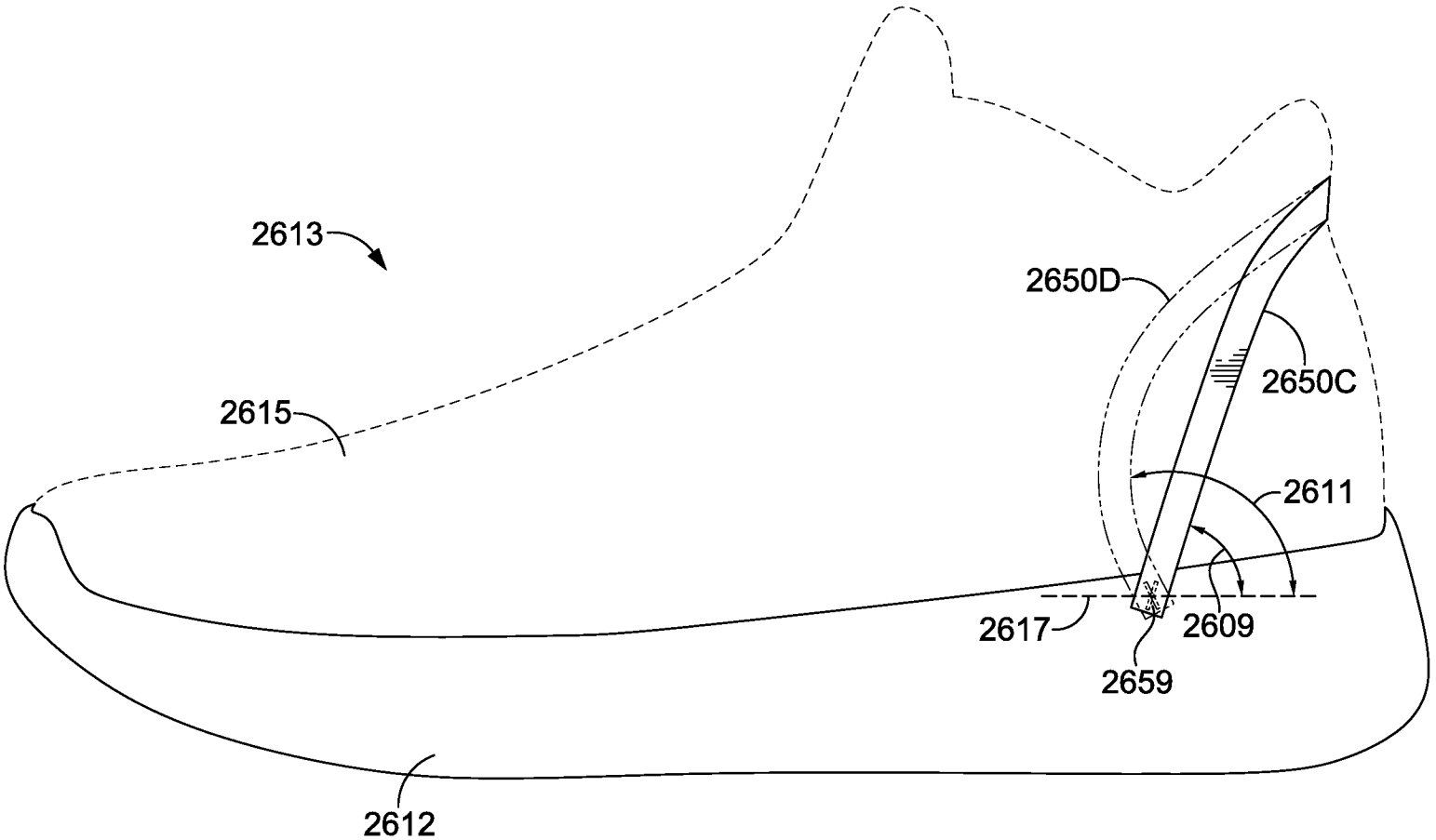
FIG. 26C depicts another footwear article having a larger adjustable orientation collar elevator at a base relative to FIG. 26A in accordance with an aspect of this disclosure.

FIGS. 26A-26C provide an alternative variable connection configuration.

Specifically, instead of having a corresponding male and female structures having correlated shaping as shown in FIG. 25B, the variable connection configuration of FIGS. 26A-26C provides a non-complimentary shaped male and female structures. Specifically, as seen best in FIG. 26B, a male structure 2601 has a rectilinear cross section and a multi-faceted aperture 2603 has a non-rectilinear cross section (e.g., star shaped, internal sprocket shaped). This non-complimentary shaping allows for the collar elevator to have an interaction surface of the male component (e.g., major surfaces of the rectilinear male projection) without enlarging the proximal end of the collar elevator to accommodate a symmetrical male projection with sufficient interaction surfaces, in an example.

FIGS. 26A and 26B provide another footwear article 2610 having an upper 2614, a sole 2612, and a variable connection 2659. The footwear article 2610 depicts alternative collar elevators, a first collar elevator 2650A and a second collar elevator 2650B to emphasize the flexibility in design, tooling, and inventory provided by a variable connection. The first collar elevator 2650A forms an angle 2605 from a horizontal reference 2617 and the second collar elevator 2650B forms a second angle 2607 from the horizontal reference 2617.

FIG. 26B provide an exploded perspective view of the footwear article 2610. The male structure 2601 extends from the distal end 2602 of the collar elevator 2650A. This is depicted as a structure having a rectilinear cross-section, but any cross-section shape is contemplated. The multi-faceted aperture 2603 is also depicted having a number of facets adapted to receive and secure the male structure 2601 at various angles.

FIG. 26C depicts another footwear article 2613 having a different style upper 2615 than the upper 2614 of FIG. 26A, while maintaining a common sole 2612, in accordance with aspects hereof. FIG. 26C is effective to demonstrate how a common base (e.g., sole 2612) can be paired with a different upper and the variable orientation connection between the collar elevator and the base provides assembly freedom. Stated differently, a common base may be used for different upper configuration by leveraging a variable orientation connection between the common base and the collar elevator (s). This can reduce inventor and tooling needs for the footwear manufacturer while allowing the footwear to have a collar elevator.

FIG. 26C is also effective to demonstrate the flexibility of different collar elevator configurations for a common base. A first collar elevator 2650C forms an angle 2609 from the horizontal reference 2617. A second collar elevator 2650D forms a second angle 2611 from the horizontal reference 2617. As such, variable configuration may be achieved with a variable orientation connection.

Figure 27A:
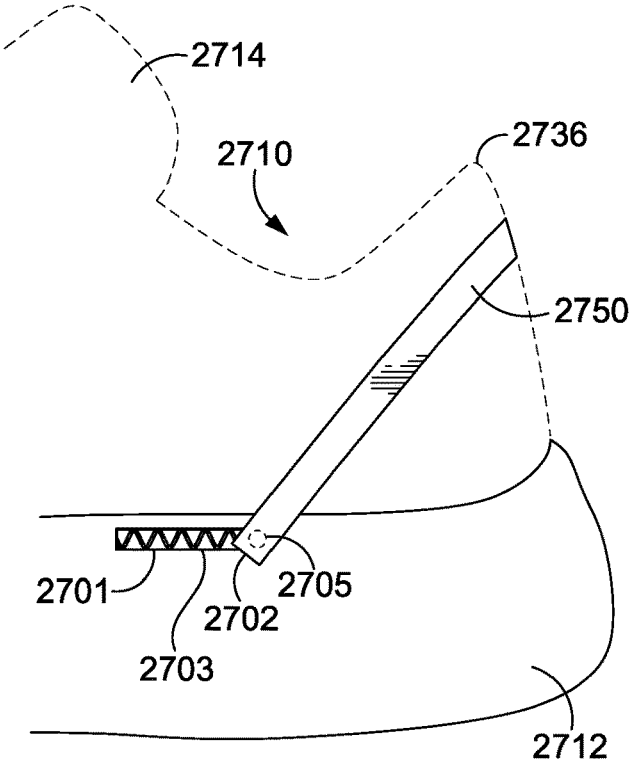
FIGS. 27A-27C depict another footwear article having a linear biasing configuration for a collar elevator in accordance with an aspect of this disclosure.
Figure 27B:
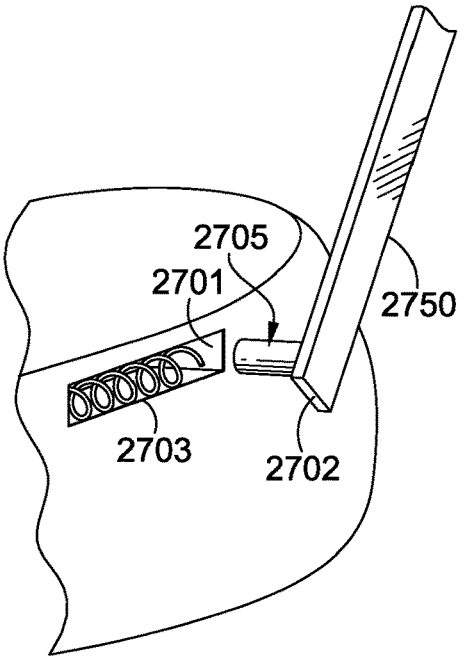
Figure 27C:
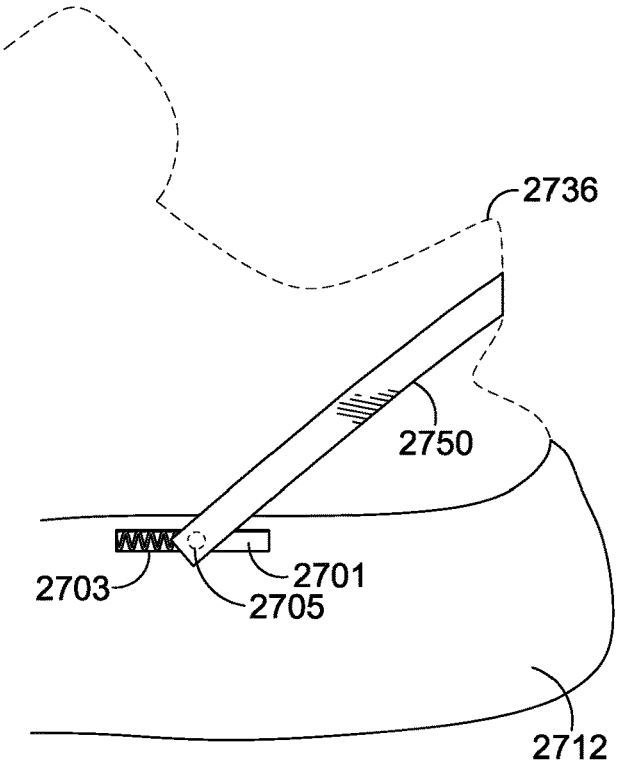

FIGS. 27A-28C depict variations of a sliding collar elevator, in accordance with aspects hereof. FIGS. 27-27C depicts a first example of a sliding collar elevator 2750 having a projection 2705 at a proximal end 2702. The projection 2705 extends into a slot 2701 containing a biasing element/material. The slot 2701 is formed in a base, such as a sole 2712. The slot 2701 provides a channel in which the projection 2705 is slideably secured. The motion path is limited based on the shape of the slot 2701. As depicted that motion path is linear, but it is contemplated that other motion paths may be leveraged to achieve a variety of collar elevator actions. The slot has a first end that is more toeward and a second end that is more heelward. As such, in an example, a first lever arm proximal end is more proximal the slot second end (e.g., the heelward end of the slot) when the ankle collar is in the raised state and the first lever arm proximal end is more distal from the slot second end (e.g., closer to the toward end of the slot) when the ankle collar is in the lowered state.

It is contemplated that the collar elevator 2750 is secured with the upper 2714 in any manner provided herein. As such, as a force is exerted on the ankle collar 2736 to don the footwear article, the force is translated from the ankle collar 2736 to cause a lowering (e.g., crushing) of the upper 2714 to open the footwear for foot insertion. The force is further translated through the collar elevator 2750 and converted into a motion dictated by the slot 2701. The projection 2705 slides and pivots within the slot 2701 as the collar elevator transfers the force load during a donning operation. The slot 2701 includes a biasing mechanism, such as a spring 2703. The spring 2703 is depicted as a spring that resists a compressive force and therefore urges the collar elevator 2750 into a raised state; however, it is contemplated that a spring resisting tension may be used on an opposite side of the projection 2705 in the slot 2701 to accomplish a similar response. The spring 2703 may be adjusted to provide varied levels of bias force. The size of the slot 2701 may also be adjusted to change a motion path length and pathway to adjust a response of the collar elevator.

FIG. 27B depicts an exploded perspective view from FIG. 27A. FIG. 27C depicts the footwear article of FIG. 27A in a lowered state. Specifically, the collar elevator 2750 pushes the projection 2705 forward in the slot 2701 to compress the spring 2703. The compression of the spring 2703 applies a return force on the projection 2705 to urge the collar elevator 2750 back into the raised state.

Figure 28A:
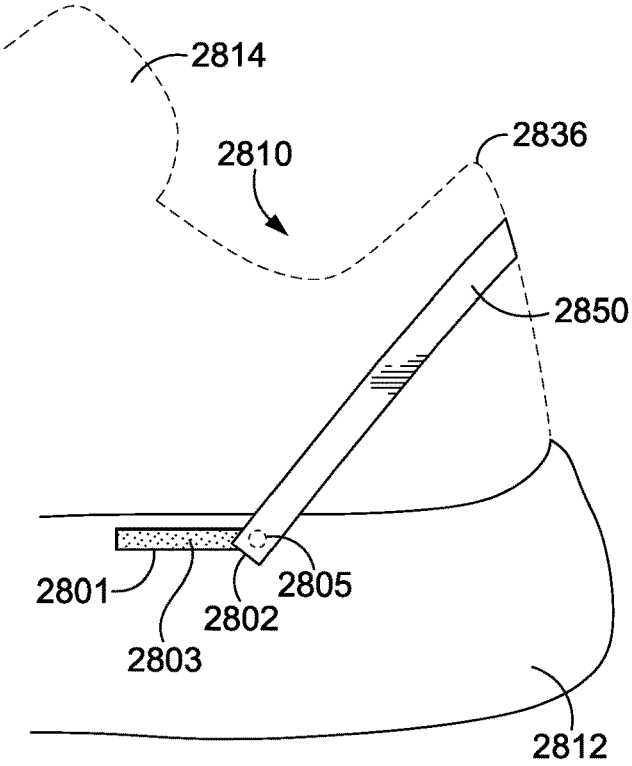
FIGS. 28A-28C depict another footwear article having a another linear biasing configuration for a collar elevator in accordance with an aspect of this disclosure.
Figure 28B:
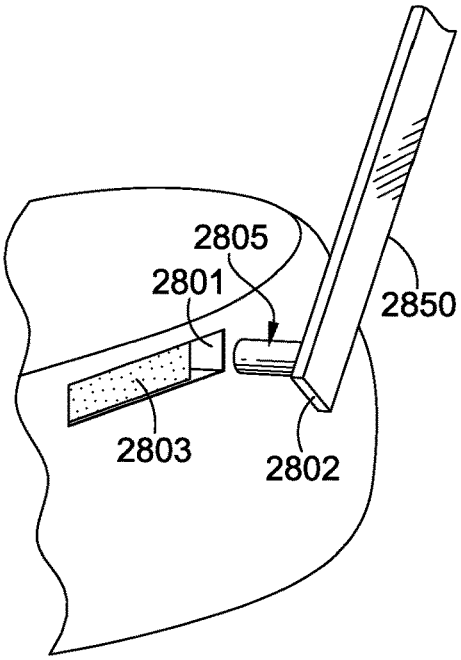
Figure 28C:
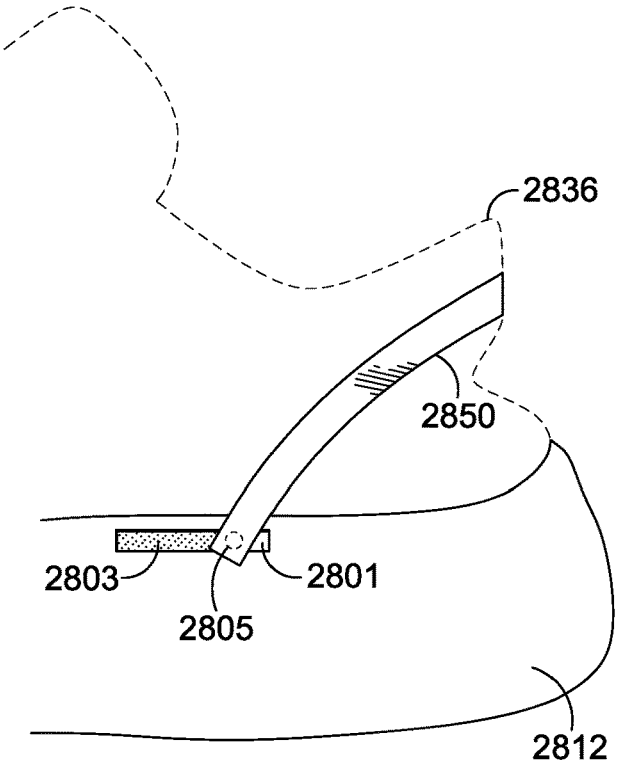

FIGS. 28-28C depicts a second example of a sliding collar elevator 2850 having a projection 2805 at a proximal end 2802. The projection 2805 extends into a slot 2801 containing a biasing element. The slot 2801 is formed in a base, such as a sole 2812. The slot 2801 provides a channel in which the projection 2805 is slideably secured. The motion path is limited based on the shape of the slot 2801. As depicted that motion path is linear, but it is contemplated that other motion paths may be leveraged to achieve a variety of collar elevator actions.

It is contemplated that the collar elevator 2850 is secured with the upper 2814 in any manner provided herein. As such, as a force is exerted on the ankle collar 2836 to don the footwear article, the force is translated from the ankle collar 2836 to cause a lowering (e.g., crushing) of the upper 2814 to open the footwear for foot insertion. The force is further translated through the collar elevator 2850 and converted into a motion dictated by the slot 2801. The projection 2805 slides and pivots within the slot 2801 as the collar elevator transfers the force load during a donning operation. The slot 2801 includes a biasing mechanism, such as a resilient material 2803. A resilient material is a compressible material that returns to a less compressed state. Examples of a resilient material include, but are not limited to a polymeric composition, such as a foamed composition. Examples also include material referenced in connection with a sole material, such as EVA.

In a specific aspect, it is contemplated that the slot 2801 is formed from a framework inserted into a mold tooling for the sole 2812. The framework allows for the inclusion of the sole forming material into the slot during the sole forming operation. The framework then provides a barrier between the sole material and the resilient material within the slot such that the resilient material within the slot is independently moveable relative to the material forming the sole. Stated differently, it is contemplated that during the forming of the sole, the slot may also be filled with a resilient material that is the same as the sole forming material. The framework also provides a track for guiding the repetitive movement of a projection that is biased by the resilient material.

FIG. 28B depicts an exploded perspective view from FIG. 28A. FIG. 28C depicts the footwear article of FIG. 28A in a lowered state. Specifically, the collar elevator 2850 pushes the projection 2805 forward in the slot 2801 to compress the resilient material 2803. The compression of the resilient material 2803 applies a return force on the projection 2805 to urge the collar elevator 2850 back into the raised state.

The concept of FIGS. 27A through 28C and the related disclosure are contemplated to be used in connection with various aspects provided herein. For example, different collar elevators having various sizes and shapes may be used in connection with the slide concept.

FIGS. 29A-32C provide variations in the lever arm configurations, in accordance with aspects herein. In particular, it is contemplated that any of the lever arm variations may be used in connection with the various aspects contemplated throughout the present disclosure.

Figure 29A:
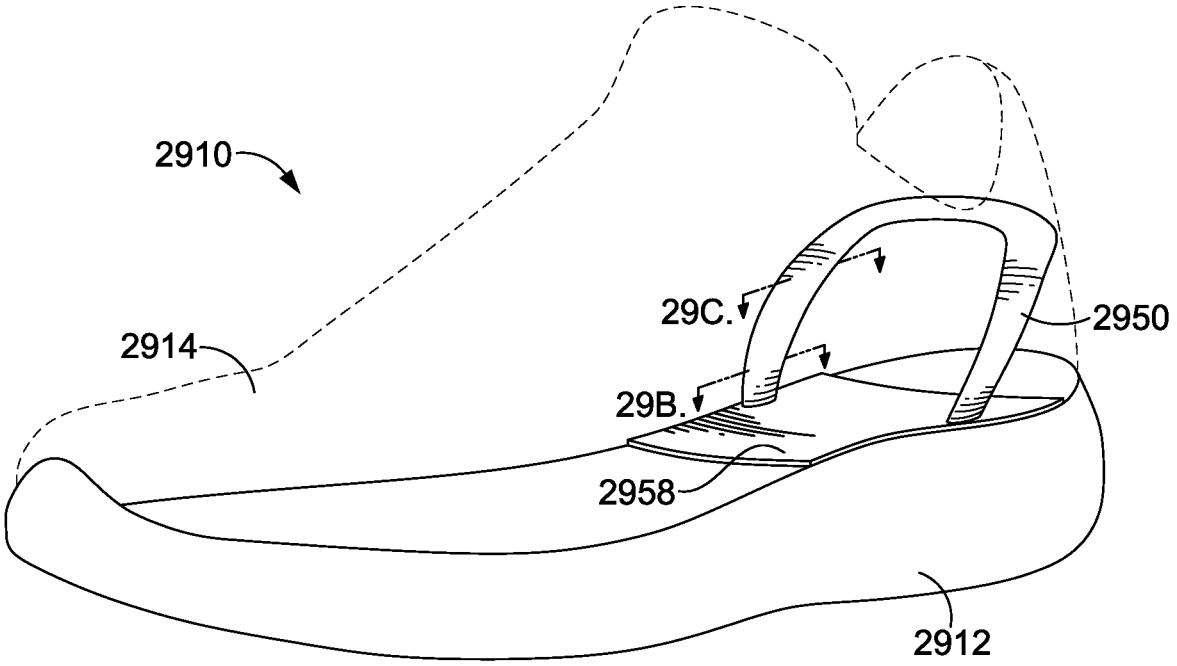
FIG. 29A depicts another footwear article having a variable cross-sectional collar elevator in accordance with an aspect of this disclosure.
Figure 29B:
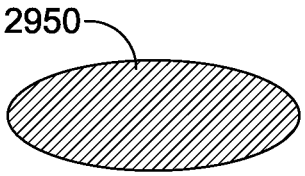
FIGS. 29B-29C depict cross sections along respective cut lines of FIG. 29A, in accordance with an aspect of this disclosure.
Figure 29C:
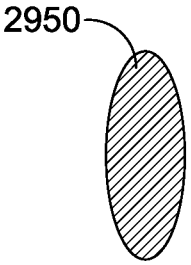

FIG. 29A depicts another footwear article 2910 having a variable cross-sectional collar elevator 2950 extending from a base 2958, in accordance with an aspect of this disclosure. As depicted in FIGS. 29B and 29C along respective cut lines in FIG. 29A, the collar elevator has a transitional geometry that has a first orientation at a first location and then transitions into a second orientation at a second location. For example, the cross section of FIG. 29B is near a proximal end of the collar elevator 2950 and it has an ovular cross section with the major axis aligned with a longitudinal axis of the footwear article 2910. As the collar elevator extend in a superior direction away from the base 2958, the cross section transitions to that depicted in FIG. 29C, which is still an ocular cross section, but the major axis is no in a medial-to-lateral direction of the footwear article 2910.

Because some forces presented to a collar elevator are directional in nature, such as a wearer's foot pressing on an ankle collar to don the footwear, the variable orientation of the cross section shape may be effective to engineer locations along the length of the collar elevator at which a deformation may occur and how the deformation occurs. For example, the collar elevator 2950 may be more prone to deforming in a direction of a minor axis in the cross section (i.e., direction perpendicular to the major axis). In this example, as a force is applied to the collar elevator 2950 during a donning operation, the collar elevator may bend outwardly (e.g., away from an interior of the footwear) at the cross section 29B and the collar elevator may bend in a direction of a longitudinal axis of the footwear at the cross section 29C. This varied deformation direction may allow for a widening of the ankle collar in a medial to lateral direction based on the deformation at the cross section 29B and a widening in the toe to heal direction based on the deformation at the cross section 29C. The varied cross section is therefore effective to engineer a deformation that aids in the used of the collar elevator, in an example.

Figure 30A:
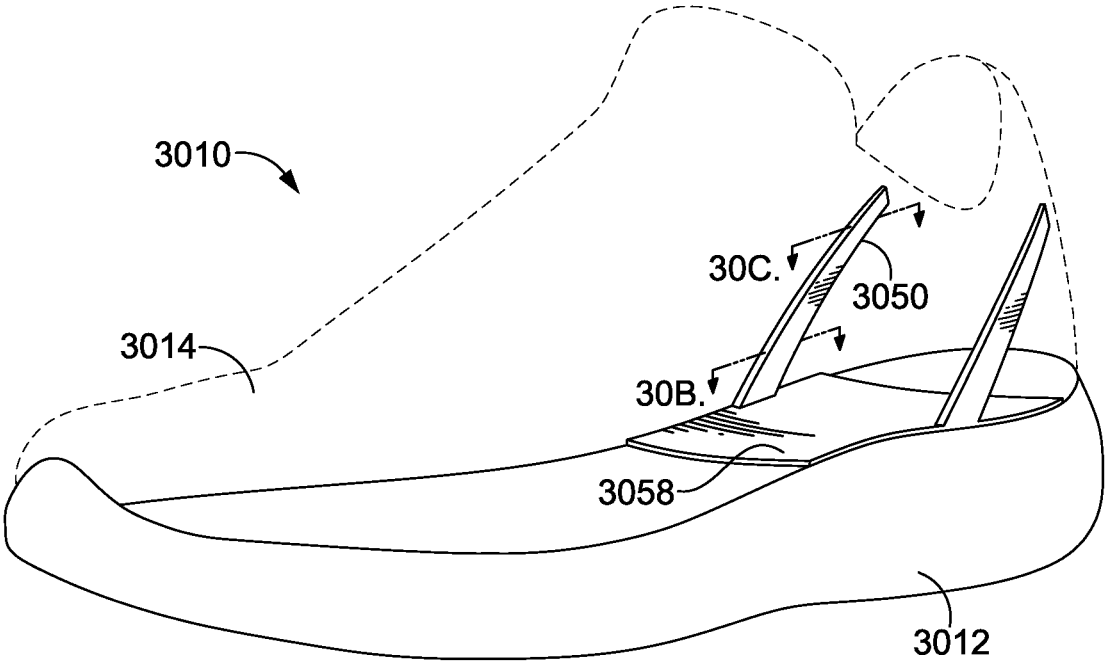
FIG. 30A depicts another footwear article having another variable cross-sectional collar elevator in accordance with an aspect of this disclosure.
Figure 30B:
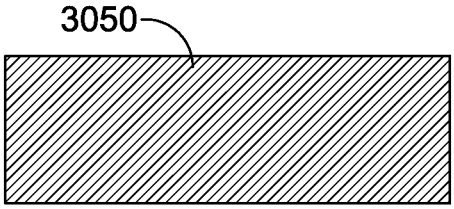
FIGS. 30B-30C depict cross sections along respective cut lines of FIG. 30A, in accordance with an aspect of this disclosure.
Figure 30C:
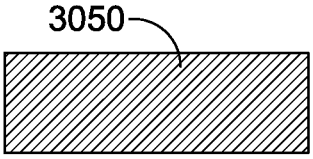

FIG. 30A depicts another footwear article 3010 having another variable cross-sectional collar elevator 3050, in accordance with an aspect of this disclosure. In this example, have a gradient cross section as the collar elevator 3050 extends away from a base 3058 allows for a variable deformation along a length of the collar elevator. As can be seen in FIG. 30B a first cross section is provided that is a greater surface area than a cross section depicted in FIG. 30C. The cross section 30B is more proximate the base 3058 than the cross section 30C. Therefore, the collar elevator 3050 tapers as it extends away from the base. This variable cross section engineers deformation such that an initial deformation occurs at a higher location (e.g., closer to a distal end of the collar elevator) and as deformation continues to occur because of additional forces being applied, such as a foot enters the footwear, the deformation (e.g., bending) occurs at portions closer to the base 3058, in an example. While a rectilinear cross section is depicted in FIGS. 30A-30C, it is appreciated that a gradient cross section may be formed from any cross section shape.

Figure 31A:
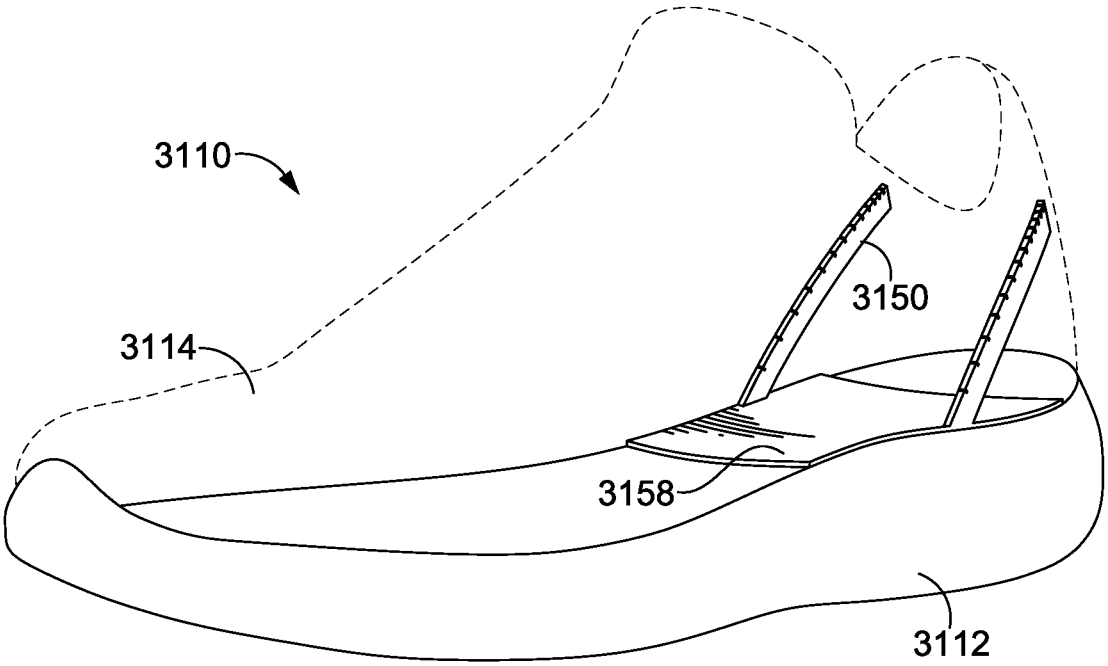
FIG. 31A depicts another footwear article having a variable slit collar elevator in accordance with an aspect of this disclosure.
Figure 31B:
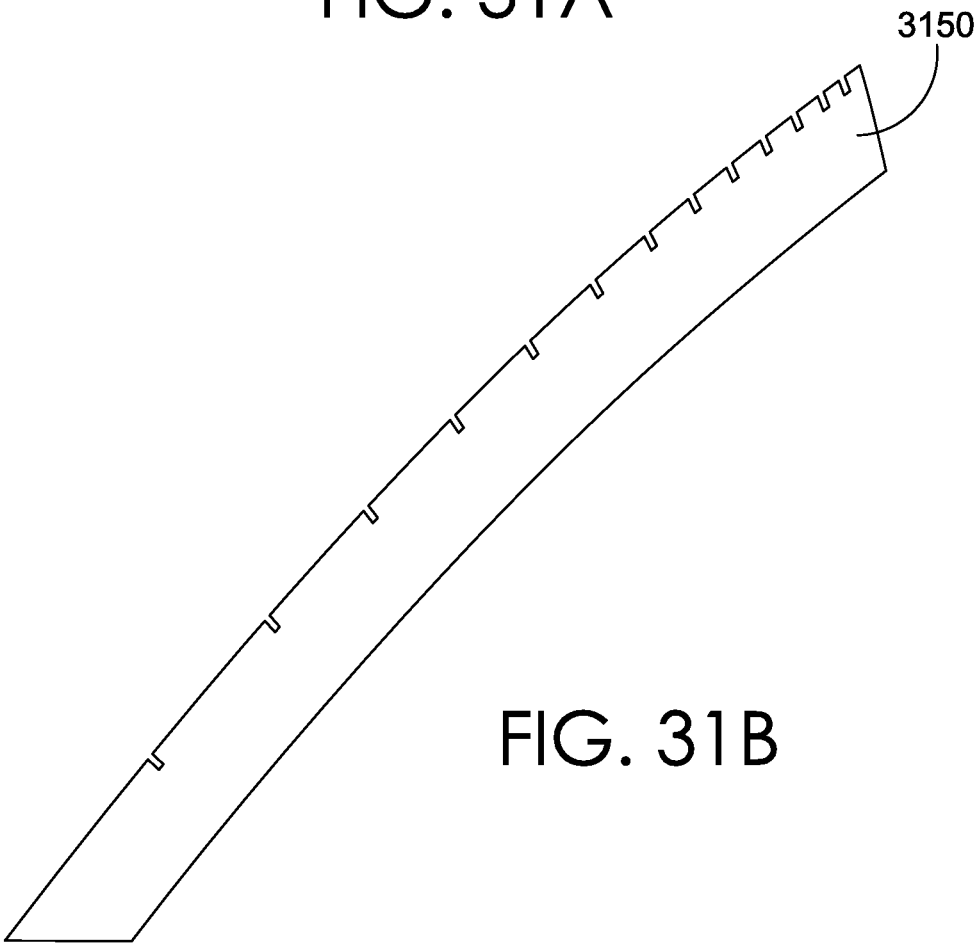
FIG. 31B depicts the variable slit collar elevator of FIG. 31A in accordance with an aspect of this disclosure.

FIG. 31A depicts another footwear article 3110 having an upper 3114, a sole 31112, and a variable slit collar elevator 3150 extending from a base 3158 in accordance with an aspect of this disclosure. Depicted are a plurality of slits extending into the collar elevator 3150. The slits provide an engineered fatigue point where deformation is more likely to occur. The slits in this example are placed on the toe-end facing surface to encourage a heel-end direction deformation to aid in transitioning from a raised state to a lowered state. Also noted in FIG. 31B, which is a magnified side perspective of the collar elevator 3150 of FIG. 31A, is a gradient of slits. A higher concentration of slits per length is found at the distal end relative to the proximal end. This gradient encourages a deformation to initially occur at the distal end and as additional force is applied, the deformation moves toward the proximal end. The slits also encourage a specific direction of deformation. For example, to encourage a longitudinal direction of deformation rather than a medial-to-lateral deformation, slits extending in the encouraged direction may be leveraged.

Figure 32A:
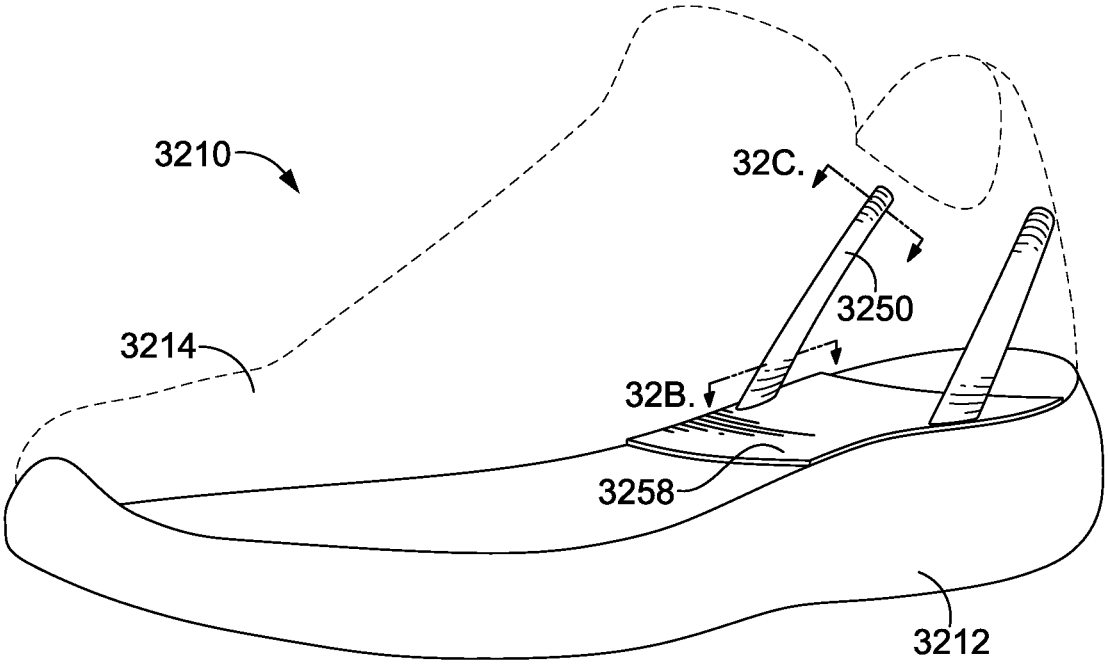
FIG. 32A depicts another footwear article having another variable cross-sectional collar elevator in accordance with an aspect of this disclosure.
Figure 32B:
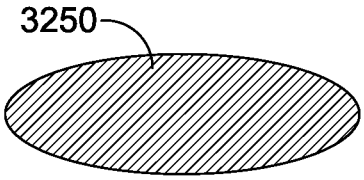
FIGS. 32B-32C depict cross sections along respective cut lines of FIG. 32A, in accordance with an aspect of this disclosure.
Figure 32C:
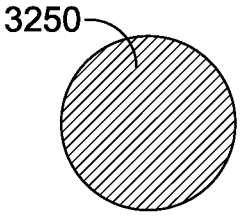
Figure 33:
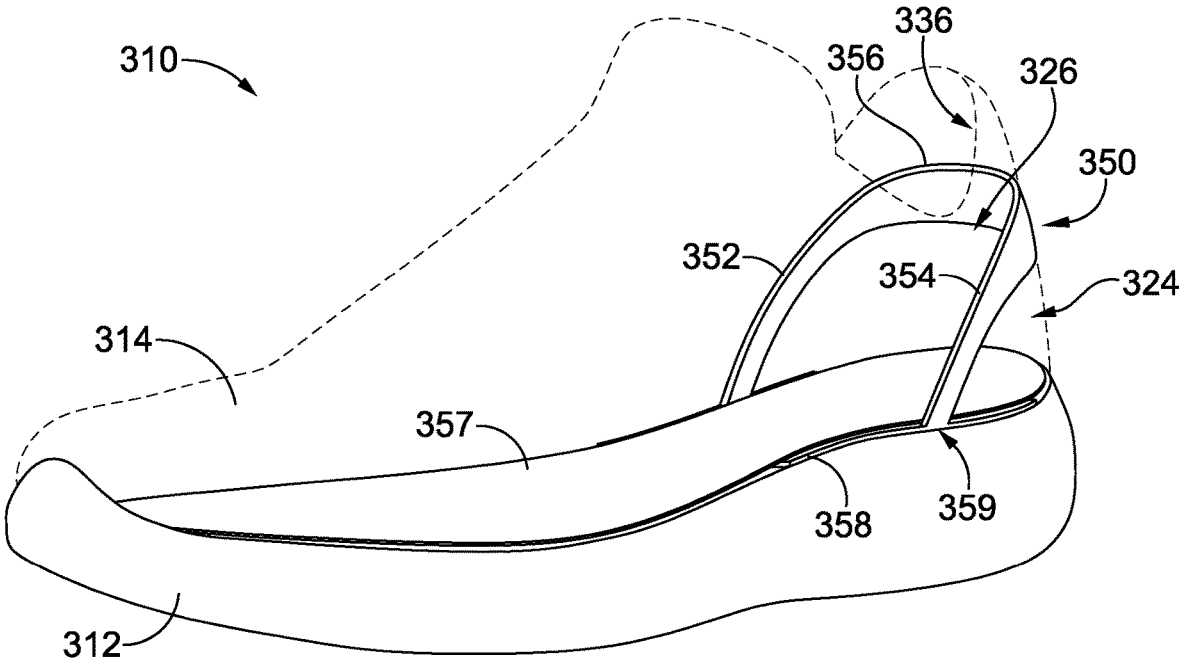
FIG. 33 depicts another footwear article having a strobel, in accordance with an aspect of this disclosure.

FIG. 32A depicts another footwear article 3210 having an upper 3214, a sole 3212, and another variable cross-sectional collar elevator 3250 extending from a base 3258, in accordance with an aspect of this disclosure. The collar elevator 3250 has a variable cross section shape along a length thereof. At a cross section 32B, the collar elevator has an ovular cross section shape with a major axis in the longitudinal direction of the footwear, as depicted in FIG. 32B. The cross section 32C that is closer to a distal end of the collar elevator 3250 has a different cross section of a circular shape, as seen in FIG. 32C. Furthermore, FIG. 33 depicts another aspect of the present invention of an article of footwear 310 having a strobel 357 and a base 358. In one aspect, the collar elevator 350 may be attached to the strobel 357 or the base 358, and in another aspect, the collar elevator 350 may be connected with the strobel 357 and connected with an upper 314 in a heel region 324.

Having a variable shape cross section allows for an engineering of the where the initial deformation is to occur. Further, the variable cross section shape allows for a reduction in material usage and potential comfort of wear, in some example. While a transition from an oval to a circle cross section is depicted, it is understood that any combination of shapes in any order and in any number may be leveraged in accordance with aspects hereof. Additionally, a smooth transition between two or more cross section shapes may not occur in all aspects. Instead, an abrupt transition between two cross section shapes may occur when engineering the collar elevator.

"A," "an," "the," "at least one," and "one or more" might be used interchangeably to indicate that at least one of the items is present. When such terminology is used, a plurality of such items might be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives might be employed throughout this detailed description corresponding to the illustrated examples. Ordinary skilled artisans will recognize that terms such as "above," "below," "upward," "downward," "top," "bottom," etc., may be used descriptively relative to the figures, without representing limitations on the scope of the invention, as defined by the claims.

The term "longitudinal," as possibly used throughout this detailed description and in the claims, refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse," as possibly used throughout this detailed description and in the claims, refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical," as possibly used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region, and/or a throat of an upper. The term "downward" or "downwards" refers to the vertical direction pointing opposite the upwards direction, toward the bottom of a component, and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" shall refer to the direction toward the interior of the component or article of footwear, such as a shoe, and the terms "outward" and "outwardly" shall refer to the direction toward the exterior of the component or article of footwear, such as a shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

The following clauses represent contemplated aspects herein. The listing is merely specific examples and is not limiting on to the scope of the current Specification. Instead, the following clauses are intended to provide guidance as to some of the contemplated aspects herein. Interpretation of the phrase "the footwear article of clause x-y" as used hereinafter should be interpreted as the footwear of any one or combination of clause x through clause y, where x and y are numerical clauses.

Clause 1. A footwear article comprising: an upper coupled to a sole and comprising an ankle collar that is movable between a lowered state positioned closer to the sole and a raised state positioned farther from the sole; and a collar elevator operable to return the ankle collar from the lowered state to the raised state, the collar elevator comprised of: a first lever arm having a proximal end and a distal end, and a second lever arm having a proximal end and a distal end, wherein the first lever arm distal end and the second lever arm distal end are discontiguous.

Clause 2. The footwear article of clause 1, wherein the first lever arm proximal end is continuous with a base.

Clause 3. The footwear article of clause 2, wherein the base is layered below an insole and above a midsole.

Clause 4. The footwear article of clause 2, wherein the base extends to the second lever arm proximal end.

Clause 5. The footwear article of clause 2, wherein the base is a U-shaped element extending between the first lever proximal end and the second level distal end around a heel end of the sole.

Clause 6. The footwear article of clause 1-5, wherein the first lever arm proximal end is distinct from and joined with a base.

Clause 7. The footwear article of clause 6, wherein the base is layered below an insole and above a midsole.

Clause 8. The footwear article of clause 6, wherein the base extends to the second lever arm proximal end.

Clause 9. The footwear article of clause 6, wherein the base is a U-shaped element extending between the first lever proximal end and the second level distal end around a heel end of the sole.

Clause 10. The footwear article of clause 6, wherein the first lever arm and the base are releasably joined or permanently joined.

Clause 11. The footwear article of clause 1-10, wherein the first lever arm extends in a heelward direction from the proximal end toward the distal end.

Clause 12. A footwear article comprising: an upper coupled to a sole and comprising an ankle collar that is movable between a lowered state positioned closer to the sole and a raised state positioned farther from the sole; a collar elevator operable to return the ankle collar from the lowered state to the raised state, the collar elevator comprised of a first lever arm having a proximal end and a distal end, wherein the first lever arm distal end is independently moveable relative to the sole; and a heel pull at a heel end of the upper.

Clause 13. The footwear article of clause 12, wherein the collar elevator further comprises a second lever arm having a proximal end and a distal end, the first lever arm distal end and the second lever arm distal end are discontiguous and at least one of the first lever arm distal end and the second arm distal end overlap a portion of the heel pull.

Clause 14. The footwear article of clause 12, wherein the collar elevator further comprises a second lever arm having a proximal end and a distal end, the first lever arm distal end and the second lever arm distal end are discontiguous and neither of the first lever arm distal end and the second arm distal end overlap the heel pull, such that a first distance between the first lever arm distal end and the second arm distal end is greater than a width of the heel pull in a first to second direction.

Clause 15. The footwear article of clause 12-14, wherein the heel pull is monolithic with the upper.

Clause 16. The footwear article of clause 12-14, wherein the heel pull is distinct from the upper and joined with the upper.

Clause 17. The footwear article of clause 12-14, wherein the heel pull extends in a heelward direction more than the upper extends in the heelward direction.

Clause 18. The footwear of clause 12-17, wherein at least one material is positioned between the heel loop and the first lever arm.

Clause 19. The footwear article of clause 12-18, wherein the first lever arm at the distal end is below an upper-most junction of the heel pull and the upper.

Clause 20. The footwear article of clause 12-19, wherein the heel pull is joined with the upper on an exterior surface of the upper.

Clause 21. The footwear article of clause 12-20, wherein the first lever arm extends from one of a medial side or a lateral side of the footwear article to the other of the medial side or the lateral side of the footwear article.

Clause 22. A footwear article comprising: an upper coupled to a sole and comprising an ankle collar that is movable between a lowered state positioned closer to the sole and a raised state positioned farther from the sole; a collar slide having a proximal end and a distal end, the collar slide proximal end extending from the ankle collar at an upper-most heel end of the ankle collar; and a collar elevator operable to return the ankle collar from the lowered state to the raised state, the collar elevator comprised of a first lever arm having a proximal end and a distal end, wherein the first lever arm distal end is independently moveable relative to the sole and the first lever arm extends from the sole towards the ankle collar in the raised state position at a first angle that is greater than a second angle defined by the collar slide relative to the sole also in the raised state position.

Clause 23. The footwear article of clause 22, wherein the collar elevator further comprises a second lever arm having a proximal end and a distal end, the first lever arm distal end and the second lever arm distal end are discontiguous and at least one of the first lever arm distal end and the second arm distal end overlap at least a portion of a width including the collar slide.

Clause 24. The footwear article of clause 22, wherein the collar elevator further comprises a second lever arm having a proximal end and a distal end, the first lever arm distal end and the second lever arm distal end are discontiguous and neither of the first lever arm distal end and the second arm distal end overlap a width including the collar slide, such that a first distance between the first lever arm distal end and the second arm distal end is greater than a width of the collar slide.

Clause 25. The footwear article of clause 22-24, wherein the collar slide is monolithic with the upper.

Clause 26. The footwear article of clause 22-24, wherein the collar slide is distinct from the upper and joined with the upper.

Clause 27. The footwear article of clause 22-24, wherein the collar slide extends in a heelward direction more than the upper extends in the heelward direction.

Clause 28. The footwear of clause 22-27, wherein at least one material is positioned between the collar slide and the first lever arm.

Clause 29. The footwear article of clause 22-28, wherein the first lever arm at the distal end is below the proximal end of the collar slide.

Clause 30. The footwear article of clause 22-29, wherein the first lever arm extends from one of a medial side or a lateral side of the footwear article to the other of the medial side or the lateral side of the footwear article.

Clause 31. A footwear article comprising: an upper coupled to a sole and comprising an ankle collar that is movable between a lowered state positioned closer to the sole and a raised state positioned farther from the sole; a collar stay having a first end on a medial side of the upper and a second end on a lateral side of the upper, the collar stay extending around a heel end of the upper at the ankle collar; and a collar elevator operable to return the ankle collar from the lowered state to the raised state, the collar elevator comprised of: a first lever arm having a proximal end and a distal end, and a second lever arm having a proximal end and a distal end, wherein the first lever arm distal end and the second lever arm distal end are discontiguous.

Clause 32. The footwear article of clause 31, wherein at least one of the first lever arm distal end and the second arm distal end overlap at least a portion of a width including the collar stay.

Clause 33. The footwear article of clause 31, wherein neither of the first lever arm distal end nor the second arm distal end overlap a width including the collar stay, such that a first distance between the first lever arm distal end and the second arm distal end is greater than a width of the collar stay.

Clause 34. The footwear article of clause 31-33, wherein the collar stay is a polymeric composition having a stiffness that is greater than a stiffness of an adjacent material forming the upper.

Clause 35. The footwear article of clause 31-34, wherein the collar stay is distinct from the upper and joined with the upper.

Clause 36. The footwear article of clause 31-34, wherein the collar stay is joined to an exterior layer of the upper or between the exterior layer of the upper and an inner lining of the footwear article.

Clause 37. The footwear of clause 31-36, wherein at least one material is positioned between the collar stay and the first lever arm.

Clause 38. The footwear article of clause 31-37, wherein the first lever arm at the distal end is below the collar stay in the raised state position.

Clause 39. A footwear article comprising: an upper coupled to a sole and comprising an ankle collar that is movable between an opened state position and a closed state position; and a collar elevator operable to return the ankle collar from the lowered state to the raised state, the collar elevator comprised of a first lever arm having a proximal end and a distal end, wherein at least a portion of the first lever arm undulates between the proximal end and the distal end.

Clause 40. The footwear article of clause 39, wherein the collar elevator is further comprised of a second lever arm having a proximal end and a distal end and an undulation between the proximal end and the distal end, wherein the first lever arm distal end and the second lever arm distal end are discontiguous.

Clause 41. The footwear article of clause 39-40, wherein the first lever arm extends from the sole toward the ankle collar at the heel end of the sole.

Clause 42. The footwear article of clause 39-40, wherein the first lever arm extends from the sole toward the ankle collar in a heelward direction.

Clause 43. The footwear article of clause 39, wherein the collar elevator is further comprised of a second lever arm having a proximal end and a distal end and an undulation between the proximal end and the distal end, wherein the first lever arm distal end and the second lever arm distal end are continuous.

Clause 44. A footwear article comprising: an upper coupled to a sole and comprising an ankle collar that is movable between a opened state positioned and a closed state position; and a collar elevator operable to return the ankle collar from the lowered state to the raised state, the collar elevator comprised of: a first lever arm having a proximal end at the sole and a distal end toward the ankle collar, a first resilient member extending in a toeward direction from the first lever arm toward the sole on a medial side, and a second resilient member extending in a toeward direction from the first lever arm toward the sole on a lateral side.

Clause 45. The footwear article of clause 44, wherein the first resilient member has a first length between the first lever arm and the sole in the closed state and the first resilient member has a second length between the first lever arm and the sole in the open state, the second length is greater than the first length.

Clause 46. The footwear article of clause 45, wherein the second resilient member has a first length between the first lever arm and the sole in the closed state and the second resilient member has a second length between the first lever arm and the sole in the open state, the second length is greater than the first length.

Clause 47. The footwear article of clause 44-46, wherein the first resilient member has a Young's modulus that is lower than the first lever arm.

Clause 48. The footwear article of clause 44-47, wherein the first lever arm articulates at the sole from a vertical to a rearward direction when transitioning from the closed state position to the open state position.

Clause 49. A footwear article comprising: an upper coupled to a sole and comprising an ankle collar that is movable between a lowered state positioned closer to the sole and a raised state positioned farther from the sole, wherein the sole is comprised of a multi-faceted aperture; and a collar elevator operable to return the ankle collar from the lowered state to the raised state, the collar elevator comprised of a first lever arm having a proximal end and a distal end, wherein the first lever arm proximal end is positioned within the multi-faceted aperture at a first orientation that provide a first angle between the first lever arm and the sole or a second orientation that provides a second angle between the first lever arm and the sole.

Clause 50. The footwear article of clause 49, wherein the first lever arm proximal end is comprised of a male form having a complimentary shape to the multi-faceted aperture.

Clause 51. The footwear article of clause 49, wherein the first lever arm proximal end is comprised of a male form having a non-complimentary shape to the multi-faceted aperture.

Clause 52. The footwear article of clause 49-51, wherein the collar elevator further comprises a second lever arm having a proximal end and a distal end, the second lever arm proximal end is positioned within a second multi-faceted aperture of the sole at a first orientation that provide a first angle between the first lever arm and the sole or a second orientation that provides a second angle between the first lever arm and the sole.

Clause 53. The footwear article of clause 52, wherein the first angle of the first lever arm and the first angle of the second lever arm are a common angle and the second angle of the first lever arm and the second angle of the second lever arm are a common angle.

Clause 54. The footwear article of clause 52, wherein the second lever arm proximal end is comprised of a male form having a non-complimentary shape to the multi-faceted aperture.

Clause 55. A footwear article comprising: an upper coupled to a sole and comprising an ankle collar that is movable between a lowered state positioned closer to the sole and a raised state positioned farther from the sole, wherein the sole is comprised of a slot on a first side; and a collar elevator operable to return the ankle collar from the lowered state to the raised state, the collar elevator comprised of a first lever arm having a proximal end and a distal end, the first lever arm including a protrusion extending away from the first lever arm and toward the sole and engaged with the sole in the slot, wherein a resilient material is in the slot on a first side of the protrusion.

Clause 56. The footwear article of clause 55, wherein the resilient material is a spring.

Clause 57. The footwear article of clause 56, wherein the spring is a compression spring.

Clause 58. The footwear article of clause 55, wherein the resilient material is a polymeric composition.

Clause 59. The footwear article of clause 58, wherein the polymeric composition is a foamed polymeric composition.

Clause 60. The footwear article of clause 59, wherein the foamed polymeric composition is ethylene vinyl acetate.

Clause 61. The footwear article of clause 55, wherein the resilient material is a polymeric material and the sole also comprises the polymeric material.

Clause 62. The footwear article of clause 55, wherein the sole is comprised of a second slot on a second side, wherein the first side is a medial sidewall of the sole and the second side is a lateral sidewall of the sole.

Clause 63. The footwear article of clause 62, wherein the collar elevator is further comprised of a second lever arm having a proximal end and a distal end, the second lever arm including a protrusion extending toward the sole and engaged with the sole in the second slot, wherein a resilient material is in the second slot on a first side of the protrusion.

Clause 64. The footwear article of clause 63, wherein the first side of the protrusion in the second slot is a toe-end side of the slot.

Clause 65. A footwear article comprising an upper coupled to a sole and comprising an ankle collar that is movable between a lowered state positioned closer to the sole and a raised state positioned farther from the sole, wherein the sole comprising: a slot having a first end and a second end, and a resilient material in the slot between the first end and the second end; and a collar elevator operable to return the ankle collar from the lowered state to the raised state, the collar elevator comprising a first lever arm having a proximal end and a distal end, the first lever arm proximal end is more proximal the slot second end when the ankle collar is in the raised state and the first lever arm proximal end is more distal from the slot second end when the ankle collar is in the lowered state.

Clause 66. The footwear article of clause 65, wherein the resilient material is a spring.

Clause 67. The footwear article of clause 66, wherein the spring is a compression spring.

Clause 68. The footwear article of clause 65, wherein the resilient material is a polymeric composition.

Clause 69. The footwear article of clause 68, wherein the polymeric composition is a foamed polymeric composition.

Clause 70. The footwear article of clause 69, wherein the foamed polymeric composition is ethylene vinyl acetate.

Clause 71. The footwear article of clause 65, wherein the resilient material is a polymeric material and the sole also comprises the polymeric material.

Clause 72. The footwear article of clause 65-71, wherein the sole is comprised of a second slot on a second side, wherein the slot is on a medial sidewall of the sole and the second slot is on a lateral sidewall of the sole.

Clause 73. The footwear article of clause 72, wherein the collar elevator is further comprised a second lever arm having a proximal end and a distal end, the second lever arm proximal end is more proximal a second end of the second slot when the ankle collar is in the raised state and the first lever arm proximal end is more distal from the second end of the second slot when the ankle collar is in the lowered state.

Clause 74. The footwear article of clause 65-73, wherein the resilient material is disposed between the first lever proximal end and the slot first end.

Clause 75. The footwear article of clause 74, wherein the resilient material is absent between the first lever proximal end and the slot second end.

Clause 76. The footwear article of clause 74, wherein the resilient material is under a first compression when the ankle collar is in the raised state and the resilient material is under a second compression that is greater than the first compression when the ankle collar is in the lowered state.

Clause 77. The footwear article of clause 65-76, wherein the first lever arm is comprised of a protrusions that extends into the slot and engages with the resilient material in the slot.

From the foregoing, it will be seen that this invention is one well adapted to attain all the ends and objects hereinabove set forth together with other advantages which would be realized by an ordinary skilled artisan and which are inherent to the structure.

It will be understood that certain features and subcombinations are of utility and may be employed without reference to other features and subcombinations. This is contemplated by and is within the scope of the claims.

Since many possible aspects may be made of the invention without departing from the scope thereof, it is to be understood that all matter herein set forth or shown in the accompanying drawings is to be interpreted as illustrative and not in a limiting sense.

The invention claimed is:

1. A footwear article capable of hands-free donning, comprising:

a sole including a ground-contacting surface;

an upper formed, at least in part, with a knit textile, the upper having a heel region; and a collar elevator coupled with the upper in the heel region, and a separate collar slide that is spaced apart from the collar elevator by a distance, the collar slide forming a ramp interface during a donning operation, wherein:

(1) a ground plane reference line is tangential to the ground-contacting surface of the sole;

(2) a first reference line extending tangential to the collar slide at an anterior location of the upper such that the first reference line intersects the ground plane reference line forming a first angle;

(3) a second reference line extending tangential to the collar elevator at a proximal end of the collar elevator such that the second reference line intersects the ground plane reference line forming a second angle; and (4) the first angle is less than the second angle.

2. The footwear article of claim 1, wherein the sole comprises a polymer foam composition.

3. The footwear article of claim 2, wherein the polymer foam composition comprises at least a polyurethane composition or an ethylene vinyl acetate composition.

4. The footwear article of claim 1, further comprising a midsole integrated with an outsole.

5. The footwear article of claim 1, wherein the upper continuously extends from a medial side to a lateral side across a forefoot portion of the upper.

6. The footwear article of claim 1, wherein the upper does not comprise a forefoot opening.

7. The footwear article of claim 1, wherein the collar slide is integral with the ankle collar.

8. The footwear article of claim 1, wherein the knit textile comprises a stretch portion.

9. The footwear article of claim 1, wherein the collar elevator is affixed to an exterior layer and an inner lining of the footwear article.

10. The footwear article of claim 9, wherein the collar elevator is entirely between the exterior layer and the inner lining of the footwear article.

11. The footwear article of claim 1 further comprising a base, wherein the collar elevator is connected with the base.

12. The footwear article of claim 11, wherein the base is at least one selected from a portion of an outsole of the sole, a portion of a midsole of the sole, a portion of an insole, or a portion of a strobel.

13. The footwear article of claim 11, wherein the collar elevator extends from the base to an ankle collar.

14. The footwear article of claim 11, wherein the collar slide is positioned proximate a heel portion of the footwear article.

15. The footwear article of claim 1 further comprising a strobel, wherein the collar elevator is attached to the strobel.

16. The footwear article of claim 1, wherein the collar elevator has a variable cross section between two locations along a superior-extending direction of the collar elevator.

17. The footwear article of claim 1 further comprising an ankle collar, wherein the collar elevator is coupled with the ankle collar.

18. The footwear article of claim 1, wherein the collar elevator comprises a heel structure having a curved profile in a medial to lateral direction of the footwear article in the heel region.

19. A footwear article capable of hands-free donning, comprising:

a sole including a ground-contacting surface and a foot-facing surface;

an upper having a heel region and a throat;

a strobel, the strobel affixed to the foot-facing surface of the sole; and a collar elevator comprising a heel structure, the collar elevator connected with the strobel and coupled with the upper in the heel region, the collar elevator including a separate collar slide that is spaced apart from the collar elevator by a distance, the collar slide forming a ramp interface during a donning operation, wherein:

(1) a ground plane reference line is tangential to the ground-contacting surface of the sole;

(2) a first reference line extending tangential to the collar slide at an anterior location of the upper such that the first reference line intersects the ground plane reference line forming a first angle;

(3) a second reference line extending tangential to the collar elevator at a proximal end of the collar elevator such that the second reference line intersects the ground plane reference line forming a second angle; and the first angle is less than the second angle.

* * * * *